US011503407B2

(12) United States Patent
Corynen

(10) Patent No.: US 11,503,407 B2
(45) Date of Patent: Nov. 15, 2022

(54) LOUDSPEAKER UNIT

(71) Applicant: PSS BELGIUM NV, Dendermonde (BE)

(72) Inventor: David Corynen, Dendermonde (BE)

(73) Assignee: PSS Belgium NV, Dendermonde (BE)

( * ) Notice: Subject to any disclaimer, the term of this patent is extended or adjusted under 35 U.S.C. 154(b) by 0 days.

(21) Appl. No.: 17/044,555

(22) PCT Filed: Mar. 12, 2019

(86) PCT No.: PCT/EP2019/056109
§ 371 (c)(1),
(2) Date: Oct. 1, 2020

(87) PCT Pub. No.: WO2019/192808
PCT Pub. Date: Oct. 10, 2019

(65) Prior Publication Data

US 2021/0168504 A1 Jun. 3, 2021

(30) Foreign Application Priority Data

Apr. 4, 2018 (GB) ..... 1805523

(51) Int. Cl.

| | |
|---|---|
| ***H04R 3/12*** | (2006.01) |
| ***G10K 11/178*** | (2006.01) |
| ***H04R 1/02*** | (2006.01) |
| ***H04R 1/28*** | (2006.01) |
| ***H04R 1/40*** | (2006.01) |

(52) U.S. Cl.
CPC ..... *H04R 3/12* (2013.01); *G10K 11/17873* (2018.01); *H04R 1/025* (2013.01); *H04R 1/2826* (2013.01); *H04R 1/403* (2013.01); *G10K 2210/1281* (2013.01); *G10K 2210/1282* (2013.01); *G10K 2210/3027* (2013.01); *H04R 2400/11* (2013.01); *H04R 2499/13* (2013.01)

(58) Field of Classification Search
None
See application file for complete search history.

(56) References Cited

U.S. PATENT DOCUMENTS 6,650,758 B1 11/2003 Van Schyndel
7,688,992 B2 3/2010 Aylward et al.
(Continued)

FOREIGN PATENT DOCUMENTS

EP 0717916 A1 6/1996
EP 0988771 A1 3/2000
(Continued)

OTHER PUBLICATIONS

UKIPO, Search Report for corresponding GB Patent Application No. 1805523.6, dated Sep. 13, 2018, 1 page.
(Continued)

*Primary Examiner* — Kenny H Truong
(74) *Attorney, Agent, or Firm* — NK Patent Law

(57) ABSTRACT

A loudspeaker unit for producing sound at bass frequencies an array of two or more diaphragms. The first radiating surface and the second radiating surface are located on opposite faces of the diaphragm, and one or more of the
(Continued)

diaphragms are included in a first subset of the diaphragms and one or more of the diaphragms are included in a second subset of the diaphragms; a plurality of drive units.

7 Claims, 32 Drawing Sheets

(56) References Cited

U.S. PATENT DOCUMENTS

| | | | | |
|---|---|---|---|---|
| 7,692,363 | B2 | 4/2010 | Butler | |
| 8,130,987 | B2 | 3/2012 | Kaneda | |
| 9,327,628 | B2 | 5/2016 | Subat | |
| 9,428,090 | B2 | 8/2016 | Subat | |
| 9,440,566 | B2 | 9/2016 | Subat | |
| 2006/0056650 | A1 | 3/2006 | Hofmann et al. | |
| 2009/0141915 | A1 | 6/2009 | Ko et al. | |
| 2009/0284055 | A1* | 11/2009 | Aylward | H04R 1/403 381/388 |
| 2013/0101146 | A1 | 4/2013 | Mosgaard | |
| 2016/0286329 | A1 | 6/2016 | Grosche | |
| 2017/0085990 | A1* | 3/2017 | Sladeczek | H04S 7/307 |

FOREIGN PATENT DOCUMENTS

| | | | |
|---|---|---|---|
| EP | 1460879 | A2 | 9/2004 |
| EP | 1763281 | A2 | 3/2007 |
| EP | 2405670 | A1 | 1/2012 |
| WO | 2014143927 | A2 | 9/2014 |
| WO | 2017214019 | A1 | 12/2017 |

OTHER PUBLICATIONS

ISA/EP, International Search Report and Written Opinion for corresponding PCT Patent Application No. PCT/EP2019/056109, dated May 27, 2019, 20 pages.

Wikipedia: "Equal-loudness contour", https://en.wikipedia.org/wiki/Equal-loudness_contour, accessed on May 12, 2017, 6 pages.

Linkwitz Lab—Loudspeaker Design: "Simply Music—Linkwitz Lab transducers bring the musicians to your home", http://www.linkwitzlab.com, accessed on May 12, 2017, 16 pages.

Techopedia: "Head Tracking", https://www.techopedia.com/definition/31557/head-tracking, accessed on Mar. 4, 2018, 2 pages.

Autoguide: "Two Companies are Working on Bringing In-Car Sensing Tech to New Cars", http://www.autoguide.com/auto-news/2017/08/two-companies-are-working-on-bringing-in-car-sensing-tech-to-new-cars.html, accessed on Mar. 4, 2018, 4 pages.

Sharpbrains: "General Motors to adopt eye, head-tracking technology to reduce distracted driving", https://sharpbrains.com/blog/2014/09/02/general-motors-to-adopt-eye-head-tracking-technology-to-reduce-distracted-driving/, Sep. 2, 2014, 3 pages.

Patently Apple: "Apple Wins Patent for Advanced 3D Eye/Head Tracking System Supporting Apple's 3D Camera", http://www.patentlyapple.com/patently-apple/2016/08/apple-wins-patent-for-advanced-3d-eyehead-tracking-system-supporting-apples-3d-camera.html. Aug. 23, 2016, 5 pages.

Ivantysynova, Lenka et al: "Face Recognition and Head Tracking in Embedded Systems", Optik&Photonik, Jan. 2015, pp. 42-45, 4 pages.

* cited by examiner $$\Delta d = \Delta t \cdot c$$

(a)

(b)

LOUDSPEAKER UNIT

CROSS REFERENCE TO RELATED APPLICATIONS

This application is a U.S. National Stage Application of International Patent Application No. PCT/EP2019/056109 entitled "LOUDSPEAKER UNIT" filed on 12 Mar. 2019, which claims priority from GB1805523.6 entitled "LOUDSPEAKER UNIT" filed 4 Apr. 2018, the contents and elements of which are herein incorporated by reference for all purposes.

FIELD OF THE INVENTION

The present invention relates to a loudspeaker unit, a seat assembly that includes the loudspeaker unit, and a vehicle having a plurality of the seat assemblies.

BACKGROUND

Among the frequencies in the audible spectrum, lower frequencies are the ones that tend to carry most well over larger distances and are the ones difficult to keep inside a room. For example, nuisance from neighboring loud music has mostly a low frequency spectrum. "Low" frequencies can also be referred to as "bass" frequencies and these terms may be used interchangeably throughout this document.

Many cars today are equipped with a main audio system, which typically consist of a central user interface console with internal or external audio amplifiers, and one or more loudspeakers placed in the doors. This type of audio systems is used to ensure enough loudness of the same content (e.g. radio or cd-playback) for all passengers.

Some cars include personal entertainment systems (music, games & television) which are typically equipped with headphones to ensure individual passengers receive personalized sound, without disturbing (or being disturbed by) other passengers who are enjoining a different audio-visual content.

Some cars include loudspeakers placed very close to an individual passenger, so that sound having an adequately high sound pressure level ("SPL") can be obtained at the ears of that individual passenger, whilst having a much lower SPL at the positions of other passengers.

The present inventor has observed that the concept of a personal sound cocoon is a useful way to understand the approach of having a loudspeaker placed close to a user, wherein the personal sound cocoon is a region in which a user is able to experience sound having an SPL deemed to be acceptably high for their enjoyment, whereas outside the personal sound cocoon the sound is deemed to have an SPL which is lower than it is within the personal sound cocoon.

The present inventor has also observed that creating a personal sound cocoon that can be enjoyed by the user with little sound leakage into his/her surroundings is a big challenge that if overcome could bring a huge change in how users experience our individual multimedia content in all kind of settings/surroundings such as (but not limited) to automotive, home, gaming, and aviation settings.

The present inventor has also observed that creating an effective personal sound cocoon may involve sound reduction or cancellation of sound outside of the cocoon.

A main audio system as used in most cars today (with one or more loudspeakers placed in the doors) is unable to provide an effective personal sound cocoon for each individual passenger.

Although the usage of headphones ensures a good sound quality and a very effective personal sound cocoon (little sound leakage), the use of headphones has safety, ergonomic and comfort problems. Similar considerations apply for standalone applications in other environments such as home, studio, public areas where individual entertainment is needed without disturbing neighbors.

The use of highly directive loudspeakers positioned close to an individual passenger/user brings an effective solution for medium and high frequencies. However, it is generally impractical in most situations to make a loudspeaker directive at bass frequencies, since in order to provide a highly directive loudspeaker for bass frequencies, the dimensions of the radiating surface must be of the same order as the wavelength, and wavelengths are typically very long for bass frequency content (e.g. $\lambda$=3.4 m for f=100 Hz). Loudspeakers with radiating surfaces of this scale for producing bass frequency content are impractical in many situations, such as in a car. Nonetheless, bass frequency content is a very important part of the audio spectrum and in most music this spectrum represents half or more of the total sound power.

As shown by the well-known equal-loudness contours [1] e.g. as standardized as ISO 226:2003, our ears have a low sensitivity to bass frequencies under 150 Hz. Therefore, in general, sound at bass frequencies needs to be boosted in order to balance the spectral loudness. Also, road noise or environmental noise will have a bigger masking effect on this part of the spectrum. However, the present inventor has found that the use of traditional monopole loudspeakers (typically a cone monopole loudspeaker) for the purpose of creating a personal sound cocoon for an individual user at bass frequency sound will in general not produce satisfactory results, since a relatively high SPL at bass frequencies is needed in order to create a personal sound cocoon to overcome the limited sensitivity of our ears in this region of the frequency spectrum, yet a traditional monopole loudspeaker will have a spherical radiation pattern at bass frequencies (same sound pressure in all directions), with its sound pressure dropping only with 6 dB for every double distance from the loudspeaker under free field conditions. Further, a car environment behaves not as a free field, making the use of monopole loudspeakers for bass frequency cocooning even more cumbersome: a small room will show a pressure chamber effect whereby it will boost the bass frequency energy provided by a monopole (overall pressure increases in the chamber of 12 dB/octave below 70 Hz for a typical car).

The present inventor is aware of several patent documents which describe using a variety of loudspeaker arrangements for the purpose of producing personal sound in vehicles:

EP0988771A1
EP1460879A1
U.S. Pat. No. 8,130,987B2
U.S. Pat. No. 7,688,992B2
U.S. Pat. No. 9,327,628B2
U.S. Pat. No. 9,440,566B2
U.S. Pat. No. 9,428,090B2

The present inventor is also aware of other loudspeaker arrangements for producing personal sound in other contexts:

WO2014143927A2
U.S. Pat. No. 7,692,363B2

Dipole loudspeakers and their directional characteristics are well described in the literature and some of the patent documents referenced above use dipole loudspeakers, mostly for the purpose of using the directional characteristics of a dipole loudspeaker to generate spatial effects in the mid and high frequency region, or to use a dipole loudspeaker for low frequency reproduction at large distances, e.g. normal stereo setup, see e.g. [2] for useful background information on this.

In pending PCT application PCT/EP2018/084636, as well as in GB patent application nos. GB1721127.7 and GB1805525.1 (to which PCT/EP2018/084636 claims priority), filed by the present applicant, there is proposed a dipole loudspeaker for producing sound at bass frequencies, the dipole loudspeaker including: a diaphragm having a first radiating surface and a second radiating surface, wherein the first radiating surface and the second radiating surface are located on opposite faces of the diaphragm, and wherein the first and second radiating surfaces each have a surface area of at least 100 $cm^2$; a drive unit configured to move the diaphragm at bass frequencies such that the first and second radiating surfaces produce sound at bass frequencies, wherein the sound produced by the first radiating surface is in antiphase with sound produced by the second radiating surface; a frame, wherein the diaphragm is suspended from the frame via one or more suspension elements, wherein the frame is configured to allow sound produced by the first radiating surface to propagate out from a first side of the dipole loudspeaker and to allow sound produced by the second radiating surface to propagate out from a second side of the dipole loudspeaker; wherein preferably the loudspeaker is for use with an ear of a user being located at a listening position that is in front of the first radiating surface and is 40 cm or less from the first radiating surface.

The invention described in PCT/EP2018/084636, GB1721127.7 and GB1805525.1 was based on an insight that for a suitably dimensioned diaphragm, from a listening position that is close to (e.g. 40 cm or less from) the first radiating surface of such a loudspeaker, a user can experience bass sound (typically up to 100 Hz) that is highly localized, in the sense that the sound pressure level (SPL) experienced by a user will quickly decrease with increasing distance from the loudspeaker.

The present inventor has observed that a loudspeaker made according to the teaching of PCT/EP2018/084636, GB1721127.7 and GB1805525.1 only provides an effective personal sound cocoon up to a certain upper frequency limit, which (depending on the performance of the personal sound cocoon desired may e.g. be 100 Hz or 160 Hz).

The present inventor has observed that it may be desirable to increase this upper frequency limit, and/or to improve the performance of the personal sound cocoon up to the same upper frequency limit The present invention has been devised in light of the above considerations.

SUMMARY OF THE INVENTION

In a first aspect (which may be referred to herein as a "dipole type" aspect of the present invention), the present invention may provide a loudspeaker unit for producing sound at bass frequencies including:

an array of two or more diaphragms, each diaphragm in the array having a first radiating surface and a second radiating surface, wherein the first radiating surface and the second radiating surface are located on opposite faces of the diaphragm, and wherein one or more of the diaphragms are included in a first subset of the diaphragms and one or more of the diaphragms are included in a second subset of the diaphragms;

a plurality of drive units, wherein each drive unit is configured to move a respective one of the diaphragms in the array based on a respective electrical signal;

a frame, wherein each diaphragm in the array is suspended from the frame via one or more suspension elements such that the first radiating surfaces are facing in a first direction and the second radiating surfaces are facing in an opposite second direction, wherein the frame is configured to allow sound produced by the first radiating surfaces to propagate out from a first side of the loudspeaker unit in the first direction and to allow sound produced by the second radiating surfaces to propagate out from a second side of the loudspeaker unit in the second direction;

drive circuitry configured to provide each drive unit with a respective electrical signal derived from the same audio source such that the electrical signal(s) provided to the one or more drive units configured to move the first subset of diaphragms is/are out of phase with respect to the electrical signal(s) provided to the one or more drive units configured to move the second subset of diaphragms.

A loudspeaker unit according to the first aspect of this invention has been found to produce a more effective personal sound cocoon than a loudspeaker as described in PCT/EP2018/084636, GB1721127.7 and GB1805525.1 (discussed above), since out of phase sound is being produced by different subsets of loudspeakers on the same side of the loudspeaker unit (as well as being produced on opposite sides of the loudspeaker unit).

Also, having multiple diaphragms oriented with their first radiating surfaces facing in the first direction may be useful e.g. to provide stereo sound to the different ears of a user, or alternatively to compensate for movement of a user's head (as explained in more detail below).

In more detail, a user with an ear that is in front of and close to (e.g. 50 cm or less from) a first radiating surface of a diaphragm in the first subset of diaphragms preferably can hear the sound produced by that first radiating surface, but a user who is further away from that first radiating surface will preferably hear sound with a greatly reduced SPL level it is believed due to interference from (i) out of phase sound produced by the first radiating surface of the/each diaphragm in the second subset of diaphragms as well as (ii) out of phase sound produced by the second radiating surface of the/each diaphragm in the first subset of diaphragms.

In view of the above, a loudspeaker unit according to the first aspect of the invention may be configured for use with an ear of a user located at a listening position that is in front of and 50 cm or less (more preferably 40 cm or less, more preferably 30 cm or less, more preferably 25 cm or less, more preferably 20 cm or less, more preferably 15 cm or less) from the first radiating surface of a diaphragm in the first subset of diaphragms.

The terms "user" and "listener" (and "passenger", if the loudspeaker unit is located in a car) may be used interchangeably in this disclosure.

Here it is to be noted that although the listening position has been defined with respect to the first radiating surface of a diaphragm in the first subset of diaphragms, this does not rule out the possibility of a similar "proximity" effect being achievable at another listening position. Indeed, it is expected that a similar effect could be achieved with respect to the second radiating surface of that same diaphragm (or indeed with respect to the first/second radiating surface of another diaphragm in the array).

Preferably, a loudspeaker unit according to the first aspect of the invention may be configured for use with a first ear of a user located at a first listening position that is in front of and 50 cm or less (more preferably 40 cm or less, more preferably 30 cm or less, more preferably 25 cm or less, more preferably 20 cm or less, more preferably 15 cm or less) from the first radiating surface of a diaphragm in the first subset of diaphragms whilst a second ear of the user is located at a second listening position that is at a listening position that is in front of and 50 cm or less (more preferably 40 cm or less, more preferably 30 cm or less, more preferably 25 cm or less, more preferably 20 cm or less, more preferably 15 cm or less) from the first radiating surface of a diaphragm in the first subset of diaphragms. For avoidance of any doubt, as can be seen from the discussion below, the second listening position can be located in front of the first radiating surface of the same diaphragm in the first subset of diaphragms, or a different diaphragm in the first subset of diaphragms, as the first listening position.

It is also possible for a loudspeaker unit according to the first aspect of the invention to be configured for use with a first ear of a user located at a first listening position that is in front of the first radiating surface of a diaphragm in the first subset of loudspeakers whilst a second ear of the user is located at a second listening position that is at a listening position that is in front of a first radiating surface of a diaphragm in the second subset of loudspeakers. Although this is not preferred since the sound received at the two listening positions would be out of phase with each other, this has been found to provide acceptable results at low frequencies, as discussed below.

Without wishing to be bound by theory, the inventor believes that the effects referred to above are due to the sound produced by the first radiating surface of a diaphragm in the first subset of diaphragms interfering with (i) out of phase sound produced by the first radiating surface of the/each diaphragm in the second subset of diaphragms as well as (ii) out of phase sound produced by the second radiating surface of the/each diaphragm in the first subset of diaphragms, which the inventor believes helps to achieve an improved reduction in SPL with distance from the/each listening position (compared with an equivalent dipole loudspeaker). This effect is described in more detail below with reference to the enclosed drawings.

In view of the technical discussions contained herein, a skilled person would appreciate that the frame should be adequately open at both the first and second sides of the loudspeaker, i.e. to mostly avoid getting in the way of sound produced by the first and second radiating surfaces, so that sound produced by the first and second radiating surfaces is able interfere with each other without being overly inhibited or guided by the frame.

In other words, the frame should be adequately open at both the first and second sides of the loudspeaker so that each diaphragm can, optionally in combination with the drive unit configured to move the diaphragm, be viewed as providing a respective dipole loudspeaker within the loudspeaker unit.

Accordingly, for this first aspect of the invention, each diaphragm, optionally in combination with the drive unit configured to move the diaphragm, may be referred to as a (respective) dipole loudspeaker.

A skilled person would appreciate that the extent to which the frame is open at the first and second sides of the loudspeaker will depend on a number of factors such as the level of personal sound cocooning desired, the size of personal sound cocoon desired, and other design considerations (e.g. implementing the loudspeaker in a car headrest may require some of the frame or other structure to be located in front of the first and/or second radiating surfaces).

Accordingly, the degree to which the frame should be open at the first and second sides of the loudspeaker to achieve a desired level of personal sound cocooning cannot readily be defined in a precise manner.

In a first set of examples of the first aspect of the invention (which may be referred to herein for brevity as a "two dipole configuration"), the loudspeaker unit may include two diaphragms, with the first subset of diaphragm including one of the two diaphragms and the second subset of diaphragms including the other of the two diaphragms (note that in some examples of the invention, the first and second subset of diaphragms may respectively include only one diaphragm each).

In the two dipole configuration, the loudspeaker unit may be configured for use with a first ear of a user located at a first listening position that is in front of and 50 cm or less (more preferably 40 cm or less, more preferably 30 cm or less, more preferably 25 cm or less, more preferably 20 cm or less, more preferably 15 cm or less) from the first radiating surface of the diaphragm in the first subset of diaphragms whilst a second ear of the user is located at a second listening position that is in front of and 50 cm or less (more preferably 40 cm or less, more preferably 30 cm or less, more preferably 25 cm or less, more preferably 20 cm or less, more preferably 15 cm or less) from the first radiating surface of the diaphragm in the second subset of diaphragms, e.g. such that the first ear of the user is able to listen to sound produced by the first radiating surface of the diaphragm in the first set of diaphragms whilst the second ear of the user is listening to sound produced by the first radiating surface of the diaphragm in the second set of diaphragms. In this case, the drive circuitry may be configured to provide each drive unit with a respective electrical signal that includes frequencies that do not exceed 100 Hz (or even 80 Hz). This is because the present inventor has observed that when the first and second ears of a user are in front of respective radiating surfaces that are producing sound out of phase with respect to each other, the user experience can be unpleasant at frequencies which exceed 100 Hz (more preferably 80 Hz), due to a user being able to detect the difference in phase at such frequencies.

In this way, the first ear of the user is able to listen to sound produced by the first radiating surface of the diaphragm in the first set of diaphragms whilst the second ear of the user is listening to sound produced by the first radiating surface of the diaphragm in the second set of diaphragms.

In a second set of examples (which may be referred to herein for brevity as a "multi dipole configuration"), the loudspeaker unit may include three or more loudspeakers, with the first subset of diaphragm including at least two diaphragms and the second subset of diaphragms including at least one diaphragm.

In the multi dipole configuration, the loudspeaker may be configured for use with a first ear of a user located at a first listening position that is in front of and 50 cm or less (more preferably 40 cm or less, more preferably 30 cm or less, more preferably 25 cm or less, more preferably 20 cm or less, more preferably 15 cm or less) from the first radiating surface of a diaphragm in the first subset of diaphragms whilst a second ear of the user is located at a second listening position that is in front of and 50 cm or less (more preferably 40 cm or less, more preferably 30 cm or less, more preferably 25 cm or less, more preferably 20 cm or less, more preferably 15 cm or less) from the first radiating surface of a diaphragm in the first subset of diaphragms.

Preferably, the first and second listening positions may be in front of the first radiating surface of different diaphragms in the first subset of diaphragms, e.g. with the first listening position being in front of the first radiating surface of a first diaphragm in the first subset of diaphragms and with the second listening position being in front of the first radiating surface of a second (different) diaphragm in the first subset of diaphragms.

A typical distance between a first ear and a second ear of a user is 14-18 cm.

Accordingly, the first and second diaphragms in the first subset of diaphragms are preferably no more than 18 cm apart, preferably no more than 15 cm apart. For avoidance of any doubt, the first and second diaphragms in the first subset of diaphragms may be much closer than this, e.g. as is the case for the loudspeaker unit shown in FIG. 13.

Preferably, the first and second diaphragms are arranged such that, in use, a first ear of a user is located in front of (or close to being located in front of) a geometric centre of the first radiating surface of the first diaphragm in the first subset of diaphragms whilst a second ear of the user is located in front of (or close to being located in front of) a geometric centre of the first radiating surface of the second diaphragm in the first subset of diaphragms.

To this end, the distance between a geometric centre of the first radiating surface of the first diaphragm in the first subset of diaphragms and a geometric centre of the first radiating surface of the second diaphragm in the first subset of diaphragms may be in the range 10 cm to 20 cm, more preferably in the range 13-18 cm.

For the purposes of this disclosure, the geometric centre of a radiating surface may be the point in space that is the arithmetic mean of all points on the radiating surface (noting that the radiating surface need not be flat).

In the multi dipole configuration, the array of diaphragms preferably includes at least one diaphragm in the second subset of diaphragms for which at least a portion of the diaphragm in the second subset of diaphragms is located between the at least a portion of the first and second diaphragms in the first subset of diaphragms. This helps to ensure that the diaphragms in the first and second subsets are closely packed together.

For avoidance of any doubt, it is not necessary for the first and second listening positions to be in front of the first radiating surface of different diaphragms in the first subset of diaphragms since, in some examples, the first and second listening positions could be in front of the same diaphragm in the first subset of diaphragms.

The loudspeaker unit according to the first aspect of the invention may have multiple operational modes, wherein:

- in a first operational mode, the drive circuitry is configured to provide the drive unit(s) configured to move the first subset of diaphragms with an electrical signal that is out of phase with respect to an electrical signal that is provided to the drive unit(s) configured to move the second subset of diaphragms; and
- in a second operational mode, the drive circuitry is configured to provide the drive unit(s) configured to move the first subset of diaphragms with an electrical signal that is in phase with respect to an electrical signal that is provided to the second subset of the diaphragms.

In this way, the loudspeaker unit can have an operational mode (the second operational mode) in which it can function as a single dipole loudspeaker. This may be useful e.g. to allow the loudspeaker unit to produce higher sound pressure levels in situations in which creating a personal sound cocoon is not needed or not as important (e.g. where all passengers in a car are listening to the same audio).

The second operational mode may be deliberately used to cause vibrations, e.g. to provide feedback to a user sat in a car seat in which the loudspeaker unit is implemented, since all the diaphragms moving in phase with each other will in general increase the forces caused by movement of the diaphragms on the frame.

In a loudspeaker unit according to the first aspect of the invention, the drive circuitry may be configured to apply a predetermined delay to one or more of the electrical signals provided to the drive units. Applying a predetermined delay to one or more of the electrical signals provided to the drive unit may be useful to virtually "move" the location of those one or more drive units. For avoidance of any doubt, if a predetermined delay is applied to more than one of the electrical signals provided to the drive units, the predetermined delay respectively applied to each of the electrical signals could be different.

A delay may also be deliberately used to cause vibrations, e.g. to provide feedback to a user sat in a car seat in which the loudspeaker unit is implemented.

In a second aspect (which may be referred to herein as a "monopole type" aspect of the present invention), the present invention may provide a loudspeaker unit for producing sound at bass frequencies including:

- an array of two or more diaphragms, each diaphragm in the array having a first radiating surface and a second radiating surface, wherein the first radiating surface and the second radiating surface are located on opposite faces of the diaphragm, and wherein one or more of the diaphragms are included in a first subset of the diaphragms and one or more of the diaphragms are included in a second subset of the diaphragms;
- a plurality of drive units, wherein each drive unit is configured to move a respective one of the diaphragms in the array based on a respective electrical signal;
- a frame, wherein each diaphragm in the array is suspended from the frame via one or more suspension elements, wherein the frame is configured to allow sound produced by the first radiating surfaces to propagate out from the loudspeaker unit;
- at least one enclosure configured to receive sound produced by the second radiating surfaces;
- drive circuitry configured to provide each drive unit with a respective electrical signal derived from the same audio source such that the electrical signal(s) provided to the one or more drive units configured to move the first subset of diaphragms is/are out of phase with respect to the electrical signal(s) provided to the one or more drive units configured to move the second subset of diaphragms.

A loudspeaker unit according to the second aspect of this invention has been found to provide more flexibility in producing a personal sound cocoon than a loudspeaker as described in PCT/EP2018/084636, GB1721127.7 and GB1805525.1 (discussed above), since according to the second aspect of this invention two subsets of loudspeaker are used to produce out of phase sound and therefore can be arranged e.g. with a desired degree of separation, and e.g. with the electrical signal provided to each loudspeaker being individually manipulated to modify the phase, delay or amplitude. Whereas for the loudspeaker as described in PCT/EP2018/084636, GB1721127.7 and GB1805525.1, the separation of the two sides of the diaphragm, and the relative phase of sound produced by the two sides of the diaphragm, are limited by geometry of the diaphragm and frame.

For a loudspeaker unit according to the second aspect of the invention, a user with an ear that is close to (e.g. 50 cm or less from) a first radiating surface of a diaphragm in the first subset of diaphragms preferably can hear the sound produced by that first radiating surface, but a user who is further away from that first radiating surface will preferably hear sound with a greatly reduced SPL level it is believed due to interference from out of phase sound produced by the first radiating surface of the/each diaphragm in the second subset of diaphragms.

In view of the above, a loudspeaker unit according to the second aspect of the invention may be configured for use with an ear of a user located at a listening position that is 50 cm or less (more preferably 40 cm or less, more preferably 30 cm or less, more preferably 25 cm or less, more preferably 20 cm or less, more preferably 15 cm or less) from the first radiating surface of a diaphragm in the first subset of diaphragms. Conveniently, this listening position may be in front of the first radiating surface, though this need not be the case since (as discussed below) each diaphragm according to the second aspect of the invention may be expected to exhibit monopole loudspeaker behaviour at bass frequencies, i.e. with a spherical polar response (such that orientation is not an issue).

Here it is to be noted that although the listening position has been defined with respect to the first radiating surface of a diaphragm in the first subset of diaphragms, this does not rule out the possibility of a similar "proximity" effect being achievable at another listening position. Indeed, it is expected that a similar effect could be achieved with respect to the first radiating surface of another diaphragm in the array.

Preferably, a loudspeaker unit according to the second aspect of the invention is configured for use with a first ear of a user located at a first listening position that is 50 cm or less (more preferably 40 cm or less, more preferably 30 cm or less, more preferably 25 cm or less, more preferably 20 cm or less, more preferably 15 cm or less) from the first radiating surface of a diaphragm in the first subset of diaphragms whilst a second ear of the user is located at a second listening position that is 50 cm or less (more preferably 40 cm or less, more preferably 30 cm or less, more preferably 25 cm or less, more preferably 20 cm or less, more preferably 15 cm or less) from the first radiating surface of a diaphragm (optionally the same diaphragm) in the first subset of diaphragms. Conveniently, the first and second listening positions may be in front of the first radiating surface of the same diaphragm, though this need not be the case since (as discussed below) each diaphragm according to the second aspect of the invention may be expected to exhibit monopole loudspeaker behaviour at bass frequencies, i.e. with a spherical polar response.

Without wishing to be bound by theory, the inventor believes that the effects referred to above are due to the sound produced by the first radiating surface of a diaphragm in the first subset of diaphragms interfering with out of phase sound produced by the first radiating surface of the/each diaphragm in the second subset of diaphragms, which the inventor believes helps to achieve a reduction in SPL with distance from the listening position. This effect is described in more detail below with reference to the enclosed drawings.

In view of the technical discussions contained herein, a skilled person would appreciate that the at least one enclosure should be adequately enclosed so as to significantly inhibit sound produced by the second radiating surfaces from propagating out from the loudspeaker unit. This may be achieved e.g. by sealing the enclosure, by making the enclosure adequately large, and/or by including appropriate sound absorption materials in the enclosure.

In other words, the at least one enclosure should adequately contain sound produced by the second radiating surfaces so that each diaphragm can, optionally in combination with the drive unit configured to move the diaphragm, be viewed as providing a respective monopole loudspeaker within the loudspeaker unit.

Accordingly, for this second aspect of the invention, each diaphragm, optionally in combination with the drive unit configured to move the diaphragm, may be referred to as a (respective) monopole loudspeaker.

Preferably, the loudspeaker unit includes a single enclosure configured to receive sound produced by the second radiating surfaces of the diaphragms. This helps with pressure equalisation.

Preferably, the loudspeaker unit includes an even number of diaphragms such that the loudspeaker unit can be viewed as including one or more pairs of diaphragms. Preferably each pair of diaphragms includes one diaphragm in the first subset of diaphragms and one diaphragm in the second subset of diaphragms. The two diaphragms in each pair of loudspeakers are preferably oriented back to back, i.e. with the second radiating surface of one loudspeaker in the pair facing the second radiating surface of the other loudspeaker in the pair (preferably with the two radiating surfaces radiating into a shared space enclosed by the at least one enclosure), since this helps with force cancellation.

In a first set of examples (which may be referred to herein for brevity as a "two monopole configuration"), the array includes only two diaphragms, with the first subset of diaphragms including one of the two diaphragms and the second subset of diaphragms including the other one of the two diaphragms.

In this two monopole configuration, the personal sound cocoon achieved by the loudspeaker unit may be similar to that of a dipole loudspeaker. However, a loudspeaker unit according to this first set of examples is more versatile than a corresponding dipole loudspeaker because the two loudspeakers can be arranged e.g. with a desired degree of separation, and e.g. with the electrical signal provided to each loudspeaker being individually manipulated to modify the phase, delay or amplitude.

In a second set of examples (which may be referred to herein for brevity as a "multi monopole configuration"), the array includes three or more diaphragms, preferably at least four diaphragms, optionally an even number of diaphragms (optionally with the same number of diaphragms in each subset).

In this multi monopole configuration, an array including an even number (preferably four) diaphragms, with the first subset of diaphragms including half (preferably two) of the even number of diaphragms, and the second subset of diaphragms including the other half (preferably the other two) of the even number of diaphragms has been found to be particularly convenient.

Since each diaphragm is in effect providing a respective monopole loudspeaker, the polar response of each monopole loudspeaker at bass frequencies can be approximated to be spherical, meaning that the orientation of each diaphragm can be varied without significantly affecting the personal sound cocoon achieved by the loudspeaker unit. This means the orientation of each diaphragm can be chosen according to design choices.

In this multi monopole configuration, each of the second radiating surfaces may face towards a central space which is enclosed by a single enclosure configured to receive sound produced by each one of the second radiating surfaces. In some examples, a principal radiating axis of each first radiating surface may lie in the same plane and point outwardly from the central space. Preferably, the diaphragms are oriented (e.g. in a headrest of a car seat) such that, in use, this plane is vertical (but horizontal and other orientations of this plane are also possible).

In some examples where there are four or more diaphragms, a first diaphragm of the plurality of diaphragms may be oriented with the principal radiating axis of its first radiating surface pointing in a first (e.g. forwards) direction, a second diaphragm of the plurality of diaphragms may be oriented with the principal radiating axis of its first radiating surface pointing in a second (e.g. backwards) direction that is generally opposite to the first direction, a third diaphragm of the plurality of diaphragms may be oriented with the principal radiating axis of its first radiating surface pointing in a third (e.g. upwards) direction that is transverse (e.g. perpendicular) with respect to the first direction, and a fourth diaphragm of the plurality of diaphragms may be oriented the principal radiating axis of its first radiating surface pointing in a fourth (e.g. downwards) direction that is generally opposite to the third direction.

There may be more than one diaphragm oriented with the first radiating surface facing in the first direction, which may be useful e.g. to provide stereo sound to the different ears of a user, or alternatively to compensate for movement of a user's head (as explained in more detail below).

The loudspeaker unit according to the second aspect of the invention may have multiple operational modes, wherein:

- in a first operational mode, the drive circuitry is configured to provide the drive unit(s) configured to move the first subset of diaphragms with an electrical signal that is out of phase with respect to an electrical signal that is provided to the drive unit(s) configured to move the second subset of diaphragms; and
- in a second operational mode, the drive circuitry is configured to provide the drive unit(s) configured to move the first subset of diaphragms with an electrical signal that is in phase with respect to an electrical signal that is provided to the second subset of the diaphragms.

In this way, the loudspeaker unit can have an operational mode (the second operational mode) in which it can function as a normal in-phase array of loudspeakers. This may be useful e.g. to allow the loudspeaker unit to produce higher sound pressure levels in situations in which creating a personal sound cocoon is not needed or not as important (e.g. where all passengers in a car are listening to the same audio).

The second operational mode may be deliberately used to cause vibrations, e.g. to provide feedback to a user sat in a car seat in which the loudspeaker unit is implemented, since all the diaphragms moving in phase with each other will in general increase the forces caused by movement of the diaphragms on the frame.

In a loudspeaker unit according to the second aspect of the invention, the drive circuitry may be configured to apply a predetermined delay to one or more of the electrical signals provided to the drive units. Applying a predetermined delay to one or more of the electrical signals provided to the drive unit may be useful to virtually "move" the location of those one or more drive units. For avoidance of any doubt, if a predetermined delay is applied to more than one of the electrical signals provided to the drive units, the predetermined delay respectively applied to each of the electrical signals could be different.

A delay may also be deliberately used to cause vibrations, e.g. to provide feedback to a user sat in a car seat in which the loudspeaker unit is implemented.

In a third aspect (which may be referred to herein as a "vent type" aspect of the present invention), the present invention may provide a loudspeaker unit for producing sound at bass frequencies including:

- an array of two or more diaphragms, each diaphragm in the array having a first radiating surface and a second radiating surface, wherein the first radiating surface and the second radiating surface are located on opposite faces of the diaphragm;
- a plurality of drive units, wherein each drive unit is configured to move a respective one of the diaphragms in the array based on a respective electrical signal;
- a frame, wherein each diaphragm in the array is suspended from the frame via one or more suspension elements, wherein the frame is configured to allow sound produced by the first radiating surfaces to propagate out from the loudspeaker unit;
- at least one enclosure configured to receive sound produced by the second radiating surfaces, wherein the enclosure includes a plurality of vents, wherein each vent is configured to allow sound produced by the second radiating surfaces to propagate out from the loudspeaker unit;
- drive circuitry configured to provide each drive unit with a respective electrical signal derived from the same audio source such that the sound produced by the second radiating surfaces is out of phase with respect to the sound produced by the first radiating surfaces.

A loudspeaker unit according to the third aspect of this invention provides another route for producing a personal sound cocoon that requires fewer loudspeakers than a loudspeaker according to the second aspect of the invention, since in this case the out of phase sound can be produced by the second radiating surfaces of the diaphragms (and emitted via the plurality of vents), rather than by separate loudspeakers.

Moreover, a loudspeaker unit according to the third aspect of the invention retains some of the benefits of a loudspeaker according to the second aspect of the invention, since it is still possible to implement a delay, e.g. by varying the distance(s) between the two or more diaphragms.

For a loudspeaker unit according to the third aspect of the invention, a user with an ear that is close to (e.g. 50 cm or less from) a first radiating surface of one of the diaphragms preferably can hear the sound produced by that first radiating surface, but a user who is further away from that first radiating surface will preferably hear sound with a greatly reduced SPL level it is believed due to interference from out of phase sound produced by the second radiating surface of each diaphragm (which is allowed to propagate out from the loudspeaker via the plurality of vents).

In view of the above, a loudspeaker unit according to the third aspect of the invention may be configured for use with an ear of a user located at a listening position that is 50 cm or less (more preferably 40 cm or less, more preferably 30 cm or less, more preferably 25 cm or less, more preferably 20 cm or less, more preferably 15 cm or less) from the first radiating surface of one of the diaphragms. Conveniently, this listening position may be in front of that first radiating surface.

Here it is to be noted that although the listening position has been defined with respect to the first radiating surface of one of the diaphragms, this does not rule out the possibility of a similar "proximity" effect being achievable at another listening position. Indeed, it is expected that a similar effect could be achieved with respect to the first radiating surface of another diaphragm in the array, or indeed in front of one of the vents.

Preferably, a loudspeaker unit according to the third aspect of the invention is configured for use with a first ear of a user located at a first listening position that is 50 cm or less (more preferably 40 cm or less, more preferably 30 cm or less, more preferably 25 cm or less, more preferably 20 cm or less, more preferably 15 cm or less) from the first radiating surface of one of the diaphragms whilst a second ear of the user is located at a second listening position that is 50 cm or less (more preferably 40 cm or less, more preferably 30 cm or less, more preferably 25 cm or less, more preferably 20 cm or less, more preferably 15 cm or less) from the first radiating surface of one of the diaphragms (optionally the same diaphragm). Conveniently, the first and second listening positions may be in front of the first radiating surface of that same diaphragm.

Without wishing to be bound by theory, the inventor believes that the effects referred to above are due to the sound produced by the first radiating surface of one of the diaphragms interfering with out of phase sound produced by the second radiating surface of each diaphragm (which is allowed to propagate out from the loudspeaker via the plurality of vents), which the inventor believes helps to achieve a reduction in SPL with distance from the listening position.

Preferably, the loudspeaker unit includes at least one pair of diaphragms, wherein the two diaphragms included in the/each pair are oriented back to back, i.e. with the second radiating surface of one loudspeaker in the pair facing the second radiating surface of the other loudspeaker in the pair.

The diaphragms in the/each pair may be oriented with one of the diaphragms included in the/each pair having a first radiating surface that faces in a first (e.g. forwards) direction and with the other one of the diaphragms included in the/each pair having a first radiating surface that faces in a second (e.g. backwards) direction that is opposite to the first direction.

In some examples, the loudspeaker unit may include more than one pair of diaphragms, with one of the diaphragms included in each pair having a first radiating surface that faces in the first direction (i.e. in the same direction). This may be useful e.g. to provide stereo sound to the different ears of a user, or alternatively to compensate for movement of a user's head (as explained in more detail below).

The plurality of vents may include a first vent configured to allow sound to propagate out from the loudspeaker unit in a third (e.g. upwards) direction that is transverse (e.g. perpendicular) with respect to the first direction, and a second vent configured to allow sound to propagate out from the loudspeaker unit in a fourth (e.g. downwards) direction that is opposite to the third direction.

The enclosure may include one or more partitions configured to direct sound produced by the second radiating surface of each diaphragm out of a respective one of the vents.

Each vent in the plurality of vents is preferably configured to allow sound to propagate out from the loudspeaker in a different direction from the/each other vent in the plurality of vents.

For avoidance of any doubt, each vent may include more than one aperture, e.g. a vent could take the form of a grill or a plurality of holes. A vent having a single aperture is also possible.

In a loudspeaker unit according to the third aspect of the invention, the drive circuitry may be configured to apply a predetermined delay to one or more of the electrical signals provided to the drive units. Applying a predetermined delay to one or more of the electrical signals provided to the drive unit may be useful to virtually "move" the location of those one or more drive units. For avoidance of any doubt, if a predetermined delay is applied to more than one of the electrical signals provided to the drive units, the predetermined delay respectively applied to each of the electrical signals could be different.

A delay may also be deliberately used to cause vibrations, e.g. to provide feedback to a user sat in a car seat in which the loudspeaker unit is implemented.

In the first, second and third aspects of the invention, the drive circuitry is configured to provide each drive unit with a respective electrical signal derived from the same audio source. The respective electrical signal may be derived from an audio signal provided by the audio source. The audio source could be any source capable of providing an audio signal. Herein, an audio signal can be understood as a signal containing information representative of sound. An audio signal produced by an audio source may typically be an electrical signal (which could be digital or analogue), but could also take another form, such as an optical signal, for example. For avoidance of any doubt, the audio signal provided by the audio source could include a single channel or multiple channels. For example, the audio signal provided by the audio source could be a stereo audio signal including two channels, with each channel being a respective component of the stereo audio signal (though it is thought the respective stereo channels would need to be similar to get adequate cancellation). Different drive units in the loudspeaker unit may be provided with a respective electrical signal derived from a different channel of an audio signal provided by the audio source, e.g. so as to provide a stereo effect.

In the first and/or second aspect of the invention, the drive circuitry may take various forms in order that the electrical signal(s) provided to the one or more drive units configured to move the first subset of diaphragms is/are out of phase with respect to the electrical signal(s) provided to the one or more drive units configured to move the second subset of diaphragms, as would be appreciated by a skilled person.

For example, in the first and/or second aspect of the invention, the drive circuitry could simply include wiring configured to reverse the polarity of the electrical signal provided to the/each drive unit configured to move a diaphragm in the second subset of diaphragms compared to the electrical signal provided to the/each drive unit configured to move a diaphragm in the first subset of diaphragms.

Preferably, in the first, second and/or third aspect of the invention, the drive circuitry includes a signal processing unit (preferably a digital signal processor or "DSP") configured to provide each drive unit with a respective electrical signal derived from an audio signal provided by the audio source. An advantage provided by such a signal processing unit is that the signal processing unit can be used not only to provide each drive unit with a respective electrical signal derived from the same audio source such that the electrical signal(s) provided to the one or more drive units configured to move the first subset of diaphragms is/are out of phase with respect to the electrical signal(s) provided to the one or more drive units configured to move the second subset of diaphragms (as is required by a loudspeaker according to the first and second aspects of the invention but not the third aspect of the invention), but can also be used to manipulate the electrical signal respectively provided to each drive unit, e.g. to modify the phase, delay or amplitude of the electrical signal respectively provided to each drive unit, e.g. so as to optimise the sound provided to a user (as might be useful e.g. for changing an operational mode of the loudspeaker unit, for changing a path length and/or for noise cancelling, e.g. in a manner described herein).

In the first and/or second aspect of the invention, the electrical signal(s) provided to the one or more drive units configured to move the first subset of diaphragms should be out of phase with respect to the electrical signal(s) provided to the one or more drive units configured to move the second subset of diaphragms, such that sound produced by the first radiating surface(s) of the first subset of loudspeakers cancels in the far field with sound produced by the second radiating surface(s) of the first subset of loudspeakers. In general, this will mean that the electrical signals provided to the first subset of diaphragms should be 180° or close to 180° (e.g. between 90° and 270°, or between 160° and 200°) out of phase with respect to the electrical signal(s) provided to the one or more drive units configured to move the second subset of diaphragms. Out of phase electric signals are not required in the third aspect of the invention.

In the first and/or second aspect of the invention, a skilled person will appreciate that because the signals provided to each drive unit can be individually manipulated (e.g. to modify phase, delay or amplitude), and since different drive units in the loudspeaker unit may be provided with a respective electrical signal derived from a different channel of an audio signal provided by the audio source (e.g. so as to provide a stereo effect), the electrical signal(s) provided to the one or more drive units configured to move the first subset of diaphragms need not be identical to each other, the electrical signal(s) provided to the one or more drive units configured to move the second subset of diaphragms need not be identical to each other, and the electrical signal(s) provided to the one or more drive units configured to move the first subset of diaphragms need not be the exact opposite (i.e. same waveform, with the same amplitude whilst being exactly 180° out of phase with respect to) the electrical signal(s) provided to the one or more drive units configured to move the second subset of diaphragms. However, the electrical signal(s) provided to each drive unit configured to move a diaphragm in the first subset of diaphragms should be adequately out of phase (i.e. close enough to being the exact opposite) with respect to the electrical signal(s) provided to each drive unit configured to move a diaphragm in the second subset of diaphragms so as to provide a desired degree of cocooning effect, since without wishing to be bound by theory the present inventor believes that deviations from such signals being exactly out of phase will in general worsen the cocooning effect. However, the present inventors believe that an optimum cocooning effect would usually be achieved by a phase difference of 180°.

In the first, second and/or third aspect of the invention, the loudspeaker unit may be configured to produce sound at bass frequencies, wherein the bass frequencies preferably include frequencies across the range 60-80 Hz, more preferably frequencies across the range 50-100 Hz, more preferably frequencies across the range 40-100 Hz, and may include frequencies across the range 40-160 Hz. At these frequencies, the present inventor has found that the loudspeaker is able to produce a particularly useful personal sound cocoon.

Accordingly, in the first, second and/or third aspect of the invention, the drive circuitry may be configured to provide each drive unit with a respective electrical signal that includes frequencies across the range 60-80 Hz, more preferably frequencies across the range 50-100 Hz, more preferably frequencies across the range 40-100 Hz, and may include frequencies across the range 40-160 Hz.

Moving the diaphragm at frequencies below 40 Hz may be useful for some applications, but not for others (such as in a car, where below 40 Hz background noise tends to be too loud).

Above 160 Hz, the present inventor has found that the "cocooning" effect worsens considerably, though with an adequate number of diaphragms it has been found that a useful cocooning effect can be obtained up to 200 Hz or even 400 Hz.

Accordingly, in some applications, in the first, second and/or third aspect of the invention, the drive circuitry may be configured to provide each drive unit with a respective electrical signal that includes frequencies that do not exceed 400 Hz, 200 Hz, or 160 Hz. This may help to ensure the loudspeaker achieves a desired level of "cocooning".

In other applications (e.g. where cocooning is not required), in the first, second and/or third aspect of the invention, the drive circuitry may be configured to provide each drive unit with a respective electrical signal that includes frequencies that exceed 400 Hz, and could provide a full range of frequencies e.g. up to 20 kHz or higher.

In view of the above considerations, in the first, second and/or third aspect of the invention, the loudspeaker unit is preferably (configured as) a subwoofer. A subwoofer can be understood as a loudspeaker unit dedicated to (rather than suitable for) producing sound at bass frequencies.

In the first, second and/or third aspect of the invention, each diaphragm may have a non-circular shape, e.g. a rectangular or square shape. This may help to maximize the surface area of the first and second radiating surfaces within other design constraints (e.g. incorporating the loudspeaker unit into a car headrest).

In the first, second and/or third aspect of the invention, each diaphragm may take various forms.

In some examples of the first, second and/or third aspect of the invention, one or more (optionally each) of the diaphragms may be a single (monolithic) piece of material. The material may be lightweight, e.g. having a density of 0.1 $g/cm^3$ or less. The material may be extruded polystyrene, extruded polypropylene or similar.

In some examples of the first, second and/or third aspect of the invention, one or more (optionally each) of the diaphragms may be covered by a skin, e.g. to protect the diaphragm. The skin could e.g. be of paper, carbon fiber, plastic foil, for example.

In some examples of the first, second and/or third aspect of the invention, one or more (optionally each) of the diaphragms may include a cone. For the/each diaphragm that includes a cone, the first radiating surface of the diaphragm may be provided by a concave surface of the cone and the second radiating surface of the diaphragm may be provided by a convex surface of the cone.

In some examples of the first, second and/or third aspect of the invention, one or more (optionally each) of the diaphragms may include several pieces of material attached together, e.g. by glue. For example, one or more diaphragms may include a first cone and a second cone, wherein the first and second cones are glued back to back. For the/each diaphragm that includes a first cone and a second cone, wherein the first and second cones are glued back to back, the first radiating surface of the diaphragm may be provided by a concave surface of the first cone and the second radiating surface of the diaphragm may be provided by a concave surface of the second cone.

In some examples of the first, second and/or third aspect of the invention, the/each cone in the array of diaphragms may e.g. be made of paper.

In some examples of the first, second and/or third aspect of the invention, the first and second radiating surfaces of each diaphragm could be circular, rectangular, rectangular with rounded corners, or indeed have a more freeform shape.

In the first, second and/or third aspect of the invention, the one or more suspension elements via which the diaphragms are suspended from the frame may take a variety of forms.

Suspension elements for loudspeakers are well known, and a variety of different types of suspension elements may be used in each case where one or more suspension elements are recited in the present disclosure. For example, a suspension element referred to herein may be a roll suspension, a metal spring, a rubber band etc.

In some examples of the first, second and/or third aspect of the invention, for one or more of the diaphragms in the array, the one or more suspension elements via which the diaphragm is suspended from the frame may include one or more suspension elements (e.g. one or more roll suspensions) attached between the first radiating surface of the diaphragm and the frame, and one more suspension elements (e.g. one or more roll suspensions) attached between the second radiating surface of the diaphragm and the frame. This may be useful if the diaphragm has a significant thickness, e.g. of 1 cm or more, for example as might be the case if the diaphragm is of extruded polystyrene or similar. Preferably, the one or more suspension elements (e.g. one or more roll suspensions) attached between the first radiating surface of the diaphragm and the frame correspond to (e.g. match, e.g. match in position, number and length) the one or more suspension elements (e.g. one or more roll suspensions) attached between the second radiating surface of the diaphragm and the frame. This matching of suspension elements is particularly useful if the diaphragm is non-circular, since it may help to eliminate any asymmetries in the performance of the suspension elements attached to one radiating surface of the diaphragm.

In the first, second and/or third aspect of the invention, the one or more suspension elements via which each diaphragm is suspended from the frame may be tuned to have a resonance frequency that is below the frequency spectrum over which the loudspeaker is configured to operate, e.g. to maximize the efficiency of the loudspeaker in the frequency spectrum of interest.

In the first, second and/or third aspect of the invention, each drive unit may be an electromagnetic drive unit that includes a magnet unit configured to produce a magnetic field, and a voice coil attached to the diaphragm (that the drive unit is configured to move). In use, the voice coil may be energized (have a current passed through it) to produce a magnetic field which interacts with the magnetic field produced by the magnet unit and which causes the voice coil (and therefore the diaphragm) to move relative to the magnet unit. The magnet unit may include a permanent magnet. The magnet unit may be configured to provide an air gap, and may be configured to provide a magnetic field in the air gap. The voice coil may be configured to sit in the air gap when the diaphragm is at rest. Such drive units are well known.

In the first, second and/or third aspect of the invention, the magnet unit of each drive unit may be located in front of the second radiating surface of the diaphragm (that the drive unit is configured to move). The loudspeaker unit may include a respective safety element which is located between the magnet unit and the second radiating surface of each diaphragm. The safety element may be configured to prevent the magnet unit from passing through the diaphragm, e.g. in a crash event or another event that involves a sudden deceleration of the loudspeaker (e.g. where the loudspeaker has been moving in the direction of the principal radiating axis of the first radiating surface). The safety element is preferably rigid. The safety element may be a voice coil coupler configured to attach the voice coil to the diaphragm.

In the first, second and/or third aspect of the invention, a safety element as described above may be particularly useful if the loudspeaker is mounted in a headrest of a vehicle seat, since it may help to provide protection for a person sat in such a seat in the event of a vehicle crash.

In the first, second and/or third aspect of the invention, the voice coil of each drive unit may be attached to the diaphragm (that the drive unit is configured to move), e.g. to the second radiating surface of that diaphragm. Each voice coil may be attached to (e.g. the second radiating surface of) the diaphragm (that the drive unit is configured to move) either directly, or via a voice coil coupler. The voice coil coupler may also be a safety element, as described above.

In the context of this disclosure, the term frame is intended to encompass any substantially rigid structure from which one or more diaphragms can be suspended. The frame may include metal and/or plastic, for example.

In the first, second and/or third aspect of the invention, the frame may respectively include one or more rigid supporting elements (e.g. arms) configured to hold a magnet unit of each drive unit in front of the first and/or second radiating surface of the diaphragm (that the drive unit is configured to move), preferably in front of the second radiating surface of that diaphragm.

In the first, second and/or third aspect of the invention, the frame from which each diaphragm is suspended may include one or more mounting legs which extend into one or more (respective) cavities in each diaphragm, wherein each diaphragm is suspended from the one or more mounting legs via one or more suspension elements.

In the first, second and/or third aspect of the invention, each diaphragm may include one or more cavities in one of the radiating surfaces (preferably the second radiating surface), wherein each cavity is configured to have a respective rigid supporting element extend through it when the loudspeaker unit is in use. This may allow the loudspeaker unit to have a lower profile in the thickness direction of the diaphragms.

Alternatively, in some examples of the first, second and/or third aspect of the invention, the magnet unit of each drive unit may be suspended from the diaphragm (that the drive unit is configured to move) via one or more suspension elements.

In some examples of the first, second and/or third aspect of the invention (which may be referred to herein for brevity as a "dual frame configuration"), the frame from which each diaphragm is suspended is a secondary frame, wherein the diaphragms are suspended from one or more primary frames (optionally one primary frame) via one or more primary suspension elements, wherein the/each primary frame is suspended from the secondary frame via one or more secondary suspension elements. Note that in this case the diaphragms can be viewed as being suspended from the secondary frame via the primary frame(s) and primary suspension elements.

In a dual frame configuration, the use of one or more primary frames suspended from a secondary frame may be useful to reduce vibrations passing from the loudspeaker into the environment. However, vibrations passing from the loudspeaker into the environment can also be avoided by appropriately configuring the two or more diaphragms in a loudspeaker unit according to the first and/or second aspect of the invention to provide force cancellation.

In a dual frame configuration, the/each primary frame may include a rigid body which extends around a respective diaphragm axis along which a respective drive unit is configured to move a respective diaphragm. The primary frame is preferably located radially outwards from the diaphragm, relative to the diaphragm axis.

In a dual frame configuration, the/each primary frame may include one or more rigid supporting elements (e.g. arms) configured to hold a magnet unit of a respective drive unit in front of the first and/or second radiating surface of a respective diaphragm (preferably in front of the second radiating surface of the diaphragm).

In a dual frame configuration, each diaphragm may include one or more cavities in one of its radiating surfaces (preferably the second radiating surface), wherein each cavity is configured to have a respective rigid supporting element extend through it when the loudspeaker is in use. This may allow the loudspeaker unit to have a lower profile in the thickness direction of the diaphragm.

In a dual frame configuration, the secondary frame may be part of, or may be configured to fixedly attach to, a rigid supporting structure, such as a car seat frame.

In some examples of the first, second and/or third aspect of the invention (which may be referred to herein for brevity as a "single frame configuration"), the frame from which each diaphragm is suspended is part of or configured to fixedly attach to, a rigid supporting structure, such as a car seat frame.

In a single frame configuration, the magnet unit of each drive unit may be suspended from a respective diaphragm via one or more magnet unit suspension elements.

In a single frame configuration, the one or more magnet unit suspension elements via which each magnet unit is suspended may include one or more (preferably two or more) spiders for example, wherein a spider may be understood as a textile ring having circumferentially extending corrugations (which may facilitate movement along the longitudinal axis whilst movement perpendicular to this axis), as is known in the art. Other suspension element forms may be considered by a skilled person, e.g. springs such as metal springs.

In the first, second and/or third aspect of the invention, the loudspeaker unit may be configured for use in performing noise cancelation, e.g. at bass frequencies. For example, in the first, and/or second aspect of the invention the drive circuitry may be configured to provide the first subset of diaphragms with an electrical signal configured to move a diaphragm in the first subset of diaphragms (e.g. at bass frequencies) so that the first radiating surface of that diaphragm produces sound configured to cancel environmental sound at a listening position, wherein one or more microphones are configured to detect the environmental sound. For example, in third aspect of the invention the drive circuitry may be configured to provide at least one of the diaphragms with an electrical signal configured to move at least one of the diaphragms (e.g. at bass frequencies) so that the first radiating surface of that at least one diaphragm produces sound configured to cancel environmental sound at a listening position, wherein one or more microphones are configured to detect the environmental sound. The listening position may be as defined above. Preferably the diaphragm being moved to cancel environmental sound at the listening positions is the same diaphragm that the listening position is defined with respect to. This may be of use in a noisy environment, such as in a car or aeroplane, e.g. where the loudspeaker is part of a seat assembly including a vehicle seat. Noise cancellation techniques are well-known.

A loudspeaker unit according to the first, second and/or third aspect of the invention may find utility in any application where it might be desirable to provide a personal sound cocoon.

In a fourth aspect, the present invention may provide a seat assembly including a seat and a loudspeaker unit according to the first, second and/or third aspect of the present invention.

Preferably, the seat is configured to position a user who is sat down in the seat such that an ear of the user is located at a listening position as described above.

Preferably, the seat is configured to position a user who is sat down in the seat such that a first ear of the user is located at a first listening position as described above whilst a second ear of the same user is located at a second listening position as described above.

The loudspeaker unit may be mounted within a headrest of the seat ("seat headrest"). Since a typical headrest is configured to be a small distance (e.g. 30 cm or less) from the ears of a user who is sat down in a seat, this is a particularly convenient way of configuring the seat to position a user who is sat down in the seat such that an ear of the user is located at a listening position as described above.

A seat headrest typically has a front surface configured to face towards the head of a user sat in the seat, and a back surface configured to face away from the head of a user sat in the seat.

A loudspeaker unit according to the first aspect of the present invention is preferably mounted within the headrest of the seat e.g. with the first radiating surfaces of the loudspeaker unit facing the front surface of the headrest and/or with a principal radiating axis of each first radiating surface extending out through the front surface of the headrest.

A loudspeaker unit according to the second aspect of the present invention is preferably mounted within the headrest of the seat e.g. with a first radiating surface of at least one diaphragm in the first subset of diaphragms (preferably including a diaphragm that the/each listening position is defined with respect to) facing the front surface of the headrest and/or with a principal radiating axis of the/each first radiating surface of at least one diaphragm in the first subset of diaphragms extending out through the front surface of the headrest.

A loudspeaker unit according to the third aspect of the present invention is preferably mounted within the headrest of the seat e.g. with the first radiating surface of at least one diaphragm in the loudspeaker unit facing the front surface of the headrest and/or with a principal radiating axis of the/each first radiating surface of at least one diaphragm in the loudspeaker unit extending out through the front surface of the headrest.

In some examples of the fourth aspect of the invention (which may be referred to herein for brevity as a "same facing multi diaphragm configuration"), the loudspeaker unit according to the first, second and/or third aspect of the invention may include at least two diaphragms mounted (preferably within the headrest of the seat) such that their first radiating surfaces face in the same direction (e.g. a forwards direction). The at least two diaphragms mounted such that their first radiating surfaces face in the same direction may be referred to as "same facing diaphragms" for brevity (or "forward facing diaphragms", if they face in a forwards direction). For avoidance of any doubt, the principal radiating axes of the same facing diaphragms need not be parallel to each other in order to be considered as facing in the same direction, and may be arranged e.g. with the principal radiating axes of the first radiating surfaces being arranged to converge (as in FIG. 17(*h*)) or diverge (as in FIG. 17(*g*)).

The loudspeaker unit may be configured for use with a first ear of a user located at a first listening position that is in front of and 50 cm or less (more preferably 40 cm or less, more preferably 30 cm or less, more preferably 25 cm or less, more preferably 20 cm or less, more preferably 15 cm or less) from the first radiating surface of a first one of the same facing diaphragms whilst a second ear of the user is located at a second listening position that is at a listening position that is in front of and 50 cm or less (more preferably 40 cm or less, more preferably 30 cm or less, more preferably 25 cm or less, more preferably 20 cm or less, more preferably 15 cm or less) from the first radiating surface of a second one of the same facing diaphragms. In the first and/or second aspect of the invention, the first and second diaphragms of the same facing diaphragms preferably both belong to the first subset of diaphragms, to avoid one ear of a user receiving out of phase sound compared with the other ear of a user.

In the same facing multi diaphragm configuration, the sound provided to the first ear of the user may be different compared to the sound provided to the second ear of the user. This may be useful to provide stereo sound to the different ears of a user, or alternatively to compensate for movement of a user's head (as explained below).

Preferably, the seat assembly includes a head tracking unit configured to track head movement of a user sat in the seat. Head tracking and face recognition technology based on video monitoring/processing is a known technology that is finding its way into cars for various purposes such as safety (to detect and then prevent a driver from falling asleep) and gesture control, see e.g. [3]-[7]. Head tracking based on one or more ultrasonic sensors may also be possible.

Preferably, the drive circuitry is configured to modify the electrical signals provided to the drive units configured to move the first and second diaphragms of the same facing diaphragms (e.g. using a signal processing unit as described herein) based on head movement as tracked by the head tracking unit, e.g. to compensate for movement of the head of a user sat in the seat. For example, the drive circuitry may be configured to increase the amplitude of sound produced by one of the first and second diaphragms if it is determined based on head movement as tracked by the head tracking unit that an ear of the user has moved further away from the first radiating surface of that diaphragm. Similarly, the drive circuitry may be configured to decrease the amplitude of sound produced by one of the first and second diaphragms if it is determined based on head movement as tracked by the head tracking unit that an ear of the user has moved closer to the first radiating surface of that diaphragm. It would be straightforward for a skilled person to adapt existing head tracking technologies e.g. as discussed in [3]-[7] to this purpose.

Herein, a principal radiating axis of a radiating surface may be understood as an axis along which the radiating surface produces direct sound at maximum amplitude (sound pressure level). Typically, the principal radiating axis will extend outwardly from a central location on the radiating surface. The principal radiating axes of the first and second radiating surfaces will in general extend in opposite directions, since they are located on opposite faces of the diaphragm.

The seat may have a rigid seat frame. The frame of the loudspeaker unit may be part of or fixedly attached to the rigid seat frame. For example, in a dual frame configuration as discussed above, the secondary frame of the loudspeaker may be part of or fixedly attached to the rigid seat frame. For example, in a single frame configuration as discussed above, the frame of the loudspeaker unit may be part of or fixedly attached to the rigid seat frame.

The seat may be a vehicle seat, for use in a vehicle such as a car ("car seat") or an aeroplane ("plane seat").

The seat could be a seat for use outside of a vehicle. For example, the seat could be a seat for a computer game player, a seat for use in studio monitoring or home entertainment.

In a fifth aspect, the present invention may provide a vehicle (e.g. a car or an aeroplane) having a plurality of seat assemblies according to the fourth aspect of the invention.

The invention includes the combination of the aspects and preferred features described except where such a combination is clearly impermissible or expressly avoided.

SUMMARY OF THE FIGURES

Embodiments and experiments illustrating the principles of the invention will now be discussed with reference to the accompanying figures in which.

DETAILED DESCRIPTION OF THE INVENTION

Aspects and embodiments of the present invention will now be discussed with reference to the accompanying figures. Further aspects and embodiments will be apparent to those skilled in the art. All documents mentioned in this text are incorporated herein by reference.

Herein, loudspeaker units incorporating one or more diaphragms acting as a dipole loudspeaker are referred to as "multipole" loudspeaker units, with loudspeaker units incorporating one diaphragm acting as a dipole loudspeaker being referred to as "dipole" loudspeaker units, with loudspeaker units incorporating two diaphragms acting as dipole loudspeakers being referred to as "quadrupole" loudspeaker units, and with loudspeaker units incorporating four diaphragms acting as dipole loudspeakers being referred to as "octopole" loudspeaker units.

Figure 1A:
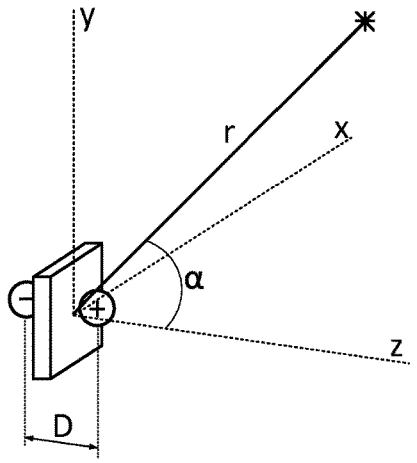
FIGS. 1(*a*) and 1(*b*) illustrate the farfield polar response of a "dipole" loudspeaker unit including a single diaphragm acting as a dipole loudspeaker.
Figure 1B:
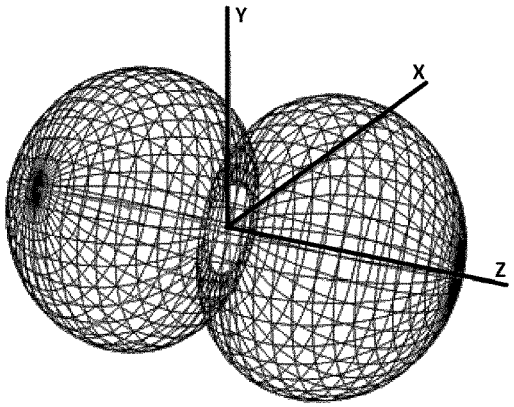

FIGS. 1(*a*) and 1(*b*) illustrate the farfield polar response of a "dipole" loudspeaker unit including a single diaphragm acting as a dipole loudspeaker.

In FIG. 1(*a*), in-phase sound is indicated by a plus sign (+) whereas out-of-phase sound is indicated by a negative sign (−). Note that sound produced by opposite surfaces of the diaphragm are necessarily out of phase with each other.

The relationship between pressure pa, produced by the dipole loudspeaker unit of FIG. 1(*a*) at bass frequencies in the farfield, k and D can theoretically be represented by the following relation:

$$p_{di} \partial k \cdot D \cdot \cos(\alpha) \quad (1)$$

Where $k=2\pi/\lambda$, and D is a "path length".

For an ideal dipole loudspeaker formed of two out of phase monopole point sources (which is only achievable in theory), path length can be understood as the distance between the two out of phase monopole point sources.

For a real dipole loudspeaker, the path length can be understood as a distance between two out of phase monopole point sources which causes the two point monopole point sources to approximate the behaviour of the real dipole loudspeaker, i.e. the distance D as shown in FIG. 1(*a*).

Figure 2A:
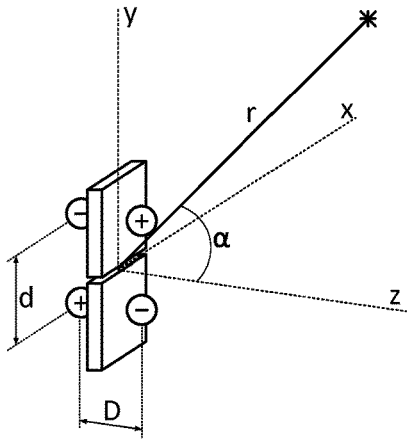
FIGS. 2(*a*) and 2(*b*) illustrate the polar response of a "quadrupole" loudspeaker unit including an array of two diaphragms, wherein each of the two diaphragms in the array provides a respective dipole loudspeaker, and wherein drive circuitry is configured to provide one of the diaphragms with an electrical signal that is out of phase with respect to an electrical signal that is provided to the other of the diaphragms.
Figure 2B:
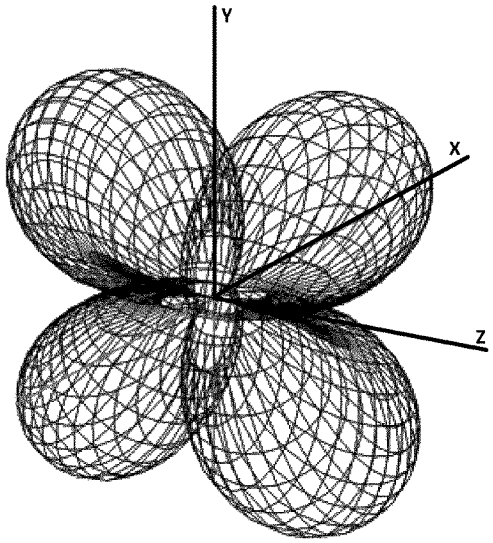

FIGS. 2(*a*) and 2(*b*) illustrate the polar response of a "quadrupole" loudspeaker unit including an array of two diaphragms, wherein each of the two diaphragms in the array provides a respective dipole loudspeaker, and wherein drive circuitry is configured to provide one of the diaphragms with an electrical signal that is out of phase with respect to an electrical signal that is provided to the other of the diaphragms.

In FIG. 2(*a*), in-phase sound is indicated by a plus sign (+) whereas out-of-phase sound is indicated by a negative sign (−).

The relationship between pressure $p_{qu}$ produced by the quadrupole loudspeaker unit of FIG. 2(*a*) at bass frequencies in the farfield, k, D and d can theoretically be represented by the following relation:

$$p_{qu} \propto k^2 \cdot D \cdot d \cdot \cos(\alpha) \cdot \sin(\alpha) \quad (2)$$

Where d is a distance in the between the geometrical centres of the radiating surfaces on the same side of the quadrupole loudspeaker unit as measured along the y-axis.

Figure 3A:
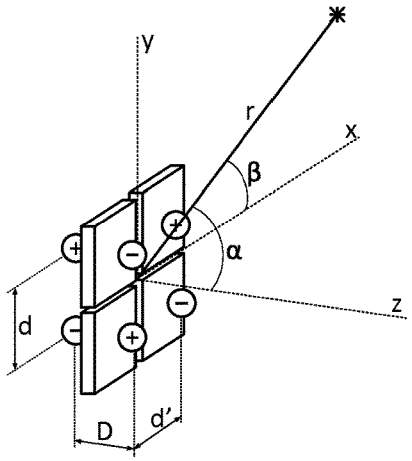
FIGS. 3(*a*) and 3(*b*) illustrate the polar response of an "octopole" loudspeaker unit including an array of four diaphragms, wherein each of the four diaphragms in the array provides a respective dipole loudspeaker, and wherein drive circuitry is configured to provide two of the diaphragms with an electrical signal that is out of phase with respect to an electrical signal that is provided to the other two of the diaphragms.
Figure 3B:
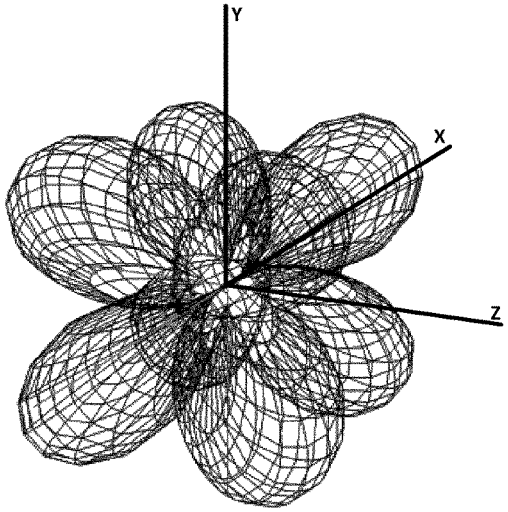

FIG. 3(*a*) and FIG. 3(*b*) illustrate the polar response of an "octopole" loudspeaker unit including an array of four diaphragms, wherein each of the four diaphragms in the array provides a respective dipole loudspeaker, and wherein drive circuitry is configured to provide two of the diaphragms with an electrical signal that is out of phase with respect to an electrical signal that is provided to the other two of the diaphragms.

In FIG. 3(*a*), in-phase sound is indicated by a plus sign (+) whereas out-of-phase sound is indicated by a negative sign (−).

The relationship between pressure $p_{oc}$ produced by the quadrupole loudspeaker unit of FIG. 3(*a*) at bass frequencies in the farfield, k, D, d and d' can theoretically be represented by the following relation:

$$p_{oc} \propto k^3 \cdot D \cdot d \cdot d' \cdot \cos(\alpha) \cdot \sin(\alpha) \cdot \cos(\beta) \quad (3)$$

Where d' is a distance in the between the geometrical centres of the radiating surfaces on the same side of the octopole loudspeaker unit as measured along the x-axis.

From relations (1), (2) and (3) above, it can be seen that:

Increasing D, d, or d' will increase the far-field pressure response of the multipole loudspeaker unit, i.e. will worsen the cocooning effect at bass frequencies.

Due to the k, $k^2$, $k^3$ terms, the far field pressure response drops off more rapidly with frequency at bass frequencies as the number of dipole loudspeakers included in the array is increased, i.e. as the order of multipole is increased (e.g. 6 dB/octave for a dipole, 12 dB/octave for a quadrupole and 18 dB/octave for an octopole)

In general, reference herein to a "cocooning" effect refers to reduced SPL at large distances, compared with an equivalent monopole loudspeaker.

Figure 4:
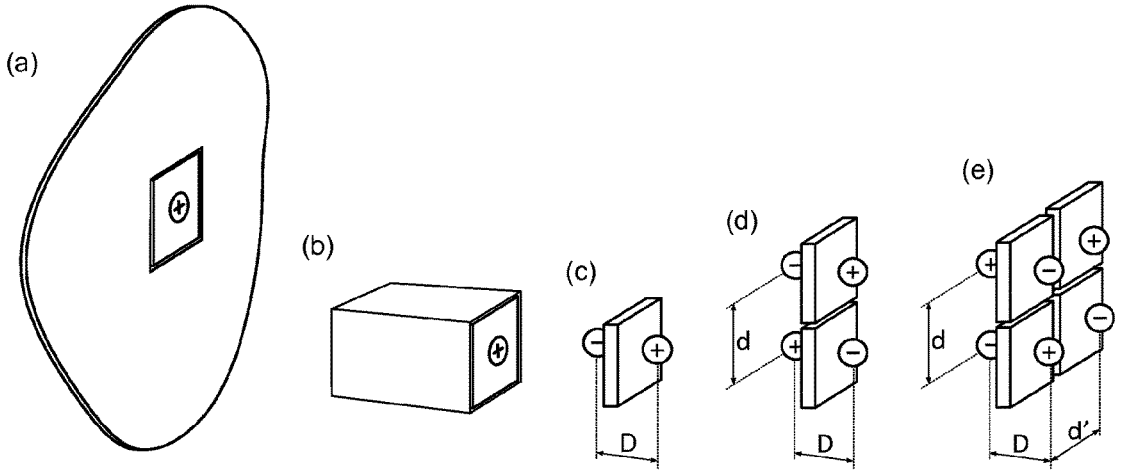
FIGS. 4(*a*)-(*e*) illustrates various loudspeaker arrangements for use in a simulation to demonstrate the proximity effect.
Figure 5A:
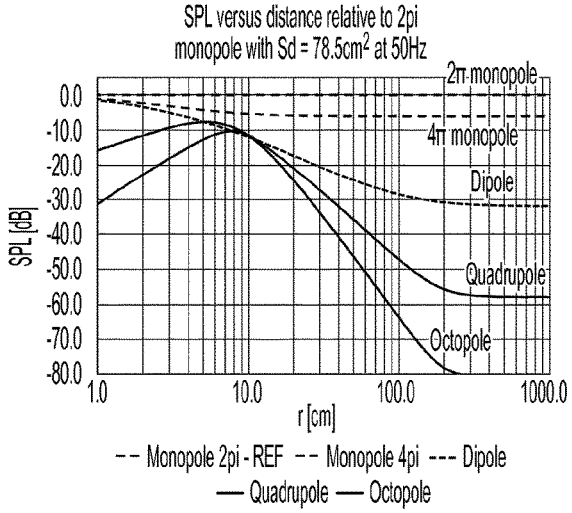
FIGS. 5(*a*)-(*d*) respectively show the results of a simulation to demonstrate the proximity effect, using the loudspeaker units of FIGS. 4(*a*)-(*e*), with sound being produced at a frequency of 50 Hz (FIG. 5(*a*)), 100 Hz (FIG. 5(*b*)), 200 Hz (FIG. 5(*c*)), 400 Hz (FIG. 5(*d*)) respectively, relative to the SPL of the $2\pi$ monopole loudspeaker unit.
Figure 5B:
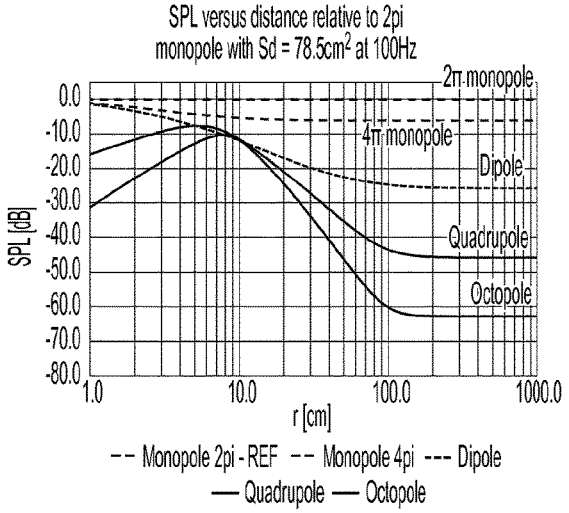
Figure 5C:
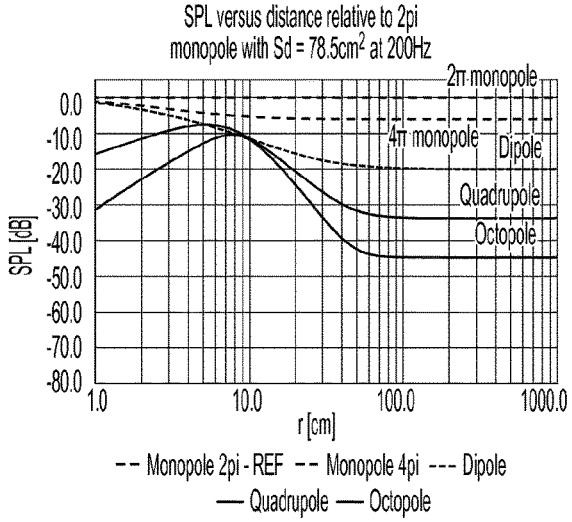
Figure 5D:
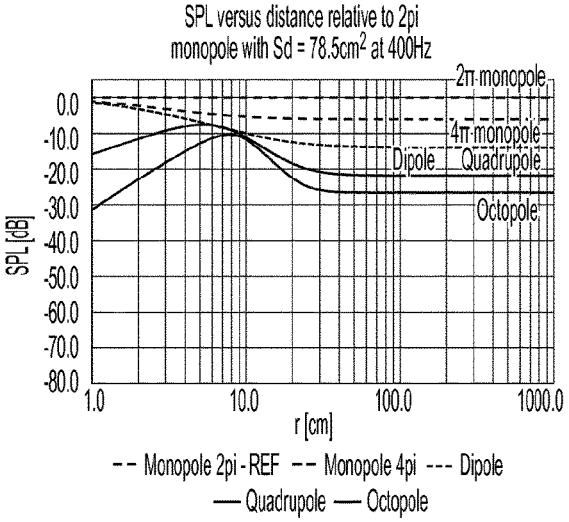
Figure 6A:
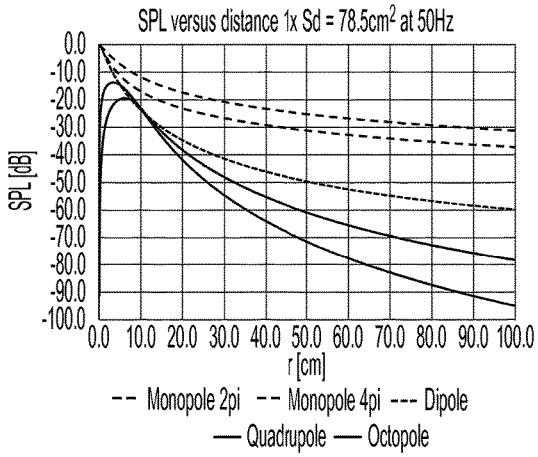
FIGS. 6(*a*)-(*d*) show the same simulation results as FIGS. 5(*a*)-(*d*) (respectively), but with SPL shown in absolute form and with distance from the loudspeaker unit (r) being shown with a linear (rather than a log) scale.
Figure 6B:
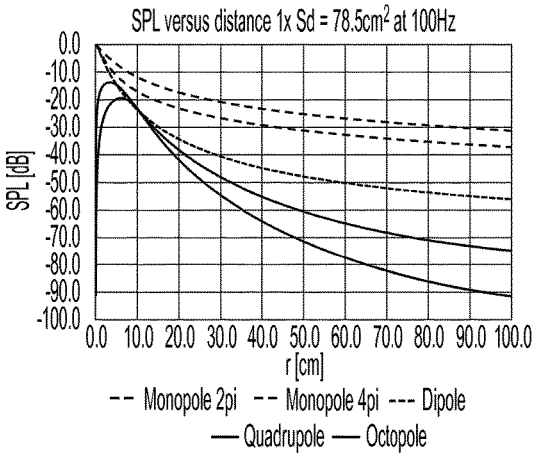
Figure 6C:
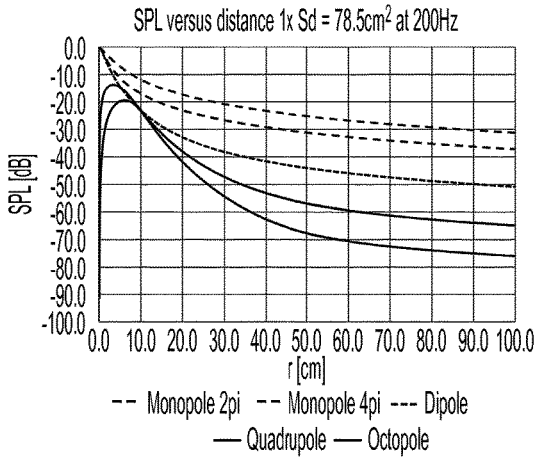
Figure 6D:
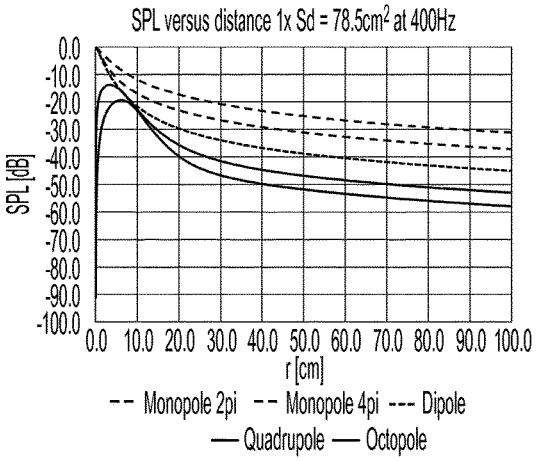

FIGS. 4(*a*)-(*e*) illustrates various loudspeaker arrangements for use in a simulation to demonstrate the proximity effect.

The loudspeaker arrangements shown in FIGS. 4(*a*)-(*e*) include:

(a) A 2π monopole loudspeaker unit (a dipole loudspeaker mounted in an infinite baffle such that only one radiating surface of the diaphragm radiates into 2π space)

(b) A 4π monopole loudspeaker unit (a diaphragm mounted in an infinite tube such that only one radiating surface of the diaphragm radiates into 4π space)

(c) A dipole loudspeaker unit (as explained with reference to FIG. 1(*a*) above)

(d) A quadrupole loudspeaker unit (as explained with reference to FIG. 2(*a*) above)

(e) An octopole loudspeaker unit (as explained with reference to FIG. 3(*a*) above)

FIGS. 5(*a*)-(*d*) respectively show the results of a simulation to demonstrate the proximity effect, using the loudspeaker units of FIGS. 4(*a*)-(*e*), with sound being produced at a frequency of 50 Hz (FIG. 5(*a*)), 100 Hz (FIG. 5(*b*)), 200 Hz (FIG. 5(*c*)), 400 Hz (FIG. 5(*d*)) respectively, relative to the SPL of the 2π monopole loudspeaker unit.

For the simulation results shown in FIGS. 5(*a*)-(*d*), sound pressure level (SPL) was simulated on the basis of the diaphragms having radiating surfaces of area S=78.5 $cm^2$ (equivalent to a disc of area 100 mm diameter), D=5.5 cm, d=11.0 cm, d'=11.0 cm.

For the purposes of these simulation results, SPL was simulated for the 2π monopole and 47 monopole loudspeaker units along the z-axis (α=0°). Since measurement of sound pressure level (SPL) along the z-axis would result in a null for the quadrupole and octopole loudspeaker units, SPL for these units was simulated along α=45° for the quadrupole loudspeaker unit and α=45° and β=45° for the octopole loudspeaker unit.

FIGS. 5(*a*)-(*d*) show that at small distances, an SPL level comparable to equivalent monopole loudspeaker units can be achieved with all of the multipole loudspeaker units. This effect is referred to herein as the "proximity effect".

FIGS. 5(*a*)-(*d*) also show that increasing the number of dipole loudspeakers included in the array (i.e. increasing the order of multipole used) results in a better cocooning effect at bass frequencies, and that the higher the number of dipole loudspeakers used, the higher the frequency at which a reasonable cocooning effect can be achieved. However, even with the octopole loudspeaker unit, the cocooning effect is not really strong enough to permit the creation of a personal sound cocoon at frequencies exceeding ~500 Hz.

FIGS. 6(*a*)-(*d*) show the same simulation results as FIGS. 5(*a*)-(*d*) (respectively), but with SPL shown in absolute form and with distance from the loudspeaker unit (r) being shown with a linear (rather than a log) scale.

Figure 7A:
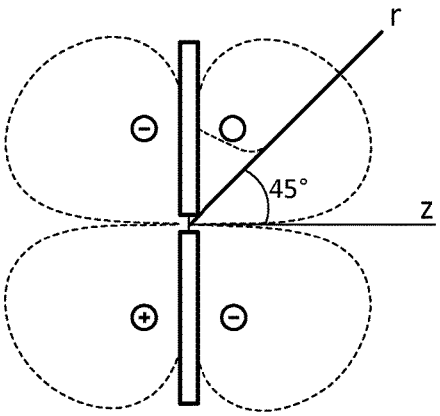
FIGS. 7(*a*) and 7(*b*) illustrate that it is favourable for a listening position to be located in front of a centre of a radiating surface, rather than a centre of an array of a multipole loudspeaker unit.
Figure 7B:
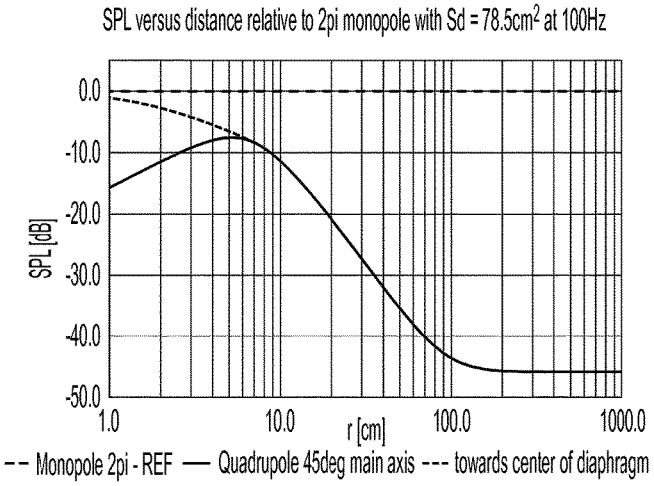

FIGS. 7(*a*) and 7(*b*) illustrate that it is favourable for a listening position to be located in front of a centre of a radiating surface, rather than a centre of an array of a multipole loudspeaker unit.

In FIG. 7(*a*), distance r from the centre of a quadrupole loudspeaker unit is shown by a solid line in FIG. 7(*a*), and the corresponding SPL as measured at 100 Hz with the same parameters as FIG. 5(*b*) is shown in FIG. 7(*b*). As can be seen from the solid line in FIG. 5(*b*), there is a dip in the SPL at small distances from the centre of the loudspeaker quadrupole loudspeaker unit, since there is a null (SPL=0) along the z-axis.

By modifying the path along which r is measured extend towards the centre of a radiating surface of a diaphragm in the quadrupole loudspeaker unit rather than towards the centre of the loudspeaker unit itself, as shown by the dotted line which branches from the solid line in FIG. 7(*a*), the SPL can continue to increase towards that of an equivalent $2\pi$ monopole as r reduces towards zero. This demonstrates that it is favourable for a listening position to be located in front of a centre of a radiating surface, rather than a centre of an array of a multipole loudspeaker unit.

Some interim conclusions may be drawn from the discussion so far:

- As the number of diaphragms is increased, there is an improvement in the drop in SPL with increasing distance, whilst a comparable SPL is maintained at small distances. E.g. at 200 Hz there is an additional 14 dB sound reduction at 1 m for a quadrupole compared to a dipole, while at 10 cm the levels are equal.
- Increasing the number of diaphragms may allow the upper bound of the low frequency range across which a useful sound cocoon can be maintained to increase.
- The graphs where the observation distance r is plotted on a logarithmic scale clearly shows the distance where the proximity effect kicks in. Those graphs show the distance up to 10 m and are referenced to a 2 pi monopole equivalent which has a 6 dB per octave SPL reduction for every double distance in the far field.

Examples Implementing First Aspect of the Invention

Figure 8:
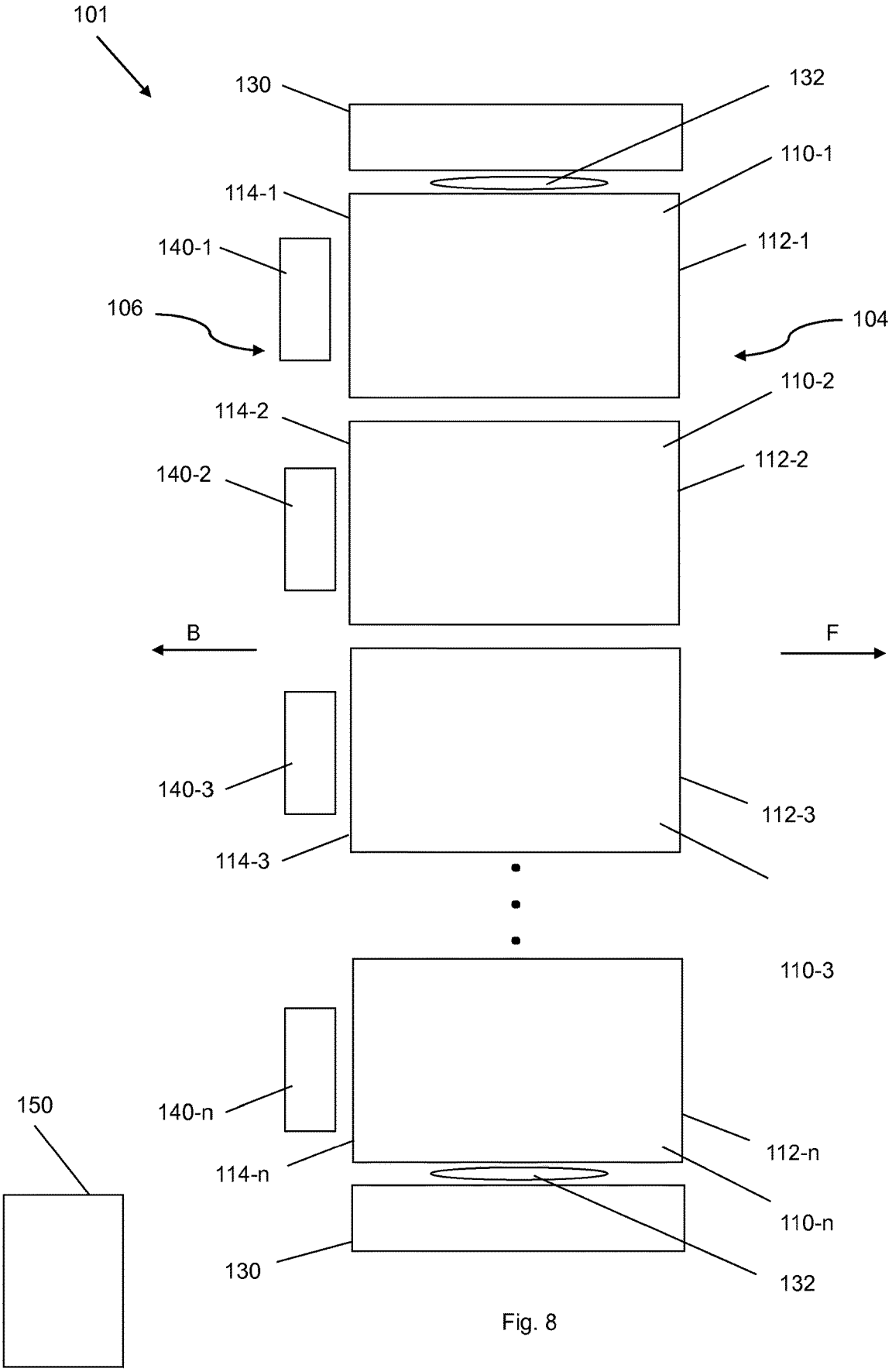
FIG. 8 is a schematic view of a loudspeaker unit 101 for producing sound at bass frequencies according to the first aspect of the invention.

FIG. 8 is a schematic view of a loudspeaker unit 101 for producing sound at bass frequencies according to the first aspect of the invention.

The loudspeaker unit 101 includes an array of n diaphragms 110 (features relating to an individual diaphragm are labelled with the suffix "−1", "−2", "−3" . . . "−n"). Each diaphragm has a first radiating surface 112, and a second radiating surface 114, wherein the first radiating surface 112 and the second radiating surface 114 are located on opposite faces of the diaphragm.

The loudspeaker unit 101 also includes a frame 130, wherein each diaphragm 110 in the array is suspended from the frame 130 via one or more suspension elements 132 such that the first radiating surfaces 112 are facing in a first ("forwards") direction F and the second radiating surfaces 114 are facing in an opposite ("backwards") second direction B, wherein the frame 130 is configured to allow sound produced by the first radiating surfaces 112 to propagate out from a first side 104 of the loudspeaker unit 101 in the first direction F and to allow sound produced by the second radiating surfaces 114 to propagate out from a second side 106 of the loudspeaker unit in the second direction B.

The loudspeaker unit 101 also includes a plurality of drive units 140, wherein each drive unit 140 is configured to move a respective one of the diaphragms 110 in the array based on a respective electric signal.

One or more of the diaphragms 110 are included in a first subset of the diaphragms 110 and one or more of the diaphragms 110 are included in a second subset of the diaphragms 110.

The loudspeaker unit 101 also includes drive circuitry (not shown in FIG. 8) configured to provide each drive unit 140 with a respective electrical signal derived from the same audio source such that the electrical signal(s) provided to the one or more drive units 140 configured to move the first subset of diaphragms 110 is/are out of phase with respect to the electrical signal(s) provided to the one or more drive units 140 configured to move the second subset of diaphragms 110.

Figure 9A:
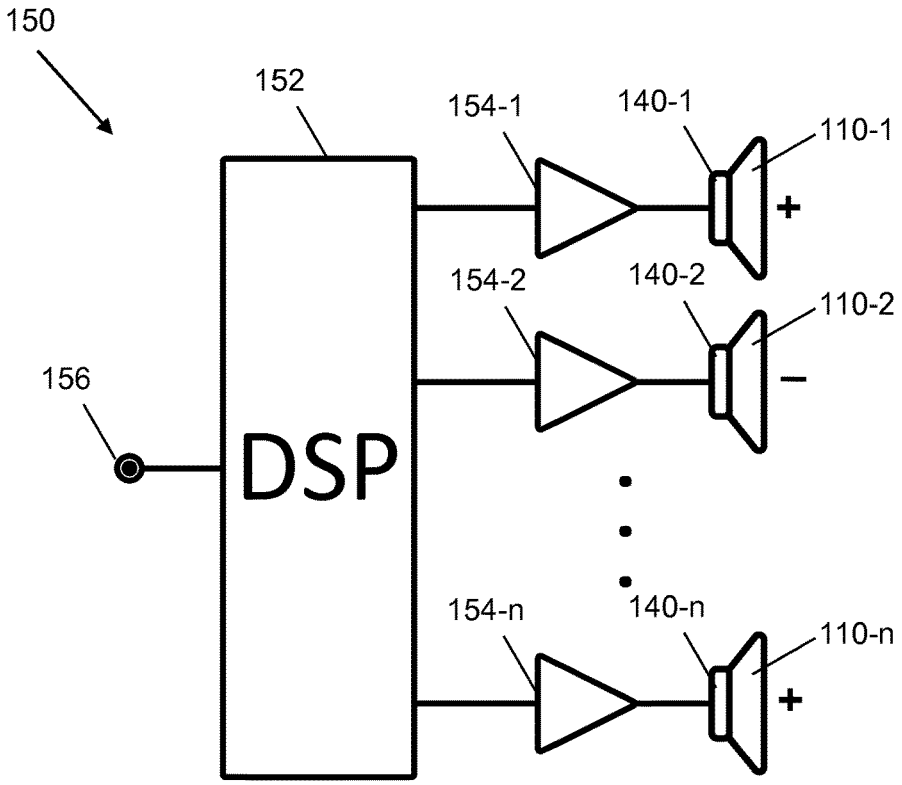
FIGS. 9(*a*) and 9(*b*) each show an example of drive circuitry 150, 150' which may be included in the loudspeaker 101 of FIG. 8.
Figure 9B:
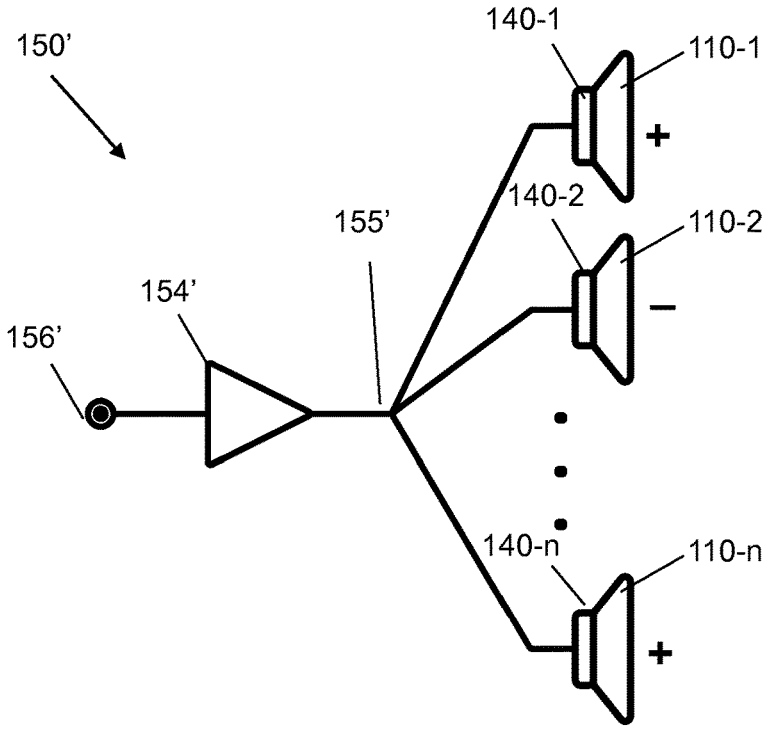

FIGS. 9(*a*) and 9(*b*) each show an example of drive circuitry 150, 150' which may be included in the loudspeaker 101 of FIG. 8 and be configured to provide each drive unit 140 of the loudspeaker unit 101 of FIG. 8 with a respective electrical signal derived from the same audio source such that the electrical signal(s) provided to the one or more drive units 140 configured to move the first subset of diaphragms 110 are out of phase with respect to the electrical signal(s) provided to the one or more drive units 140 configured to move the second subset of diaphragms 110.

For brevity, sound produced by a first radiating surface of a diaphragm in the first subset of diaphragms may be referred to as "in-phase" and/or marked with a '+' in drawings shown herein. Similarly, and also for brevity, sound produced by a first radiating surface of a diaphragm in the second subset of diaphragms may be referred to as "out-of-phase" and/or marked with a '−' in drawings shown herein. However, for avoidance of any doubt, the terms "in-phase" and "out-of-phase" and the symbols '+' and '−' are used in this way merely as a convention in order to indicate out of phase sound produced by different radiating surfaces.

The example drive circuitry 150 of FIG. 9(*a*) includes a digital signal processor ("DSP") 152 configured to provide each drive unit 140 with a respective electrical signal via a respective amplifier 154, wherein the respective electrical signal is derived from an audio signal (in this case a digital audio signal) provided by the audio source at node 156. It is straight forward for such a unit to provide manipulate the electrical signals provided to each drive unit 140 so that each drive unit 140 is provided with a respective electrical signal derived from the same audio source such that the electrical signal(s) provided to the one or more drive units 140 configured to move the first subset of diaphragms 110 (marked with a '+') is/are out of phase with respect to the electrical signal(s) provided to the one or more drive units 140 configured to move the second subset of diaphragms 110 (marked with a '−'). As described in more detail below, the DSP 152 may additionally be used to manipulate the electrical signal respectively provided to each drive unit 140, e.g. to modify the phase, delay or amplitude of the electrical signal respectively provided to each drive unit 140 so as to optimise the sound provided to a user (e.g. in a manner described below).

The example drive circuitry 150' of FIG. 9(*b*) includes an amplifier 154' and wiring 155' configured to reverse the polarity of the electrical signal(s) provided to the/each drive unit 140 configured to move a diaphragm 110 in the second subset of diaphragms (marked with a '−') compared to the electrical signal(s) provided to the/each drive unit 140 configured to move a diaphragm in the first subset of diaphragms 110 (marked with a '+'), e.g. with + and – wires supplying an audio signal provided by the audio source 156' via the amplifier 154' being connected to the/each drive unit 140 configured to move the second subset of diaphragms the other way around compared with the way + and – wires are connected to the/each drive unit 140 configured to move the first subset of diaphragms 110.

The drive circuitry 150, 150' of FIGS. 9(*a*) and 9(*b*) is preferably configured to provide each drive unit 140 with a respective electrical signal that includes frequencies across the range 60-80 Hz, preferably frequencies across the range 40-100 Hz, and may include frequencies across the range 40-160 Hz, and with frequencies that do not exceed 400 Hz, more preferably 200 Hz. If the frequencies do not exceed 200 Hz, the loudspeaker unit 101 may be understood as a subwoofer.

The following drawings and corresponding discussion sets out some guiding principles for how the loudspeaker unit 101 of FIG. 8 could be implemented in a car headrest. In some cases, a dipole loudspeaker unit containing only one diaphragm is depicted for comparative purposes.

Figure 10:
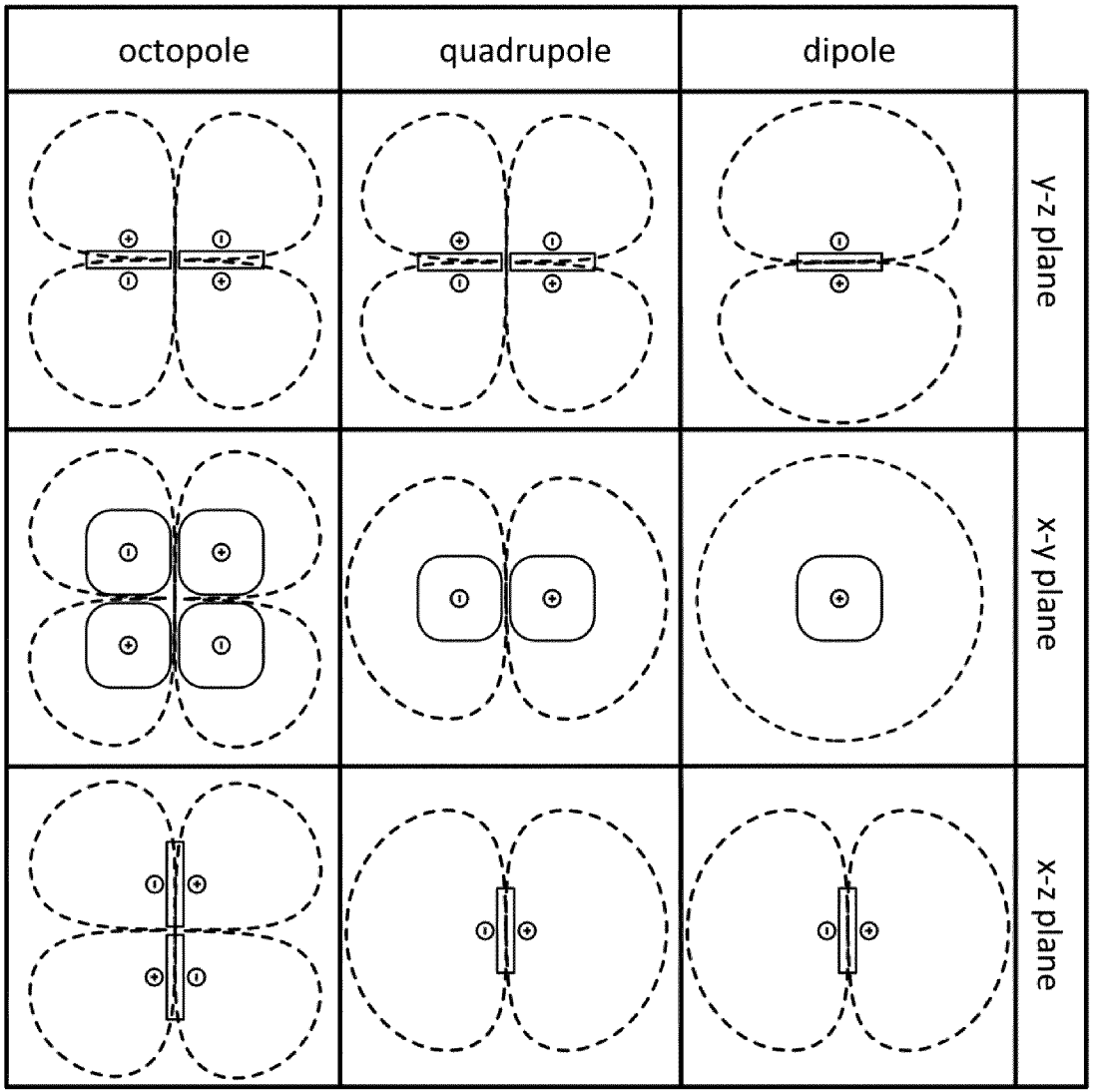
FIG. 10 shows the polar response in the y-z, x-y and x-z planes for a dipole, a quadrupole and an octopole loudspeaker unit as described with respect to FIGS. 1(*a*), 2(*a*) and 3(*a*) respectively.

FIG. 10 shows the polar response in the y-z, x-y and x-z planes for a dipole, a quadrupole and an octopole loudspeaker unit as described with respect to FIGS. 1(*a*), 2(*a*) and 3(*a*) respectively.

Knowing these polar responses can help with deciding on a preferred implementation of a multipole loudspeaker unit.

Figure 11A:
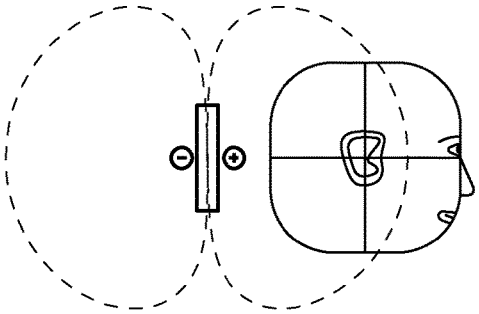
FIGS. 11(*a*)-(*c*) illustrate some preferred listening positions for use with (a) a dipole loudspeaker unit, (b) a quadrupole loudspeaker unit and (c) an octopole loudspeaker.
Figure 11B:
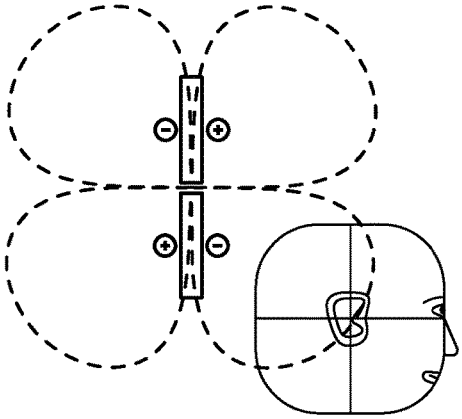
Figure 11C:
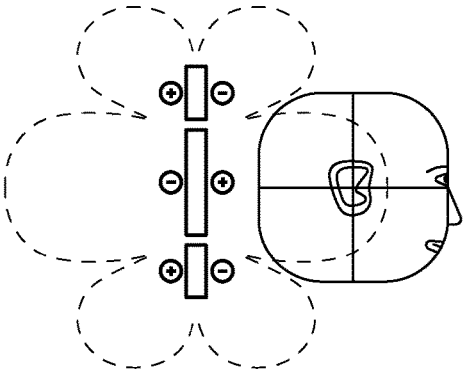

FIGS. 11(*a*)-(*c*) illustrate some preferred listening positions for use with (a) a dipole loudspeaker unit, (b) a quadrupole loudspeaker unit and (c) an octopole loudspeaker.

Figure 12A:
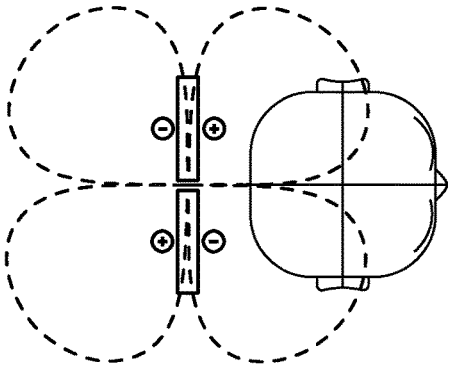
FIGS. 12(*a*)-(*b*) illustrate some other possible listening positions for use with (a) a quadrupole loudspeaker and (c) an octopole loudspeaker.
Figure 12B:
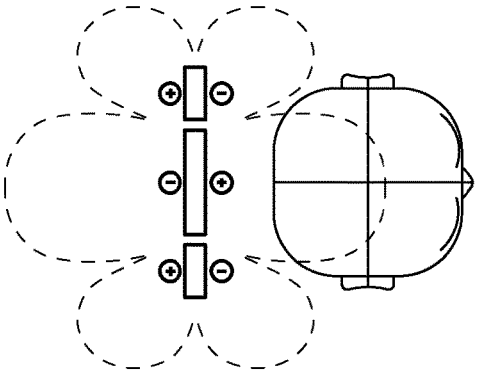

FIGS. 12(*a*)-(*b*) illustrate some other possible listening positions for use with (a) a quadrupole loudspeaker and (c) an octopole loudspeaker.

In the octopole loudspeaker units of FIG. 11(*c*) and FIG. 12(*b*), there are three diaphragms arranged in a linear array, with a central diaphragm having radiating surfaces with twice the area of the other two diaphragms. Although there are only three diaphragms (and so technically this is a hexapole loudspeaker), this is referred to as a linear octopole loudspeaker unit because it is directly equivalent to a linear array of four diaphragms of equal size in which the two central diaphragms are driven with the same polarity as each other, and the two outer diaphragms are driven with the opposite polarity.

In each of FIGS. 11(*a*)-(*c*), the ears of a user are located at first and second listening positions which are in front of a radiating surface of the same diaphragm of the loudspeaker unit. This is preferred, since this helps to maximise the SPL at those listening positions by placing both ears well within one lobe.

The arrangement of FIG. 12(*a*) is not preferred because the ears of a user are located at first and second listening positions which are in front of radiating surfaces of the loudspeaker unit driven out of phase with each other. In experiments conducted by the present inventor, it was found that using this configuration at frequencies up to 150 Hz could be fatiguing/unpleasant for a user, though SPL levels were acceptable. By lowering the frequency to 100 Hz, more preferably 80 Hz, this arrangement could provide acceptable performance (i.e. without over-fatiguing a listener), though performance was not as good as with "in phase" reproduction for both ears.

The arrangement of FIG. 12(*b*) is not preferred because the ears of a user are located at first and second listening positions which are close to SPL nulls.

Figure 13:
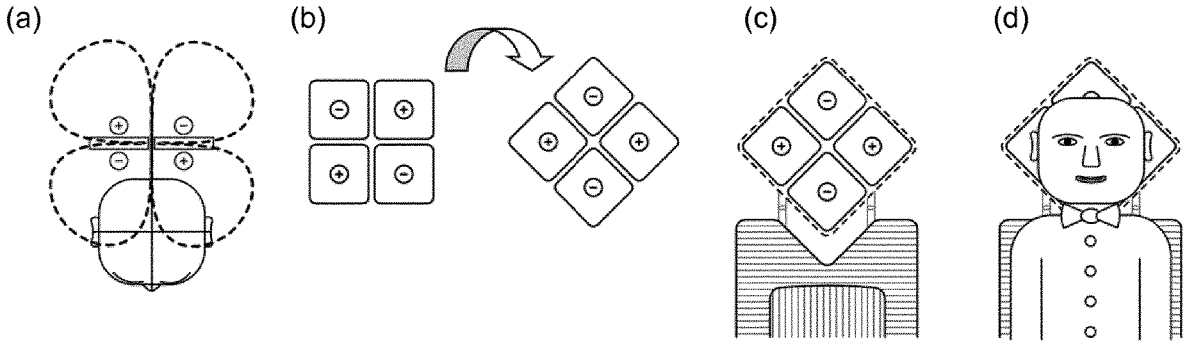
FIGS. 13(*a*)-(*d*) show how an octopole loudspeaker unit including four dipole loudspeakers arranged in a square array could be configured for use in a car headrest.

FIGS. 13(*a*)-(*d*) show how an octopole loudspeaker unit including four dipole loudspeakers arranged in a square array could be configured for use in a car headrest.

As shown in FIG. 13(*a*), orienting the array of diaphragms in two vertically stacked pairs within a car headrest could lead to the ears of a user being located at first and second listening positions which are in front of radiating surfaces of the loudspeaker unit driven out of phase with each other (or at nulls).

By flipping the orientation of the diaphragms by 45° as shown in FIG. 13(*b*), a car headrest can be obtained as shown in FIGS. 13(*c*) and 13(*d*) in which the ears of a user are located at first and second listening positions, wherein both listening positions are located in front of a geometric centre of a respective radiating surface, with those radiating surfaces being driven in-phase with each other. This helps to avoid the fatiguing of a listener as described with respect to FIG. 12(*a*).

Figure 14:
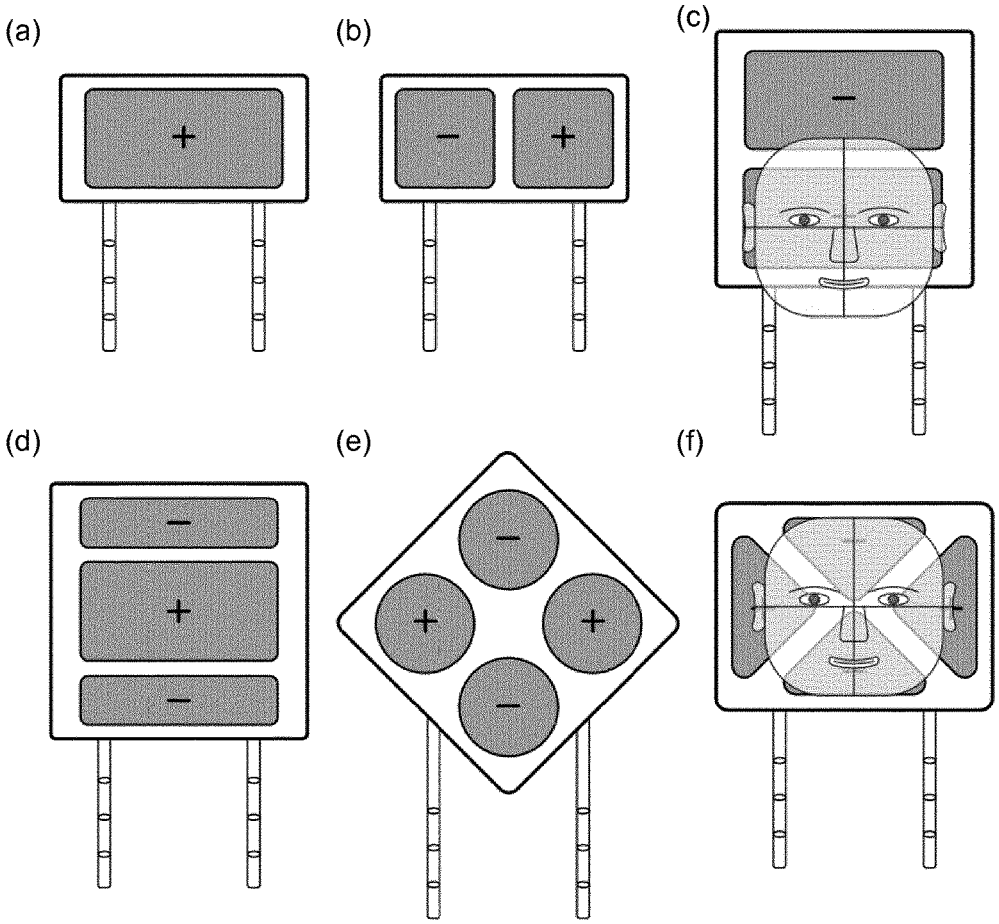
FIGS. 14(*a*)-(*f*) show various implementations of a multipole loudspeaker unit incorporating various numbers of diaphragms implemented in a car headrest, wherein each diaphragm provides a respective dipole loudspeaker.

FIGS. 14(*a*)-(*f*) show various implementations of a multipole loudspeaker unit incorporating various numbers of diaphragms implemented in a car headrest, wherein each diaphragm provides a respective dipole loudspeaker.

In FIG. 14(*a*), the loudspeaker unit is a dipole loudspeaker unit mounted within the headrest so that the ears of a user are located at first and second listening positions in front of the same radiating surface.

In FIG. 14(*b*), the loudspeaker unit is mounted within the headrest so that the ears of a user are located at first and second listening positions which are in front of radiating surfaces of the loudspeaker unit driven out of phase with each other. This is not preferred for reasons discussed above.

In FIGS. 14(*c*)-(*d*), the loudspeaker unit is mounted within the headrest so that the ears of a user are located at first and second listening positions which are in front of a radiating surface of the same diaphragm of the loudspeaker unit, which is preferred for reasons discussed above.

In FIGS. 14(*e*)-(*f*), the loudspeaker unit is mounted within the headrest so that the ears of a user are located at first and second listening positions, wherein both listening positions are located in front of a geometric centre of a respective radiating surface, with those radiating surfaces being driven in-phase with each other. In FIG. 14(*f*), the shapes of the diaphragms are also configured to maximise the surface area of the radiating surfaces.

Figure 15:
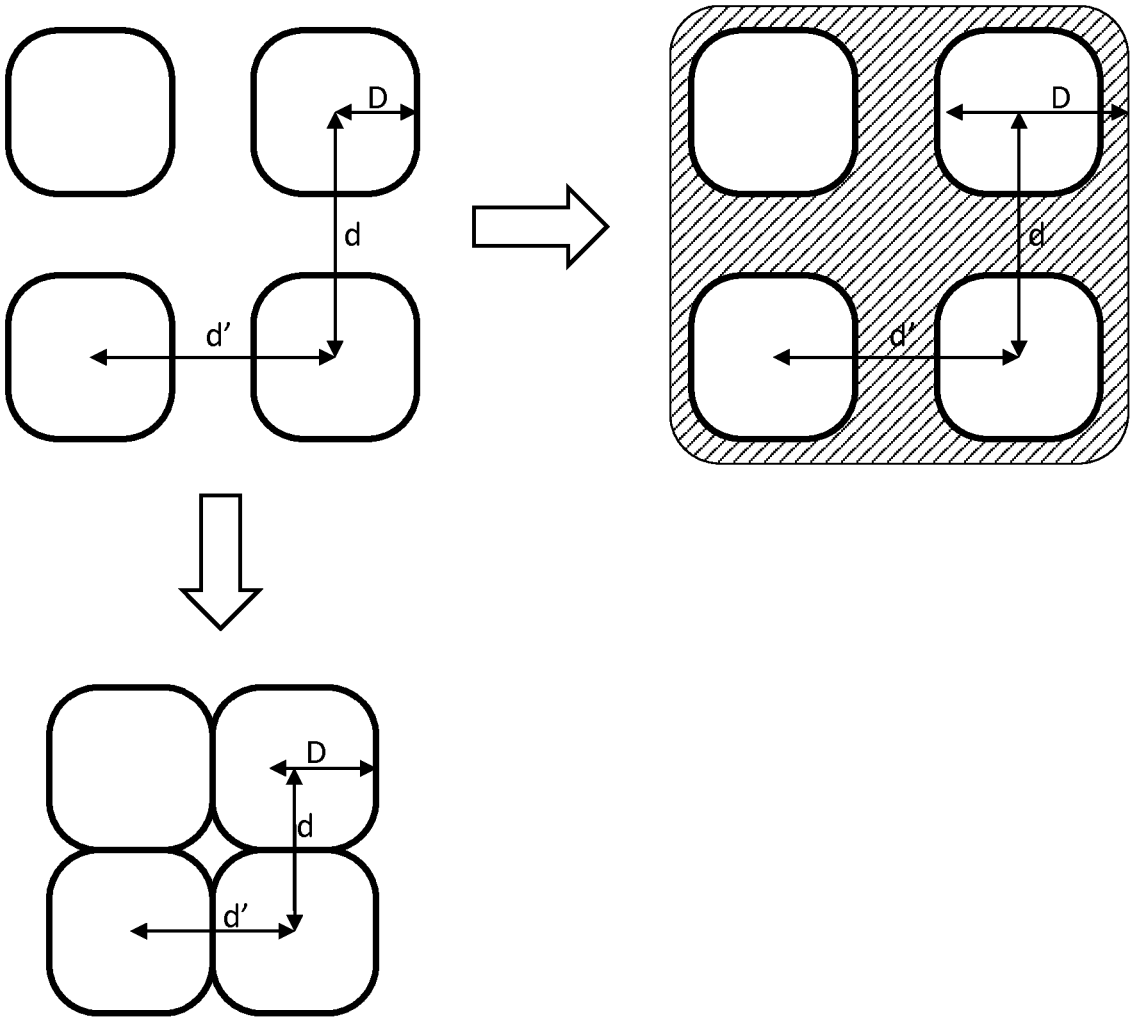
FIG. 15 illustrates various ways in which an octopole loudspeaker unit including four diaphragms arranged in a square array could be configured to alter its performance.

FIG. 15 illustrates various ways in which an octopole loudspeaker unit including four diaphragms arranged in a square array could be configured to alter its performance.

As explained above with reference to FIGS. 3(*a*) and 3(*b*), the relationship between the pressure $p_{oc}$, k, D, d and d' produced by the quadrupole loudspeaker unit of FIG. 3(*a*) at bass frequencies and in the farfield can theoretically be represented by the following relation:

$$p_{oc} \propto k^3 \cdot D \cdot d \cdot d' \cdot \cos(\alpha) \cdot \sin(\alpha) \cdot \cos(\beta) \quad (3)$$

As shown in FIG. 15, each of D, d and d' can be altered by adding a baffle (which changes D) or by changing the separation of the diaphragms (which changes d and/or d'), which in turn can be used to alter the performance of (e.g. level of cocooning provided by) the loudspeaker unit.

Figure 16:
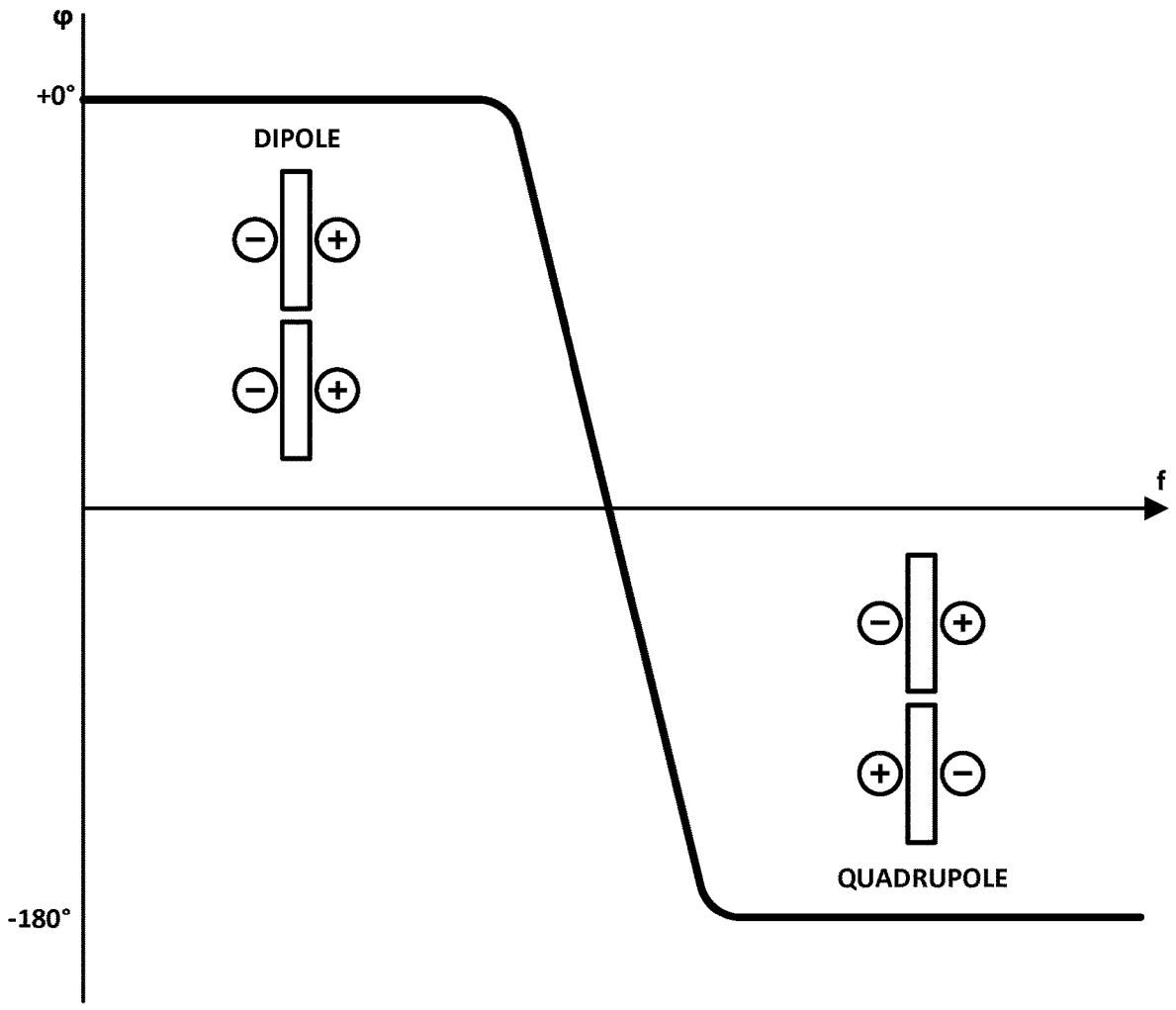
FIG. 16 shows how a multipole loudspeaker unit, in this example a quadrupole loudspeaker unit, could multiple operational modes FIGS. 17(*a*)-(*h*) show various further implementations of a loudspeaker unit incorporating various numbers of diaphragms implemented in a car headrest, wherein each diaphragm provides a respective dipole loudspeaker.

FIG. 16 shows how a multipole loudspeaker unit, in this example a quadrupole loudspeaker unit, could have multiple operational modes, wherein:

in a first operational mode (shown on the right-hand side of the figure), the drive circuitry is configured to provide the drive unit(s) configured to move the first subset of diaphragms with an electrical signal that is out of phase with respect to an electrical signal that is provided to the drive unit(s) configured to move the second subset of diaphragms; and in a second operational mode (shown on the left-hand side of the figure), the drive circuitry is configured to provide the drive unit(s) configured to move the first subset of diaphragms with an electrical signal that is in phase with respect to an electrical signal that is provided to the second subset of the diaphragms.

In the second operational mode, it can be seen that the quadrupole loudspeaker unit is in effect operating as a dipole loudspeaker unit. This may be useful e.g. to allow the loudspeaker unit to produce higher sound pressure levels in situations in which creating a personal sound cocoon is not needed or not as important (e.g. where all passengers in a car are listening to the same audio).

Figure 17:
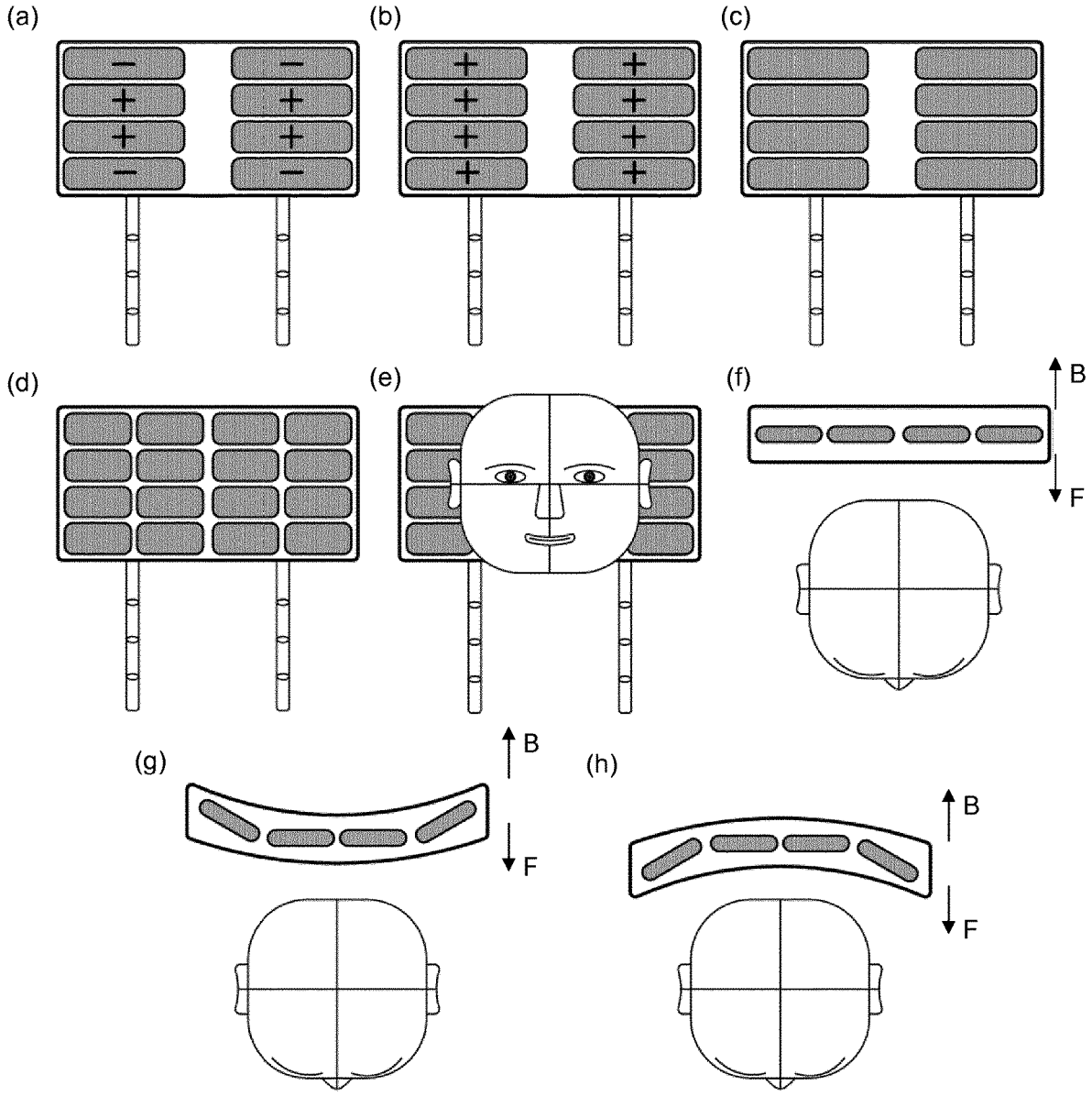

FIGS. 17(*a*)-(*h*) show various further implementations of a loudspeaker unit incorporating various numbers of diaphragms implemented in a car headrest, wherein each diaphragm provides a respective dipole loudspeaker.

In FIGS. 17(*a*)-(*c*), an example is shown in which there are eight diaphragms which provide eight dipole loudspeakers. FIG. 17(*a*) shows one operating mode for this loudspeaker unit in which the drive units configured to move a first subset of diaphragms ('+') are provided with an electrical signal that is out of phase with respect to an electrical signal provided to the drive units configured to move a second subset of diaphragms ('−'). FIG. 17(*b*) shows another operating mode for this loudspeaker unit in which all drive units are provided with an electrical signal having the same phase, such that the loudspeaker unit is in effect operating as a dipole loudspeaker unit. Yet further operating modes, e.g. in which the first and second subsets are changed, may also be implemented with the loudspeaker unit of FIGS. 17(*a*)-(*c*).

In FIGS. 17(*d*)-(*h*), there are sixteen diaphragms which provide sixteen dipole loudspeakers, to potentially provide an even better cocooning effect.

FIGS. 17(*f*)-(*h*) show that whilst first radiating surfaces of each diaphragm in the array all face in a first direction (in this case a "forwards" direction F) so that sound produced by the first radiating surfaces can propagate out from a first side of the loudspeaker unit in the first direction and the second radiating surfaces of each diaphragm in the array all face in an opposite second direction (in this case a "backwards" direction B) so that sound produced by the second radiating surfaces to propagate out from a second side of the loudspeaker unit in the second direction, the principal radiating axes of the first and second radiating surfaces need not be parallel to each other, and may be arranged e.g. with the principal radiating axes of the first radiating surfaces being arranged to converge (as in FIG. 17(*h*)) or diverge (as in FIG. 17(*g*)).

Examples which implement the loudspeaker unit 101 of FIG. 8 in a car headrest will now be described, with alike reference numerals indicating corresponding features that do not need to be described further, except where further explanation is provided.

Figure 18:
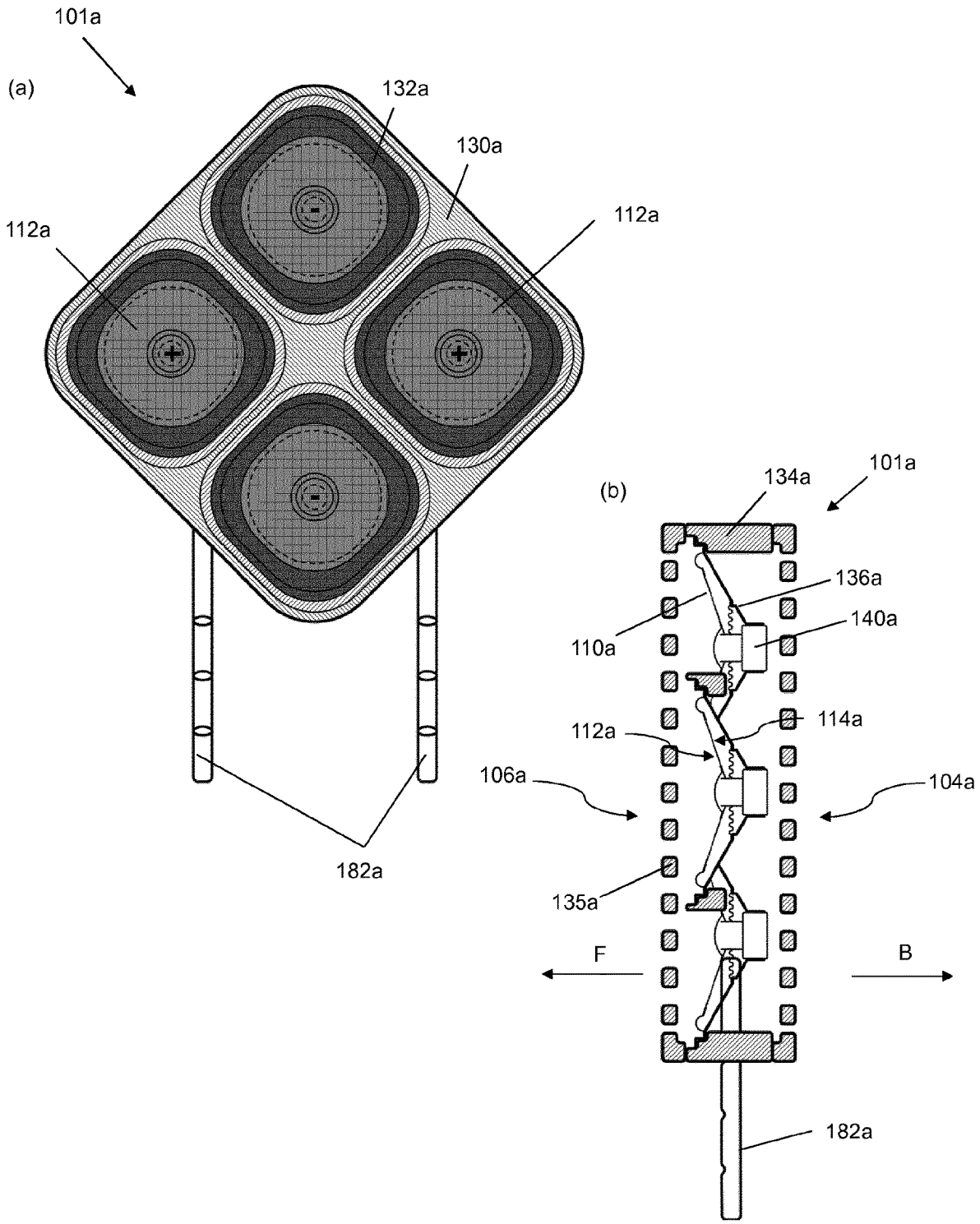
FIGS. 18(*a*) and 18(*b*) show a first example loudspeaker unit 101*a* which implements the loudspeaker unit 101 of FIG. 8 in a car headrest.

FIGS. 18(*a*) and 18(*b*) show a first example loudspeaker unit 101*a* which implements the loudspeaker unit 101 of FIG. 8 in a car headrest.

In this example, there are four diaphragms 110*a* arranged in a 2×2 array.

In this example, the diaphragms 110*a* take the form of paper cones, wherein the concave surface of the cones provide the first radiating surfaces 112*a*.

In this example, the loudspeaker unit 101*a* is implemented with a single frame configuration, wherein the frame 130*a* of the loudspeaker unit includes an outer frame 134*a* as well as a number of subframes.

The outer frame 134*a* is open at both the first and second sides of the loudspeaker 101*a* in order to allow sound produced by the first radiating surfaces 112*a* to propagate out from the first side 104 of the loudspeaker unit 101*a* in the first direction F and to allow sound produced by the second radiating surfaces 114*a* to propagate out from a second side 106*a* of the loudspeaker unit 101*a* in the second direction B, with only an acoustically transparent grill 135*a* of the outer frame 134*a* being provided in front of the first radiating surfaces 112*a* and second radiating surfaces 114*a* of the diaphragms 110*a*. The outer frame 134*a* may be covered by an acoustically transparent covering (not shown).

Each subframe includes one or more rigid supporting elements (e.g. arms) 136*a* configured to hold a magnet unit of each drive unit 140*a* in front of the second radiating surface 114*a* of a respective diaphragm 110*a*. Each drive unit 140*a* may be an electromagnetic drive unit that includes a magnet unit configured to produce a magnetic field, and a voice coil attached to the diaphragm (that the drive unit is configured to move). Such drive units are well known and do not need to be described further.

The diaphragms 110*a* are suspended from the frame 130*a* via suspension elements 132*a* which in this example include roll suspensions, as can most clearly be seen in FIG. 18(*a*).

The loudspeaker unit 101*a* is configured to be fixedly mounted to a car seat frame via mounting pins 182*a*.

In this example, there are four diaphragms 110*a* arranged in a square array and mounted within the headrest 180*a* similarly to FIG. 13, such that the ears of a user are located at first and second listening positions, wherein both listening positions are located in front of a geometric centre of a respective first radiating surface 112*a*, with those radiating surfaces being driven in-phase with each other (indicated by a '+').

Note that since the diaphragms are being moved out of phase with each other, the forces on the frame 130*a* due to movement of the diaphragms 110*a* will cancel out with each other, at least in a first operational mode of the loudspeaker unit 101*a* as described above. However, if the loudspeaker unit 101*a* is configured to also operate in a second operational mode in which all the diaphragms are moved in phase with each other, then the forces on the frame 130*a* due to movement of the diaphragms 110*a* will add to each other, and it may be desirable to suspend the frame 130*a* from another frame, e.g. as described below with reference to FIG. 20.

Figure 19:
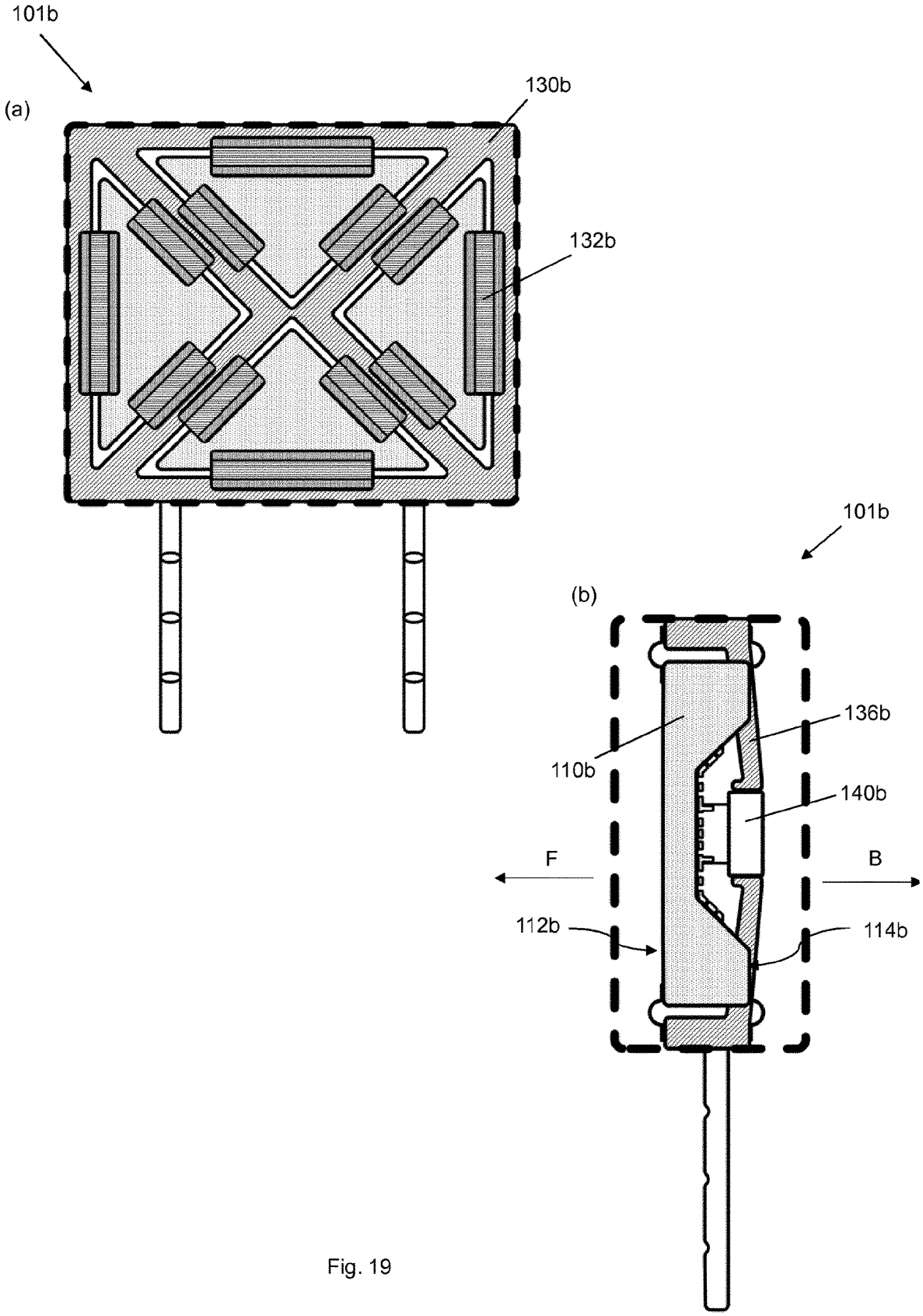
FIGS. 19(*a*) and 19(*b*) show a second example loudspeaker unit 101*b* which implements the loudspeaker unit 101 of FIG. 8 in a car headrest.

FIGS. 19(*a*) and 19(*b*) show a second example loudspeaker unit 101*b* which implements the loudspeaker unit 101 of FIG. 8 in a car headrest.

In this example, there are four diaphragms 110*b* arranged in a 2×2 array, where the shape of the diaphragms 110*b* is intended to maximise the surface area of the radiating surfaces 112*b*, 114*b*.

In this example, the diaphragms 110*b* take the form of single pieces of lightweight material, such as extruded polystyrene, wherein opposite faces of the lightweight material provide the first radiating surfaces 112*b* and second radiating surfaces 114*b*.

Each diaphragm 110*b* is suspended from the frame 130*b* via suspension elements 132*a* which in this example include roll suspensions, as can most clearly be seen in FIG. 19(*b*). The roll suspensions include "front" roll suspensions attached between the first radiating surfaces 112*b* of the diaphragms 110*b* and the frame 130*b* and "back" roll suspensions attached between the second radiating surfaces

114*b* of the diaphragms 110*b* and the frame 130*b*. For each diaphragm 110*b*, the position, number and length of the "front" and "back" roll suspension are matched to help eliminate any asymmetries in the performance of the roll suspensions.

Preferably, the one or more suspension elements (e.g. one or more roll suspensions) attached between the first radiating surface of the diaphragm and the frame correspond to (e.g. match, e.g. match in position, number and length) the one or more suspension elements (e.g. one or more roll suspensions) attached between the second radiating surface of the diaphragm and the frame.

Similarly to the example of FIGS. 18(*a*) and 18(*b*), in this example the loudspeaker unit 101*b* is implemented with a single frame configuration, with one or more rigid supporting elements 136*b* (e.g. arms) configured to hold a magnet unit of each drive unit 140*b* in front of the second radiating surface 114*b* of a respective diaphragm 110*b*.

In this example, each diaphragm 110*b* includes cavities in the second radiating surface 114*b*, wherein each cavity is configured to have a respective rigid supporting element 136*b* extend through it when the loudspeaker unit 101*b* is in use. This may allow the loudspeaker unit 101*b* to have a lower profile in the thickness direction of the diaphragms.

Figure 20:
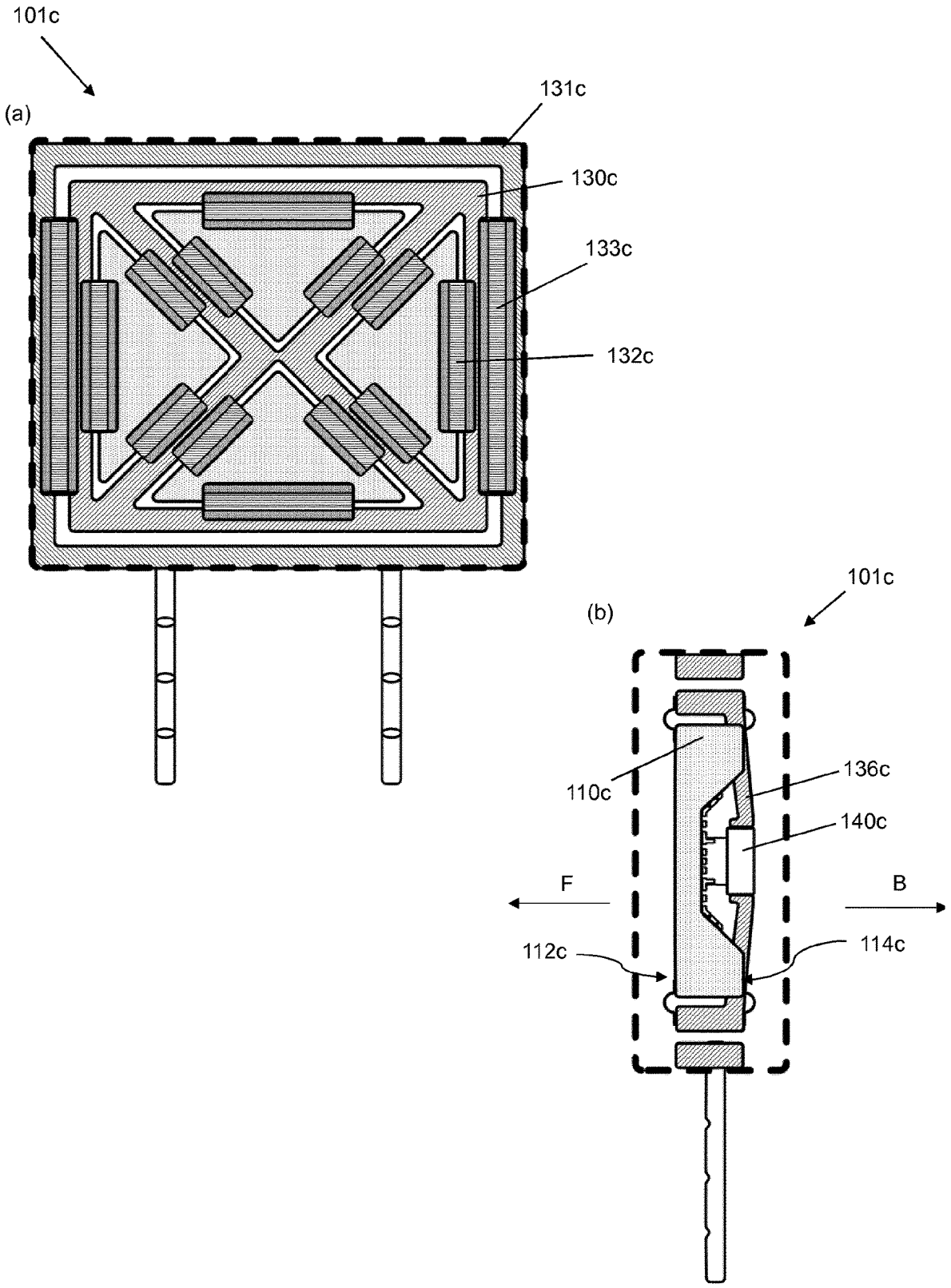
FIGS. 20(*a*) and 20(*b*) show a third example loudspeaker unit 101*c* which implements the loudspeaker unit 101 of FIG. 8 in a car headrest.

FIGS. 20(*a*) and 20(*b*) show a third example loudspeaker unit 101*c* which implements the loudspeaker unit 101 of FIG. 8 in a car headrest.

In this example, there are four diaphragms 110*c* arranged in a 2×2 array, where again the shape of the diaphragms 110*b* is intended to maximise the surface area of the radiating surfaces 112*b*, 114*b*.

In this example, the loudspeaker unit 101*c* is implemented with a dual frame configuration, and includes a primary frame 130*c* and a secondary frame 131*c*, wherein each diaphragm 110*c* is suspended from the primary frame 130*c* via primary suspension elements 132*c*, and wherein the primary frame 130*c* is suspended from the secondary frame 131*c* via one or more secondary suspension elements 133*c*.

This dual frame configuration may be useful to reduce vibrations passing from the loudspeaker unit 101*c* into the environment.

The mounting of just one diaphragm 110*c* in the loudspeaker unit 101*c* is illustrated in FIG. 20.

Figure 21:
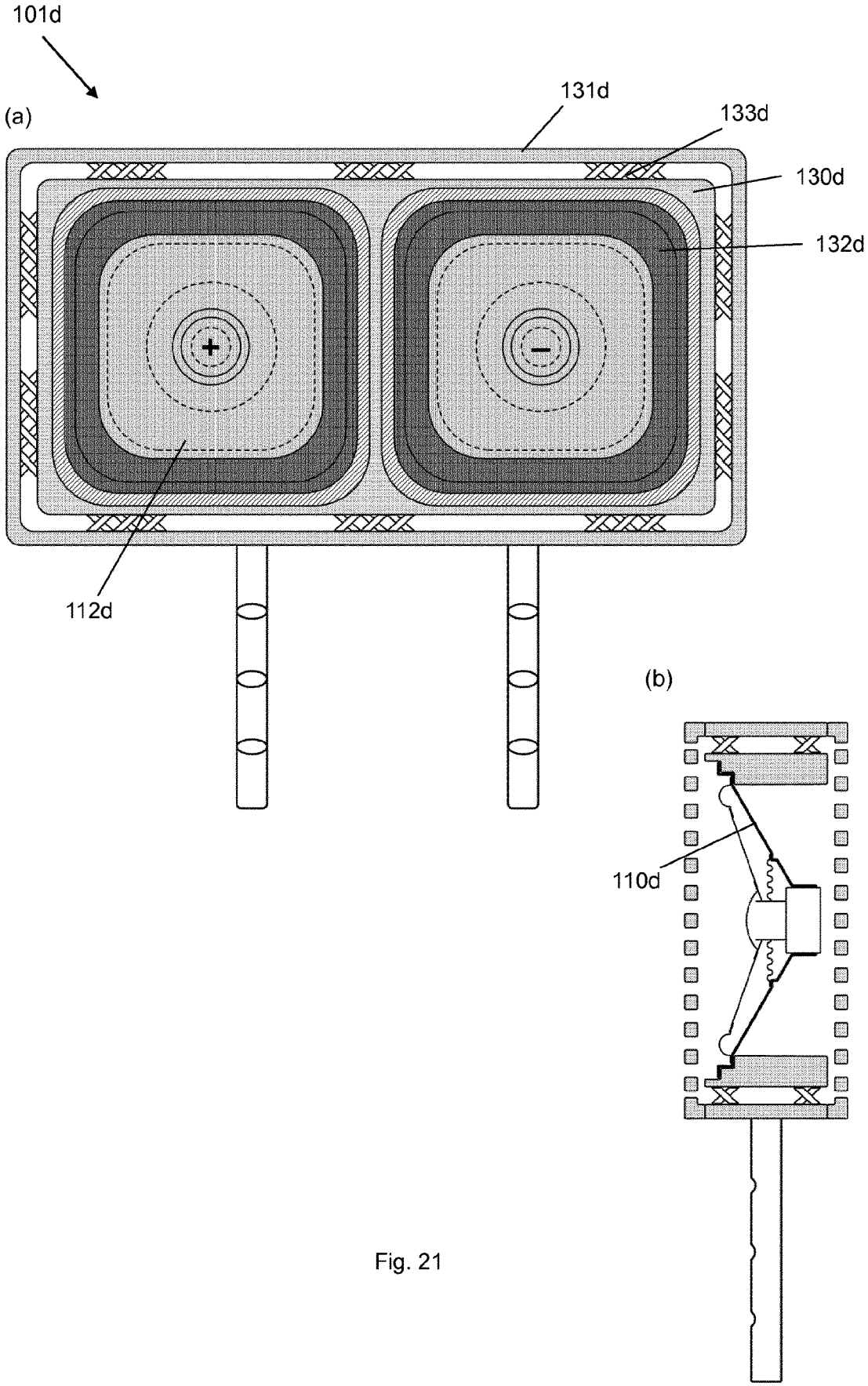
FIGS. 21(*a*) and 21(*b*) show a fourth example loudspeaker unit 101*d* which implements the loudspeaker unit 101 of FIG. 8 in a car headrest.

FIGS. 21(*a*) and 21(*b*) show a fourth example loudspeaker unit 101*d* which implements the loudspeaker unit 101 of FIG. 8 in a car headrest.

In this example, there are two diaphragms 110*d* arranged in a linear array.

This example also implements a dual frame configuration, and includes a primary frame 130*d* and a secondary frame 131*d*, wherein each diaphragm 110*d* is suspended from the primary frame 130*d* via primary suspension elements 132*d*, and wherein the primary frame 130*d* is suspended from the secondary frame 131*d* via one or more secondary suspension elements 133*d*.

In this example, there are only two diaphragms 110*d* configured such that the ears of a user are located at first and second listening positions which are in front of radiating surfaces 112*d* of the loudspeaker unit driven out of phase with each other. This is not preferred for reasons discussed above.

Figure 22:
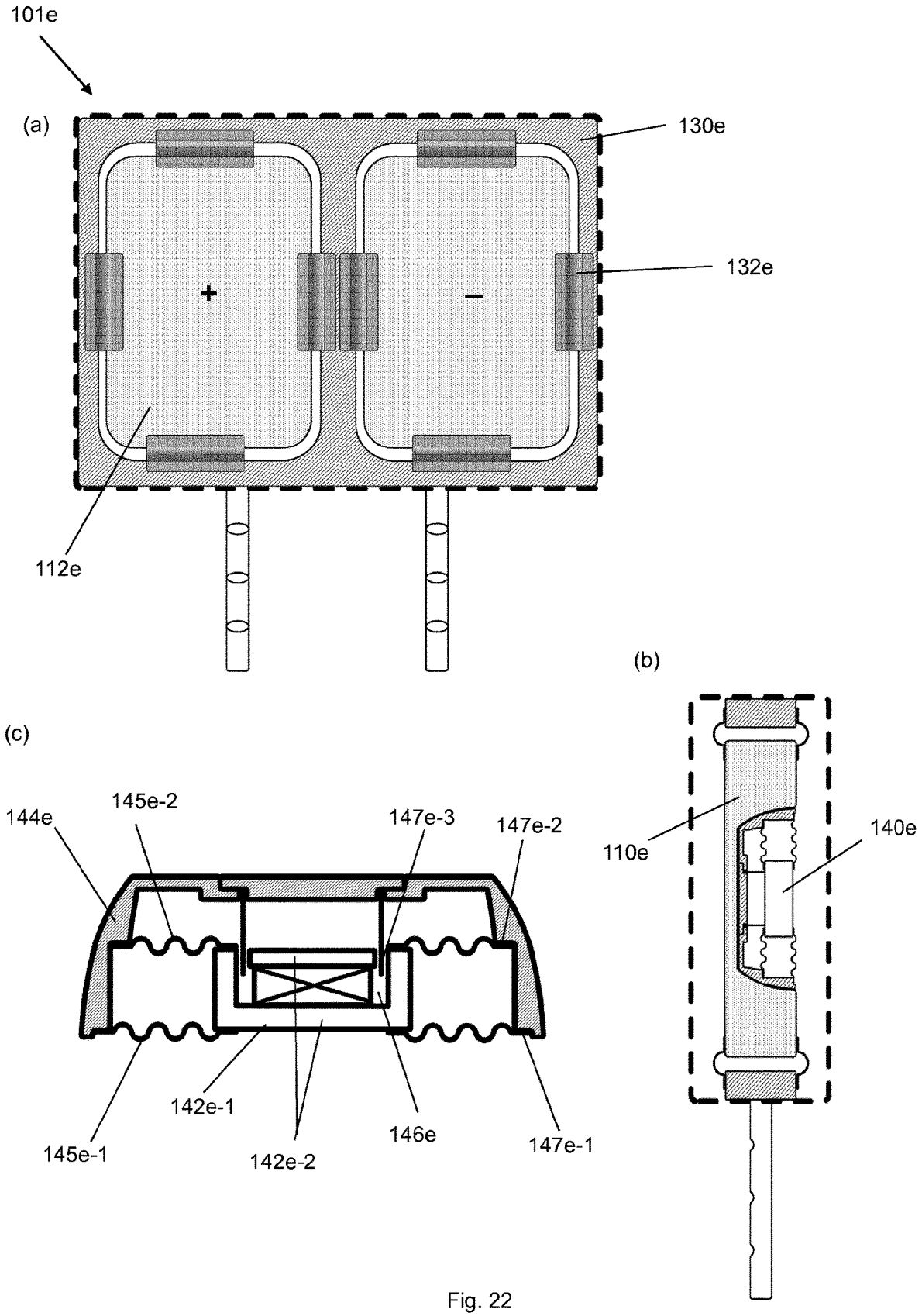
FIGS. 22(*a*)-(*c*) show a fifth example loudspeaker unit 101*e* which implements the loudspeaker unit 101 of FIG. 8 in a car headrest.

FIGS. 22(*a*)-(*c*) show a fifth example loudspeaker unit 101*e* which implements the loudspeaker unit 101 of FIG. 8 in a car headrest.

In this example, there are two diaphragms 110*e* arranged in a linear array.

In this example, the loudspeaker unit 101*e* is implemented with a single frame configuration, each diaphragm 110*e* being suspended from the frame 130*e* via suspension elements 132*e*.

In this example, the drive unit 140*e* is shown in more detail in FIG. 22(*c*), and includes a magnet unit 142*e* and a voice coil (not shown).

In this example, the voice coil is attached (e.g. glued) to the diaphragm 110*e* via a voice coil coupler 144*e* (described in more detail below).

In this example, the magnet unit 142*e* is suspended from the diaphragm 110*e* via two magnet unit suspension elements 143*e*-1, 143*e*-2 and the voice coil coupler 144*e*. In this example, the two magnet unit suspension elements 145*e*-1, 145*e*-2 take the form of spiders which may be made from an impregnated textile (metal springs may be used in other examples). A spider may be understood as a textile ring having circumferentially extending corrugations (which may facilitate movement along the longitudinal axis whilst substantially preventing movement perpendicular to this axis), as is known in the art. The spiders may be made of impregnated textile. The magnet unit 142*e* includes a permanent magnet 142*e*-1, and magnetic field guiding elements 142*e*-1. The permanent magnet 142*e*-1 and the magnetic field guiding elements 142*e*-2 of the magnet unit 142*e* are configured to define an airgap 146*e* and to provide a magnetic field having concentrated flux in the air gap 146*e*. The voice coil is configured to sit in the airgap 146*e* when the diaphragm 110*e* is at rest.

In this example, the voice coil coupler 144*e* takes the form of a housing provided with surfaces 208-1, 208-2 configured to allow the two magnet unit suspension elements 147*e*-1, 147*e*-2 to be attached (e.g. glued) to the voice coil coupler 144*e*. In this example, the housing of the voice coil coupler 144*e* also includes a cylindrical guiding surface 147*e*-3 onto which the voice coil may be mounted (e.g. glued) in place, though the voice coil is not shown in FIG. 20.

When a current is passed through the voice coil, it will produces a magnetic field which interacts with the magnetic field produced by the magnet unit 142*e* which will cause the diaphragm 110*e* to move relative to the magnet unit 142*e*, with this movement being accommodated by the magnet unit suspension elements 145*e*-1, 145*e*-2.

This example therefore shows how a magnet unit 142*e* can be suspended from the diaphragm 110*e*, rather than mounted to the frame 130*e*, as in the previous examples.

In this example, the voice coil coupler 144*e* is an element which attaches the voice coil to the second radiating surface 114*e* of the diaphragm 101. In this example, the voice coil coupler 144*e* is glued to both the voice coil and the diaphragm 110*e*, thereby attaching the diaphragm 110*e* to the voice coil, and may therefore include lots of holes to facilitate gluing. The voice coil coupler 144*e* may provide a safety element (located between the magnet unit and second radiating surface) which is configured to prevent the magnet unit 142*e* from passing through diaphragm 110*e* in the event of a crash. Because the voice coil coupler 144*e* attaches the voice coil to the second radiating surface 114*e* of the diaphragm 110*e*, the diaphragm 110*e* does not require a dustcap on the first radiating surface 110*e* in this example (unlike the example shown in FIGS. 16(*a*)-(*b*), for example).

The voice coil coupler 144*e* could be made of plastic, e.g. ABS, PC, or PVC, and may be filled with (e.g. 20%) glass fibres to improve structural strength. The voice coil coupler 144*e* could also be perforated to facilitate gluing and/or to allow visual inspection of the amount and curing of glue used. The size of the voice coil coupler 144*e* could be extended as needed for crash impact protection.

Figure 23:
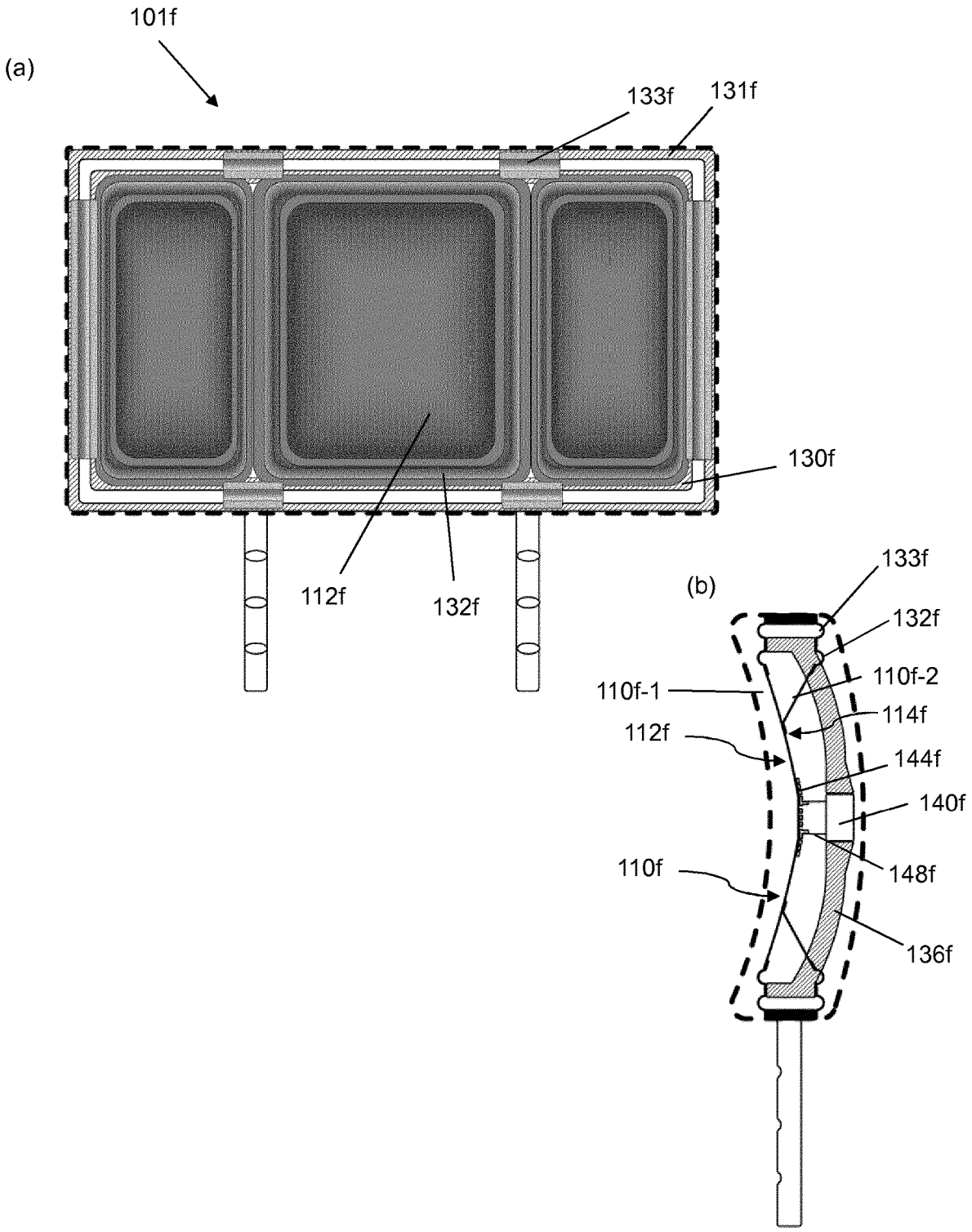
FIGS. 23(*a*) and 23(*b*) show a fifth example loudspeaker unit 101*f* which implements the loudspeaker unit 101 of FIG. 8 in a car headrest.

FIGS. 23(*a*) and 23(*b*) show a fifth example loudspeaker unit 101*f* which implements the loudspeaker unit 101 of FIG. 8 in a car headrest.

In this example, there are three diaphragms 110*d* arranged in a linear array.

This example implements a dual frame configuration, and includes a primary frame 130*f* and a secondary frame 131*f*, wherein each diaphragm 110*f* is suspended from the primary frame 130*f* via primary suspension elements 132*f* which are provided in this example as roll suspensions, and wherein the primary frame 130*f* is suspended from the secondary frame 131*f* via one or more secondary suspension elements 133*f* which are provided in this example as roll suspensions.

In this example, each diaphragm 110*f* is provided by a first cone 110*f*-1 and a second cone 110*f*-2 which are glued back to back and which respectively provide the first and second radiating surfaces 112*f*, 114*f*.

In this example, each diaphragm 110*f* and the frames 130*f*, 131*f* are curved.

In this example, the magnet unit of each drive unit 140*f* is held in front of a respective second radiating surface 114*f* by rigid supporting elements (e.g. arms) 136*f*. For each diaphragm 110*f*, a rigid safety element 144*f* located between the magnet unit and second radiating surface 114*f* is configured to prevent the magnet unit of the drive unit 140*f* from passing through diaphragm 110*e* in the event of a crash. The safety element 144*f* can be viewed as a voice coil coupler configured to attach the voice coil to the second radiating surface 112*f* of the diaphragm 110*f*, and gluing a voice coil former 148*f* In this case, that attachment is provided by gluing the rigid safety element 144*f* to a voice coil former 148*f* on which the voice coil (not shown) is mounted.

Examples Implementing Second Aspect of the Invention

Figure 24:
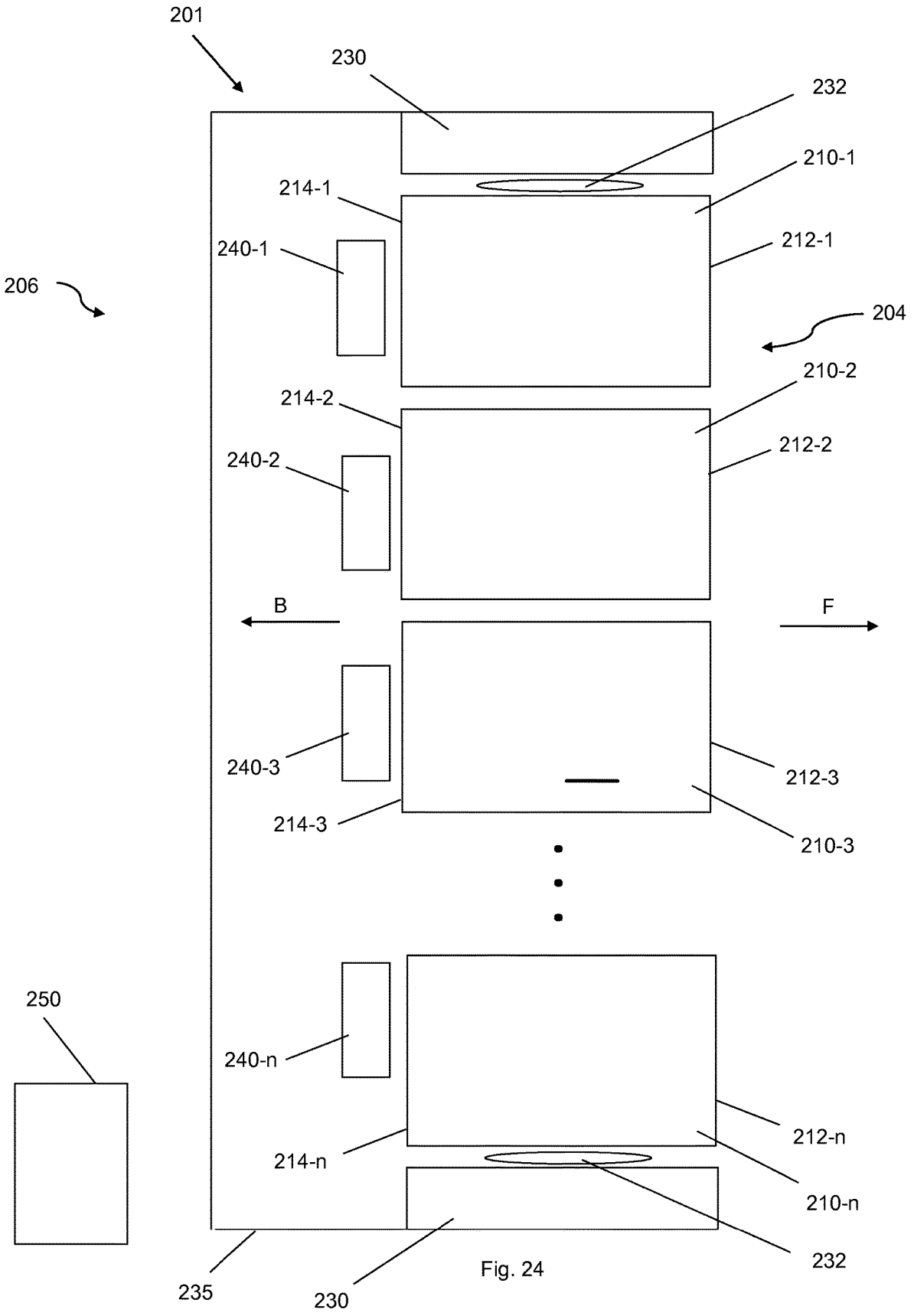
FIG. 24 is a schematic view of a loudspeaker unit 201 for producing sound at bass frequencies according to the second aspect of the invention.

FIG. 24 is a schematic view of a loudspeaker unit 201 for producing sound at bass frequencies according to the second aspect of the invention.

The loudspeaker unit 201 includes an array of n diaphragms 210 (features relating to an individual diaphragm are labelled with the suffix "−1", "−2", "−3" . . . "−n"). Each diaphragm has a first radiating surface 212, and a second radiating surface 214, wherein the first radiating surface 212 and the second radiating surface 214 are located on opposite faces of the diaphragm.

The loudspeaker unit 201 also includes a frame 230, wherein each diaphragm 210 in the array is suspended from the frame 230 via one or more suspension elements 232 such that sound produced by the first radiating surfaces 212 is allowed to propagate out from the loudspeaker unit 201.

As depicted in FIG. 24, that the first radiating surfaces 112 are facing in a first ("forwards") direction F and the second radiating surfaces 114 are facing in an opposite ("backwards") second direction B with the frame 130 being configured to allow sound produced by the first radiating surfaces 212 to propagate out from a first side 204 of the loudspeaker unit 201 in the first direction F. However, this is only schematic, and for reasons that can be understood from explanations elsewhere in this disclosure, other orientations of the diaphragms are possible (and indeed preferred).

The loudspeaker unit 201 also includes a plurality of drive units 240, wherein each drive unit 240 is configured to move a respective one of the diaphragms 210 in the array based on a respective electric signal.

The loudspeaker unit 201 also includes at least one enclosure 235 configured to receive sound produced by the second radiating surfaces 214. As depicted in FIG. 24, there is a single sealed enclosure 235 configured to receive sound produced by all the second radiating surfaces 214, thereby inhibiting sound produced by the second radiating surfaces 114 from propagating out from a second side 106 of the loudspeaker unit 201 in the second direction B. However, other enclosure arrangements are possible. For example, each of the second radiating surfaces 214 may face towards a central space which is enclosed by a single enclosure configured to receive sound produced by each one of the second radiating surfaces. It would also be possible for each second radiating surface to be provided with its own (respective) enclosure, for example.

One or more of the diaphragms 210 are included in a first subset of the diaphragms 210 and one or more of the diaphragms 210 are included in a second subset of the diaphragms 210.

The loudspeaker unit 201 also includes drive circuitry 250 configured to provide each drive unit 240 with a respective electrical signal derived from the same audio source such that the electrical signal(s) provided to the one or more drive units 240 configured to move the first subset of diaphragms 210 is/are out of phase with respect to the electrical signal(s) provided to the one or more drive units 240 configured to move the second subset of diaphragms 210.

Such drive circuitry may be implemented in a similar manner to the drive circuitry 150, 150' shown in FIG. 9(*a*) or 9(*b*), for example.

The following drawings and corresponding discussion sets out some guiding principles for how the loudspeaker unit 201 of FIG. 24 could be implemented in a car headrest. In the following examples, at least one enclosure is configured to receive sound produced by each diaphragm, such that a single diaphragm can be viewed as a monopole loudspeaker, two diaphragms can be viewed as a dipole loudspeaker, and four diaphragms can be viewed as a quadrupole loudspeaker.

In some cases, a monopole loudspeaker unit containing only one diaphragm is depicted for comparative purposes.

Figure 25:
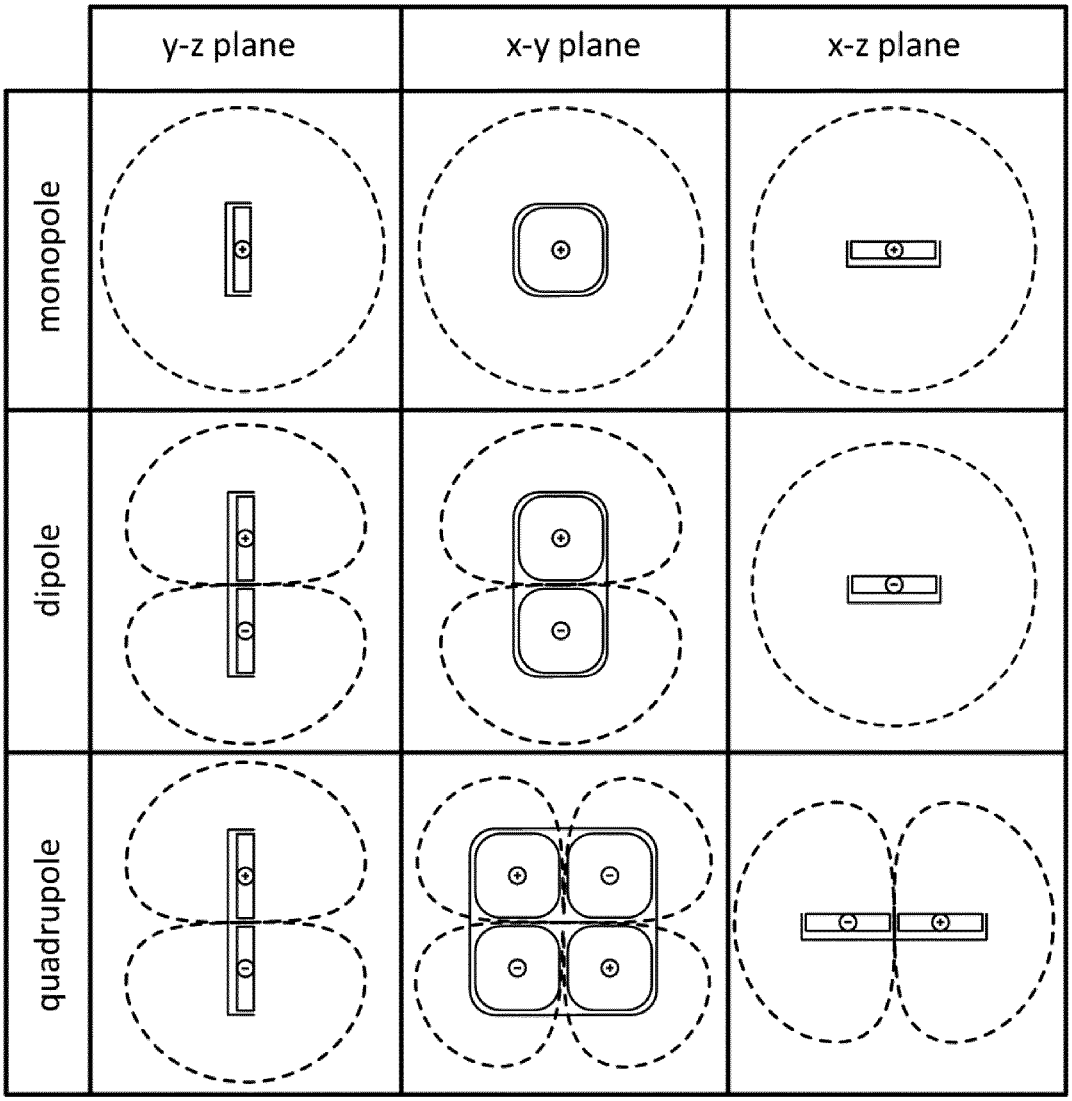
FIG. 25 shows the polar response in the y-z, x-y and x-z planes for a monopole loudspeaker unit including a single diaphragm (wherein an enclosure is configured to receive sound produced by a second radiating surface of this diaphragm), a dipole loudspeaker unit including a two diaphragms (wherein an enclosure is configured to receive sound produced by the second radiating surfaces of these diaphragms) and a quadrupole loudspeaker unit including four diaphragms (wherein an enclosure is configured to receive sound produced by the second radiating surfaces of these diaphragms).

FIG. 25 shows the polar response in the y-z, x-y and x-z planes for a monopole loudspeaker unit including a single diaphragm (wherein an enclosure is configured to receive sound produced by a second radiating surface of this diaphragm), a dipole loudspeaker unit including a two diaphragms (wherein an enclosure is configured to receive sound produced by the second radiating surfaces of these diaphragms) and a quadrupole loudspeaker unit including four diaphragms (wherein an enclosure is configured to receive sound produced by the second radiating surfaces of these diaphragms).

Knowing these polar responses can help with deciding on a preferred implementation of a multipole loudspeaker unit.

A particular point to note from FIG. 25 is that a monopole loudspeaker has a spherical polar response at bass frequencies, meaning it can be oriented in any direction according to design requirements, without changing the performance of the loudspeaker unit.

Figure 26:
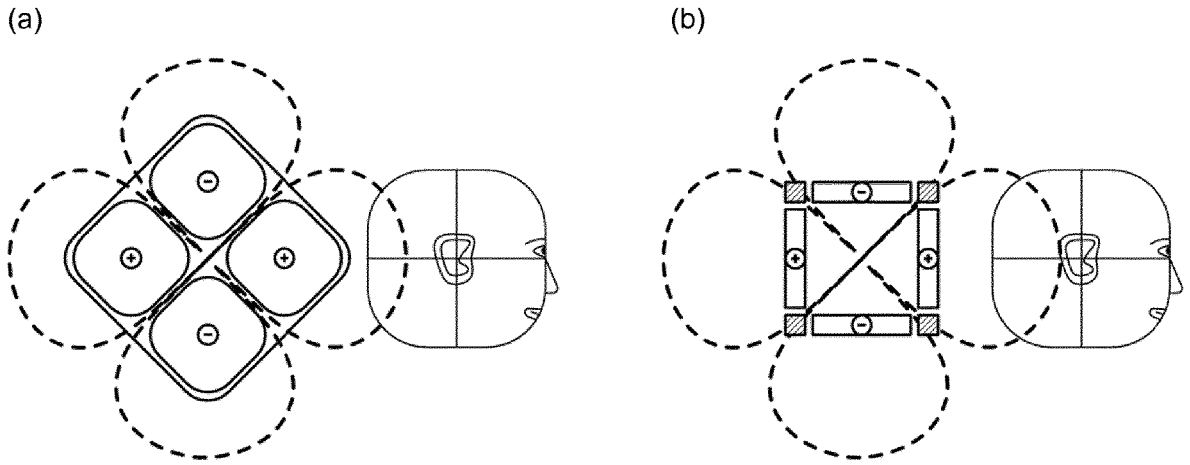
FIGS. 26(*a*)-(*b*) illustrate some preferred listening positions for use with a quadrupole loudspeaker unit formed of four monopole loudspeakers arranged in a 2×2 array, where the electrical signals provided to the drive units configured to move the first subset of diaphragms are out of phase with respect to the electrical signals provided to the one or more drive units configured to move the second subset of diaphragms.

FIGS. 26(*a*)-(*b*) illustrate some preferred listening positions for use with a quadrupole loudspeaker unit formed of four monopole loudspeakers arranged in a 2×2 array, where the electrical signals provided to the drive units configured to move the first subset of diaphragms are out of phase with respect to the electrical signals provided to the one or more drive units configured to move the second subset of diaphragms.

As above, sound produced by a first radiating surface of a diaphragm in the first subset of diaphragms is marked with a '+' and sound produced by a first radiating surface of a diaphragm in the second subset of diaphragms is marked with a '−'.

Since the polar response of an individual monopole loudspeaker is spherical, it is to be noted that the arrangement of FIG. 26(*a*) and that of FIG. 26(*b*) are directly equivalent, though the arrangement shown in FIG. 26(*b*) is preferred because it could more easily be incorporated into a car headrest.

In the arrangements of FIGS. 26(*a*) and 26(*b*), a principal radiating axis of each first radiating surface lies in the same vertical plane when the loudspeaker unit is in use.

Figure 27:
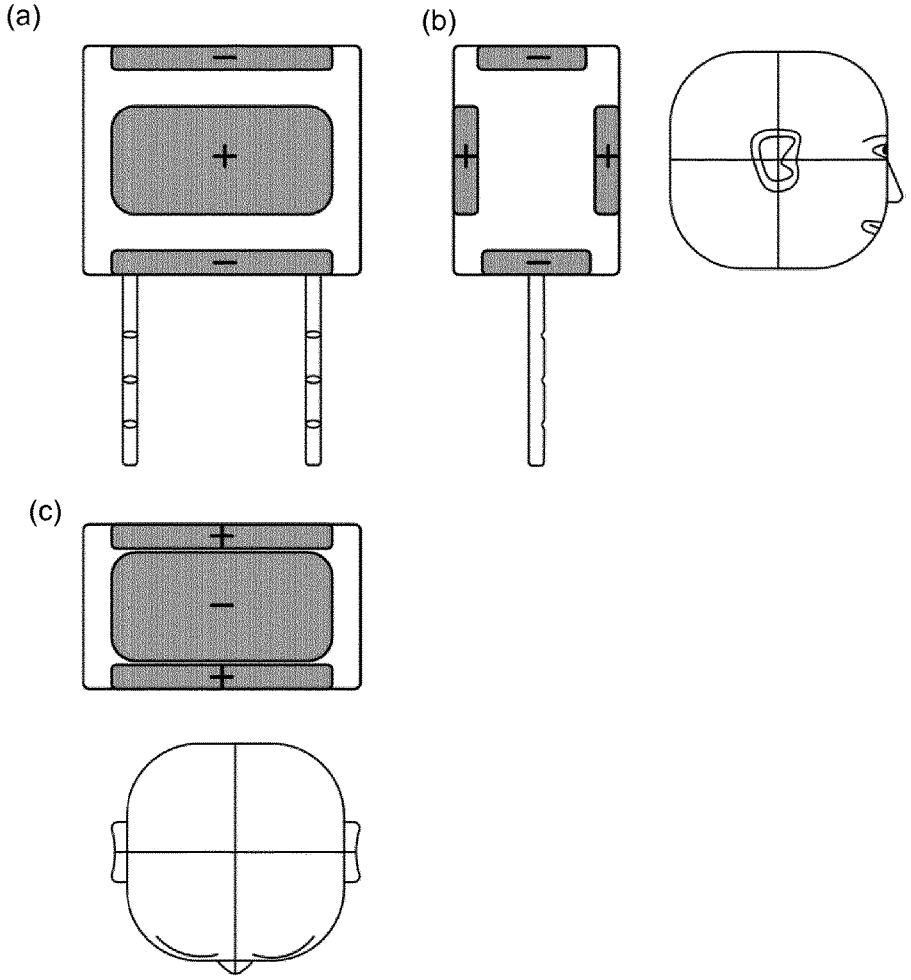
FIGS. 27(*a*)-(*c*) show the diaphragms arranged as shown in FIG. 26(*b*) from various angles.

FIGS. 27(*a*)-(*c*) show the diaphragms arranged as shown in FIG. 26(*b*) from various angles.

Figure 28:
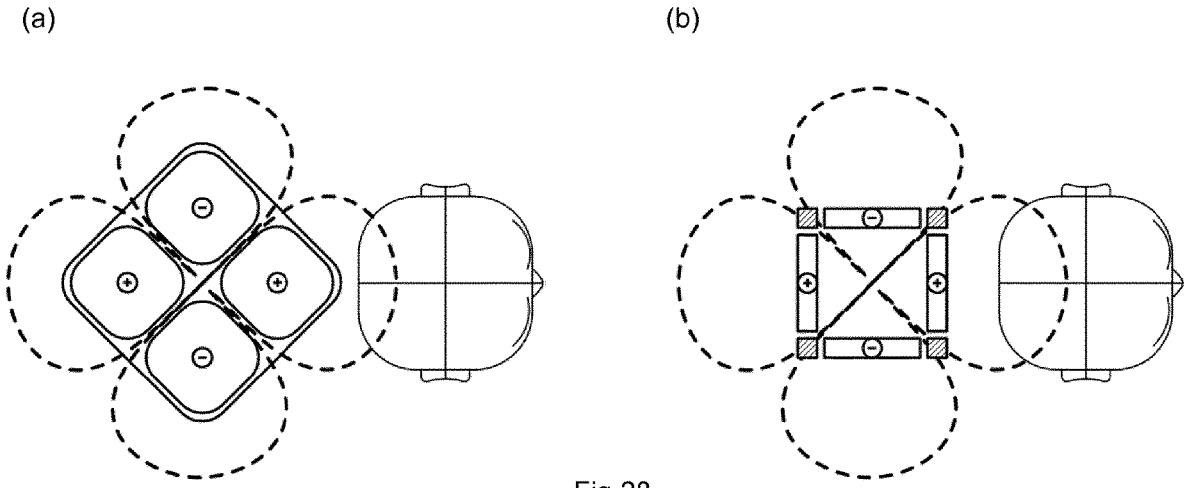
FIGS. 28(*a*)-(*b*) illustrate some less preferred listening positions for use with a quadrupole loudspeaker unit formed of four monopole loudspeakers arranged in a 2×2 array, where the electrical signals provided to the drive units configured to move the first subset of diaphragms are out of phase with respect to the electrical signals provided to the one or more drive units configured to move the second subset of diaphragms.

FIGS. 28(*a*)-(*b*) illustrate some less preferred listening positions for use with a quadrupole loudspeaker unit formed of four monopole loudspeakers arranged in a 2×2 array, where the electrical signals provided to the drive units configured to move the first subset of diaphragms are out of phase with respect to the electrical signals provided to the one or more drive units configured to move the second subset of diaphragms.

As above, sound produced by a first radiating surface of a diaphragm in the first subset of diaphragms is marked with a '+' and sound produced by a first radiating surface of a diaphragm in the second subset of diaphragms is marked with a '−'.

Again, since the polar response of an individual monopole loudspeaker is spherical, it is to be noted that the arrangement of FIG. 28(*a*) and that of FIG. 28(*b*) are directly equivalent, though the arrangement shown in FIG. 28(*b*) is preferred because it could more easily be incorporated into a car headrest.

However, the arrangement shown in FIG. 28(*b*) is nonetheless less preferred to that shown in FIG. 26(*b*), since the ears of a user are closer to nulls in the arrangement of FIG. 28(*b*) compared with the arrangement of FIG. 26(*b*).

In the arrangements of FIGS. 26(*a*) and 26(*b*), a principal radiating axis of each first radiating surface lies in the same horizontal plane when the loudspeaker unit is in use.

Figure 29:
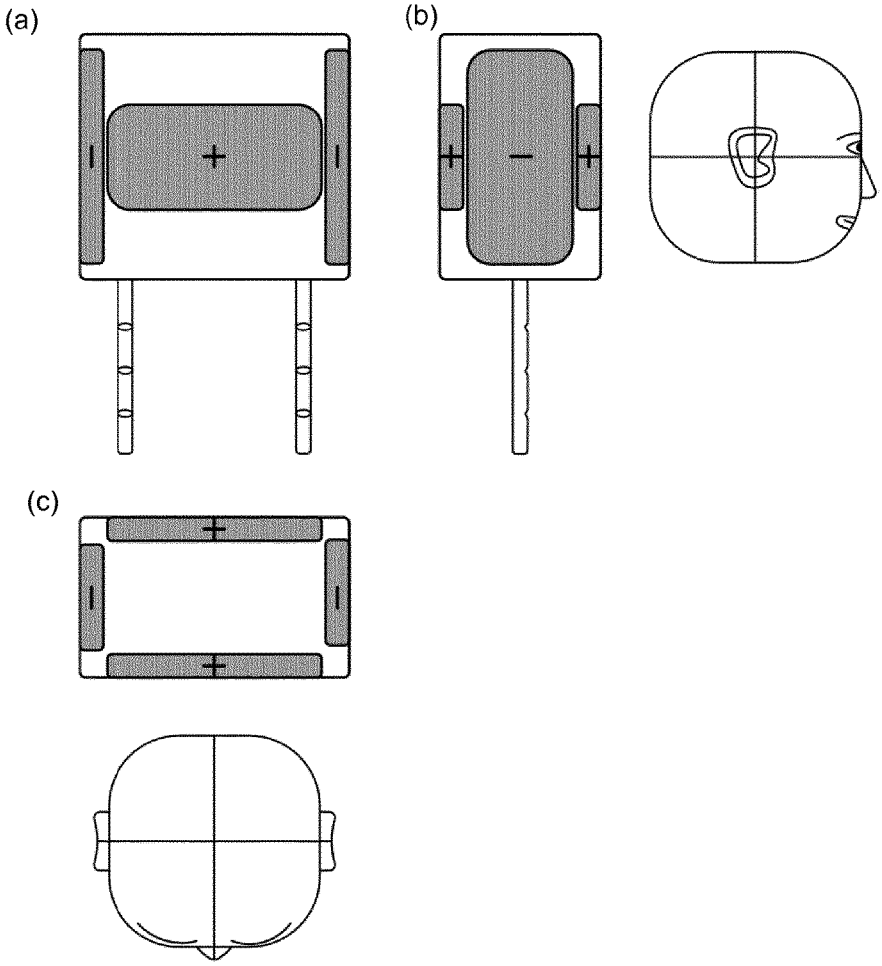
FIGS. 29(*a*)-(*c*) show the diaphragms arranged as shown in FIG. 28(*b*) from various angles.

FIGS. 29(*a*)-(*c*) show the diaphragms arranged as shown in FIG. 28(*b*) from various angles.

Examples which implement the principles of the loudspeaker unit 201 of FIG. 24 will now be described, with alike reference numerals indicating corresponding features that do not need to be described further, except where further explanation is provided.

Figure 30:
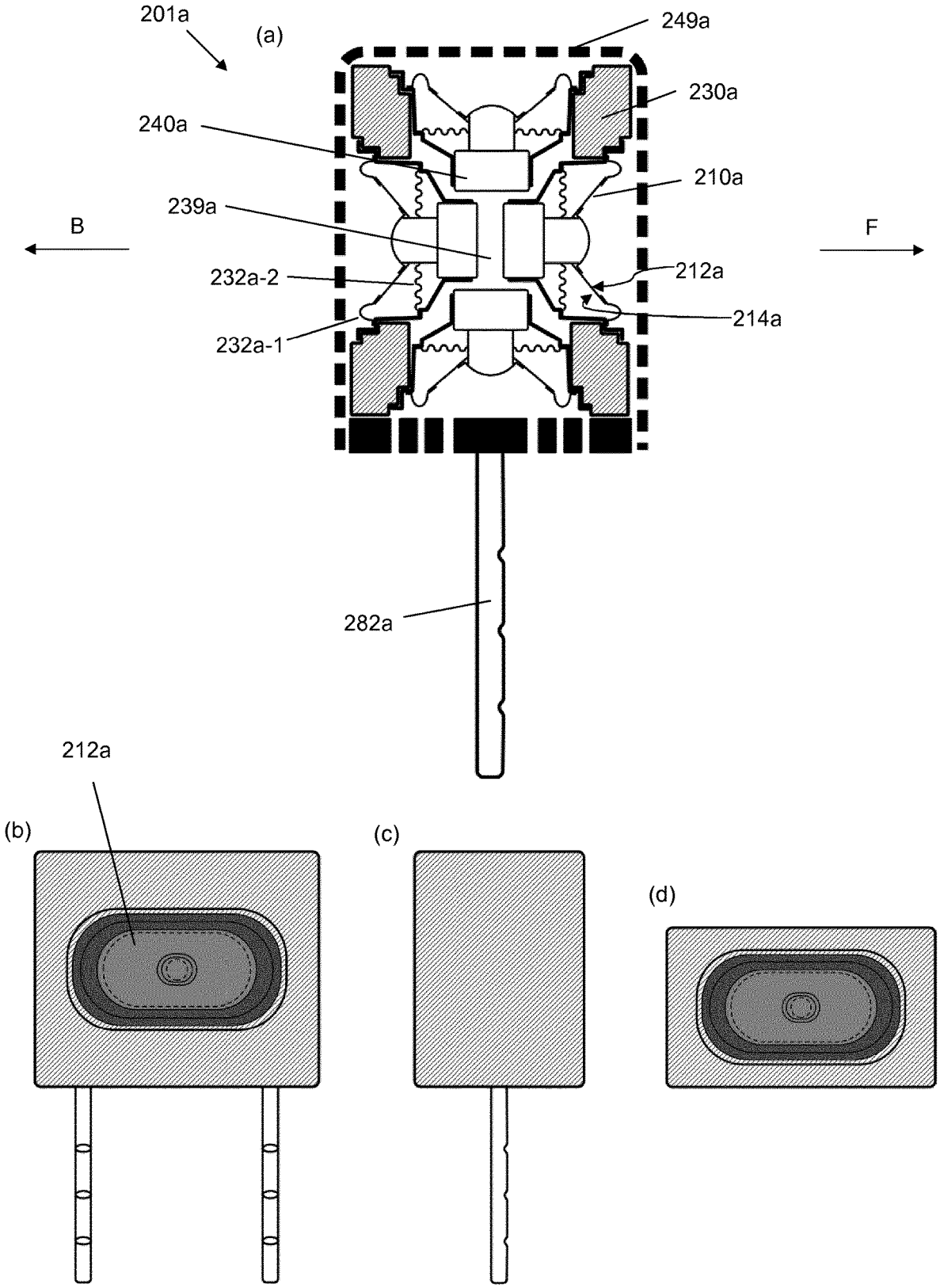
FIGS. 30(*a*)-(*d*) show a first example loudspeaker unit 201*a* which implements the loudspeaker unit 201 of FIG. 24 in a car headrest.

FIGS. 30(*a*)-(*d*) show a first example loudspeaker unit 201*a* which implements the loudspeaker unit 201 of FIG. 24 in a car headrest.

In this example, there are four diaphragms 210*a* arranged in the preferred manner depicted in FIG. 26(*b*), i.e. with a principal radiating axis of each first radiating surface 212*a* lying in the same vertical plane when the loudspeaker unit is in use. A principal radiating axis of each first radiating surface 212*a* further points outwardly from a central space 239*a*.

A sealed enclosure is provided by walls of the frame 230*a* and which encloses the central space 239*a* is configured to receive sound produced by the second radiating surfaces 214*a*.

In this example, each diaphragm 210*a* is a cone diaphragm, wherein a concave surface of each cone provides a respective first radiating surface 212*a*. Each diaphragm is suspended from the frame 230*a* via respective suspension elements which include for each loudspeaker a roll suspension 232*a*-1 and a spider 232*a*-2.

Each drive unit 240*a* configured to move a respective diaphragm 210*a* is a conventional electromagnetic drive unit.

An acoustically transparent grill 249*a* fixedly attached the frame 234*a*, in order to provide support for an acoustically transparent covering material.

The headrest is covered by an acoustically transparent material, which has been omitted from FIGS. 30(*a*)-(*d*) so that the diaphragms can be viewed on the front of the headrest (FIG. 30(*b*)) and the top of the headrest (FIG. 30(*d*)).

The loudspeaker unit 201*a* is configured to be fixedly mounted to a car seat frame via mounting pins 282*a*.

Figure 31:
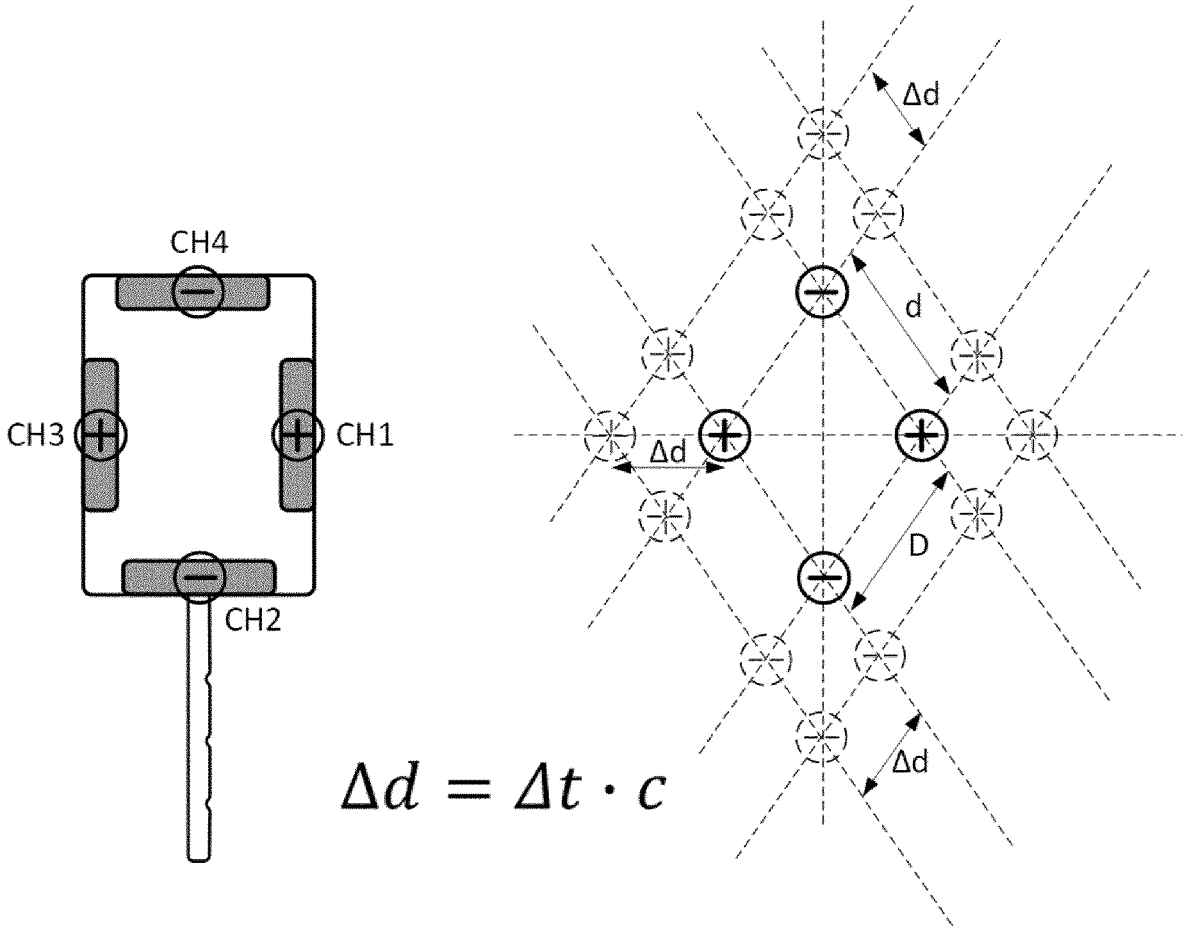
FIG. 31 illustrates effects of applying a delay Δt to a signal from a selected electrical signal supplied to one of the drive units.

FIG. 31 illustrates how, by applying a delay Δt to a signal from a selected electrical signal supplied to one of the drive units (these signals are referred to as channels CH1-CH4 in FIG. 31) causes the selected diaphragm 210*a* to be virtually moved by a distance Δd further away from a reference diaphragm 210*a* having no delay (Δt=0).

The distance by which a diaphragm is virtually moved can theoretically be represented by the following relation:

$$\Delta d = \Delta t \cdot c \tag{4}$$

Where c is the speed of sound.

However, it is to be noted that applying such a delay Δt will in general worsen the level of cocooning provided by the loudspeaker unit 201*a* and may also diminish force cancelling and therefore cause vibrations to propagate out into the environment via the frame 230*a*.

Figure 32:
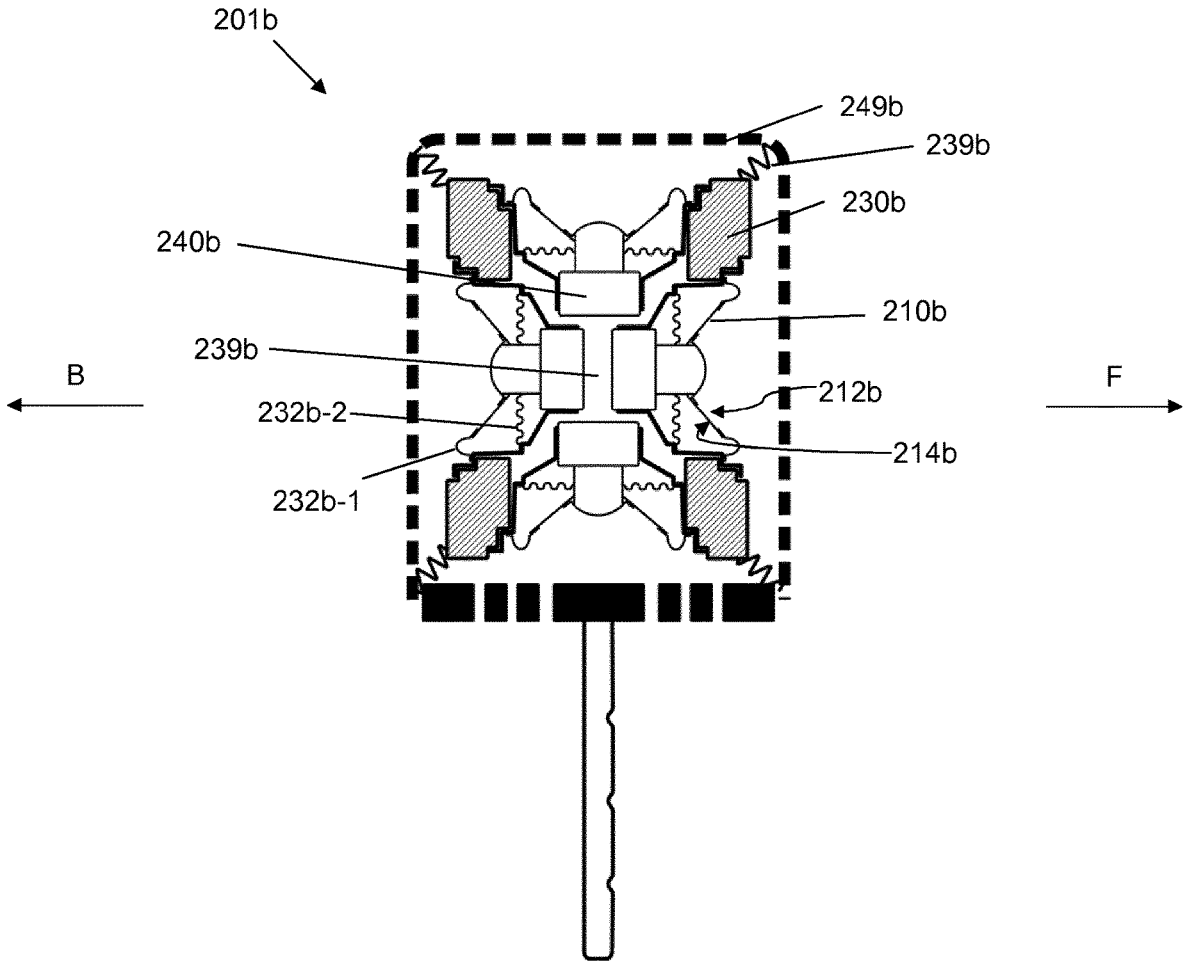
FIG. 32 shows a second example loudspeaker unit 201*b* which implements the loudspeaker unit 201 of FIG. 24 in a car headrest.

FIG. 32 shows a second example loudspeaker unit 201*b* which implements the loudspeaker unit 201 of FIG. 24 in a car headrest.

In this example, the frame 234*b* is suspended from the acoustically transparent grill 249*b* by suspension elements 239*b* provided in this case in the form of an elastic suspension.

So in this example, the transparent grill 249*b* provides a secondary frame and the frame 234*b* provides a primary frame, wherein the diaphragms 210*b* are suspended from the primary frame 234*b* by primary suspension elements 232*b*-1, 232*b*-2, and the primary frame 23*b* is suspended from the secondary frame 249*b* by secondary suspension elements 239*b*.

This dual frame configuration may be useful to reduce vibrations passing from the loudspeaker unit 201*b* into the environment. This may be useful e.g. if adding a delay between channels of equal polarity as proposed with reference to FIG. 31 causes diminished force cancelling.

In view of the above discussion, some advantages of the monopole type implementations described with reference to FIGS. 24-31 can be understood:

With 4 equal diaphragms 210*a* the complete assembly is "vibration free" since the inertial forces from the mass of the diaphragms 210*a* cancel each other. There is also no pressure build-up inside the enclosure. Whereas dipole loudspeakers in quadrupole configuration (as described e.g. with reference to FIGS. 21-22 will not completely cancel their forces and will instead create a momentum based on the distance the diaphragms are located from each other.

The back of the loudspeakers are sealed so that motor noises (e.g. blowing noises from compressed air thru the magnet gap) are better sealed compared to the dipole type implementation implementations described with reference to FIGS. 8-23

Delay flexibility: with individual monopole loudspeakers being used, the dimensions D, d of our dipole-pair and quadrupole-pair as depicted in FIG. 31 are easily adjusted both mechanically (by moving the monopole loudspeakers) and by using a delay as described above with reference to FIG. 31. Whereas with a quadrupole loudspeaker unit that uses dipole loudspeakers as described with reference to FIGS. 8-23, the dimension D, is defined by the dimensions of the diaphragm and cannot be altered using a delay. Only on the quadrupole pair (distance d) and on the octopole pair (distance d') can we usefully apply delay.

A dipole path length D of 10 cm using a dipole loudspeaker would imply a diaphragm with a 20 cm diameter and may be much too large for practical implementation in a slim headrest (especially if two such diaphragms are required), while with a loudspeaker unit that incorporates monopole loudspeakers a distance of 10 cm for the first dipole pair can easily be achieved whilst maintaining a compact headrest size. Note that we have seen previously that the pressure of our quadrupole is directly proportional with pathlength D and pathlength d.

Vibration can easily be introduced on purpose, e.g. for signaling features.

Examples Implementing Third Aspect of the Invention

Figure 33:
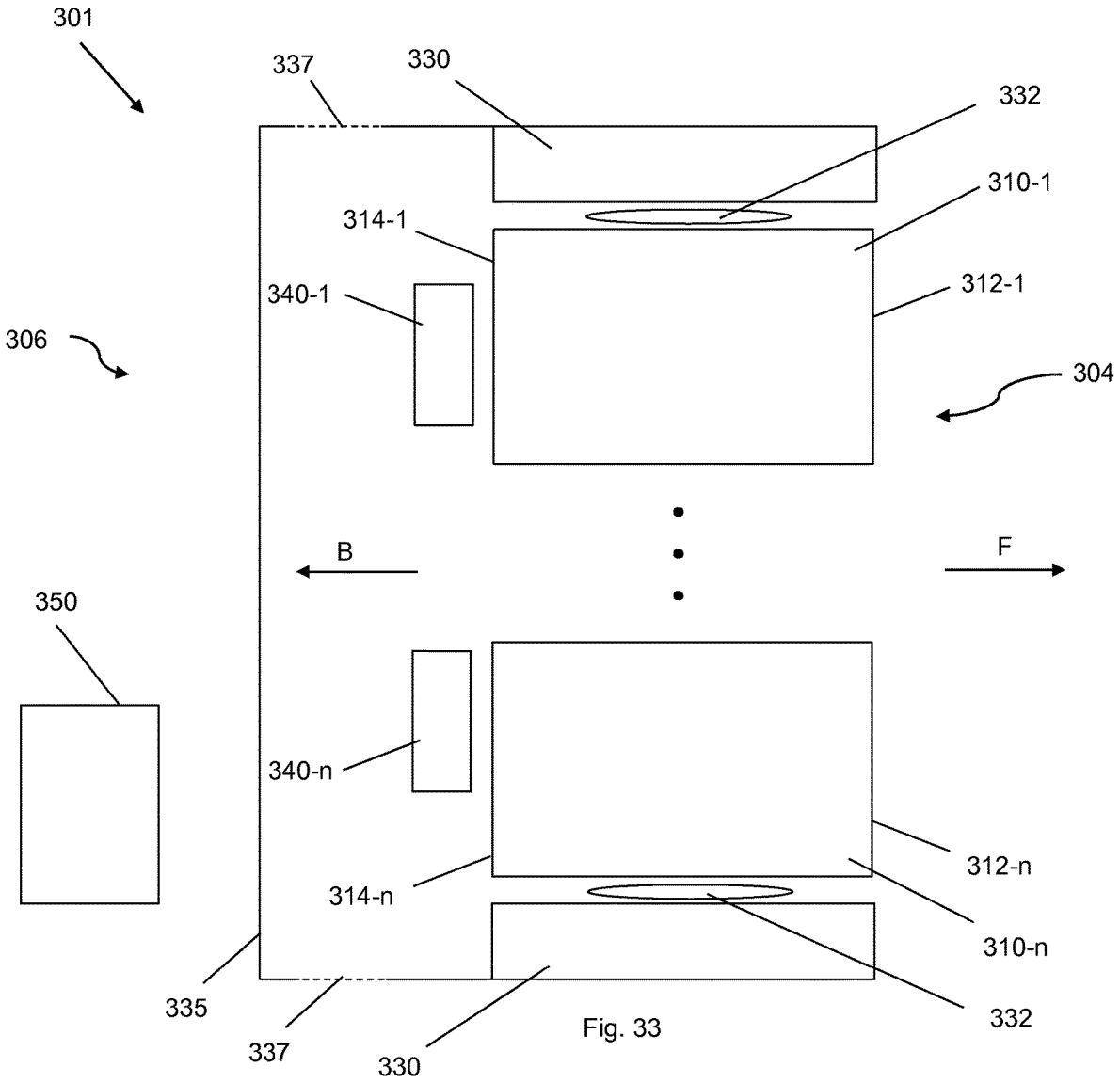
FIG. 33 is a schematic view of a loudspeaker unit 301 for producing sound at bass frequencies according to the third aspect of the invention.

FIG. 33 is a schematic view of a loudspeaker unit 301 for producing sound at bass frequencies according to the third aspect of the invention.

The loudspeaker unit 301 includes an array of n diaphragms 310 (features relating to an individual diaphragm are labelled with the suffix "−1", . . . "−n"). Each diaphragm has a first radiating surface 312, and a second radiating surface 314, wherein the first radiating surface 312 and the second radiating surface 314 are located on opposite faces of the diaphragm.

The loudspeaker unit 301 also includes a frame 330, wherein each diaphragm 310 in the array is suspended from the frame 330 via one or more suspension elements 332 such that sound produced by the first radiating surfaces 312 is allowed to propagate out from the loudspeaker unit 301.

As depicted in FIG. 33, that the first radiating surfaces 312 are facing in a first ("forwards") direction F and the second radiating surfaces 314 are facing in an opposite ("backwards") second direction B with the frame 130 being configured to allow sound produced by the first radiating surfaces 212 to propagate out from a first side 304 of the loudspeaker unit 301 in the first direction F. However, this is only schematic, and for reasons that can be understood from explanations elsewhere in this disclosure, other orientations are possible (and indeed preferred).

The loudspeaker unit 301 also includes a plurality of drive units 340, wherein each drive unit 340 is configured to move a respective one of the diaphragms 310 in the array based on a respective electric signal.

The loudspeaker unit 301 also includes at least one enclosure 335 configured to receive sound produced by the second radiating surfaces 314. As depicted in FIG. 33, there is a single enclosure 335 configured to receive sound produced by all the second radiating surfaces 314. The enclosure includes a plurality of vents 337, wherein each vent is configured to allow sound produced by the second radiating surface to propagate out from the loudspeaker unit in a different direction. Other enclosure/vent arrangements are possible.

It is important to note that the vents 337 do not serve as traditional "bass reflex" vents to extend the low frequency performance of the loudspeaker unit 301 based on creating a Helmholtz resonator tuned at a low frequency for increasing the bass output at that tuning frequency. Here, since the volume is small and the vent 337 opening large, the tuning frequency of those openings will be high compared to the low frequencies we are addressing in this application. Basically, it is neither intended nor desirable to use the Helmholtz resonance phenomenon. The vents 337 are instead used to provide a means by which air can be emitted from the enclosure whilst being out of phase and thus creating the other pole at the exit of the vent 337.

Thus, each vent 337 is preferably open enough such that any Helmholtz resonator provided by the enclosure has a tuning frequency that is above 200 Hz, more preferably above 400 Hz. The size of each vent required to achieve this will depend on various factors such as the size of the enclosure, and neck length leading to each vent. The principles of Helmholtz resonators are well known by the skilled person and do not require further description herein.

The loudspeaker unit 301 also includes drive circuitry 350 configured to provide each drive unit 340 with a respective electrical signal derived from the same audio source such that the sound produced by the second radiating surfaces 314 is out of phase with respect to the sound produced by the first radiating surfaces 312.

Figure 34A:
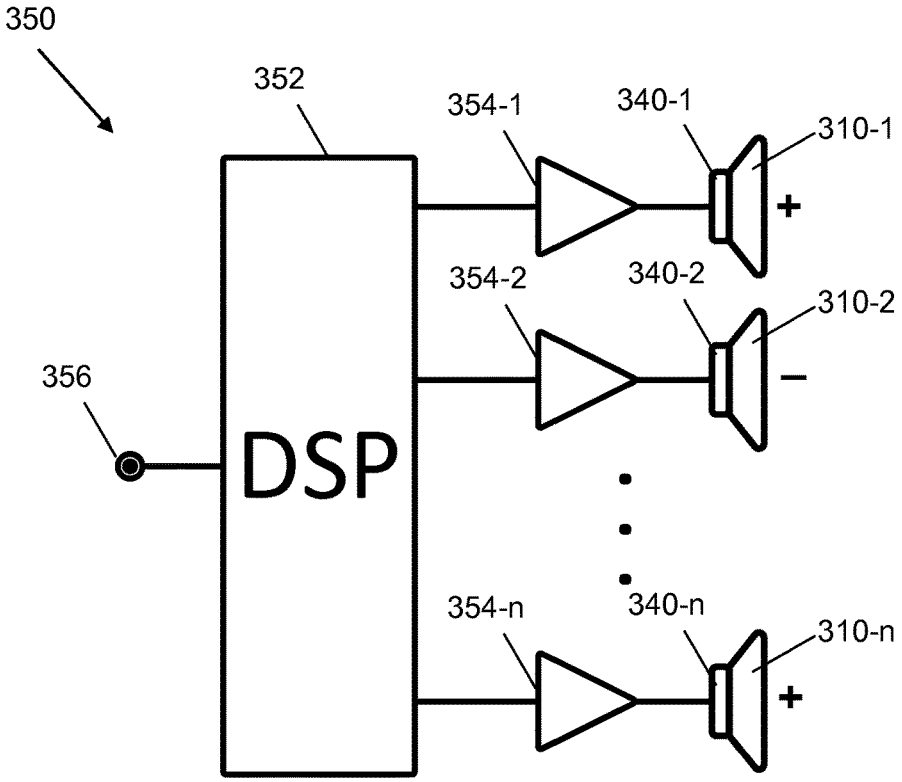
FIGS. 34(*a*) and 34(*b*) each show an example of drive circuitry 350, 350' which may be included in the loudspeaker 301 of FIG. 33.
Figure 34B:
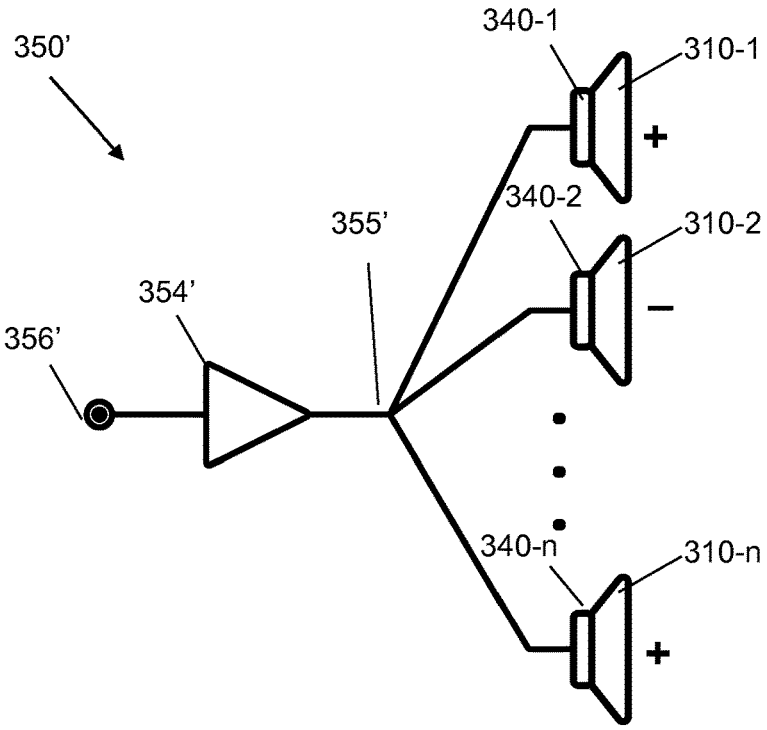

FIGS. 34(*a*) and 34(*b*) each show an example of drive circuitry 350, 350' which may be included in the loudspeaker 301 of FIG. 33 and be configured to provide each drive unit 340 of the loudspeaker unit 301 of FIG. 33 with a respective electrical signal derived from the same audio source such that the sound produced by the second radiating surfaces 314 is out of phase with respect to the sound produced by the first radiating surfaces 312.

The example drive circuitry 350 of FIG. 34(*a*) includes a digital signal processor ("DSP") 352 configured to provide each drive unit 340 with a respective electrical signal via a respective amplifier 354, wherein the respective electrical signal is derived from an audio signal (in this case a digital audio signal) provided by the audio source at node 356. No manipulation of the electrical signals by the DSP 352 is required in order for the drive circuitry 350 to provide each drive unit 340 with a respective electrical signal derived from the same audio source such that the sound produced by the second radiating surfaces 314 is out of phase with respect to the sound produced by the first radiating surfaces 312. However, a DSP 352 is nonetheless preferred, since modification of the electrical signals provided to the drive units 340 e.g. to modify the phase, delay or amplitude of the electrical signal respectively provided to each drive unit 140 so as to optimise the sound provided to a user (e.g. in a manner described herein).

The example drive circuitry 350' of FIG. 9(*b*) includes an amplifier 354' and wiring 355' configured to maintain the polarity of the electrical signal(s) provided to the/each drive unit 340, e.g. with + and − wires supplying an audio signal provided by the audio source 356' via the amplifier 354' being connected to the/each drive unit 340 the same way around (unlike the situation in FIG. 9(*b*) where the wiring was used to reverse the polarity of electric signals provided to drive units configured to move a certain subset of diaphragms).

The following drawings and corresponding discussion sets out some guiding principles for how the loudspeaker unit 301 of FIG. 33 could be implemented in a car headrest.

Figure 35:
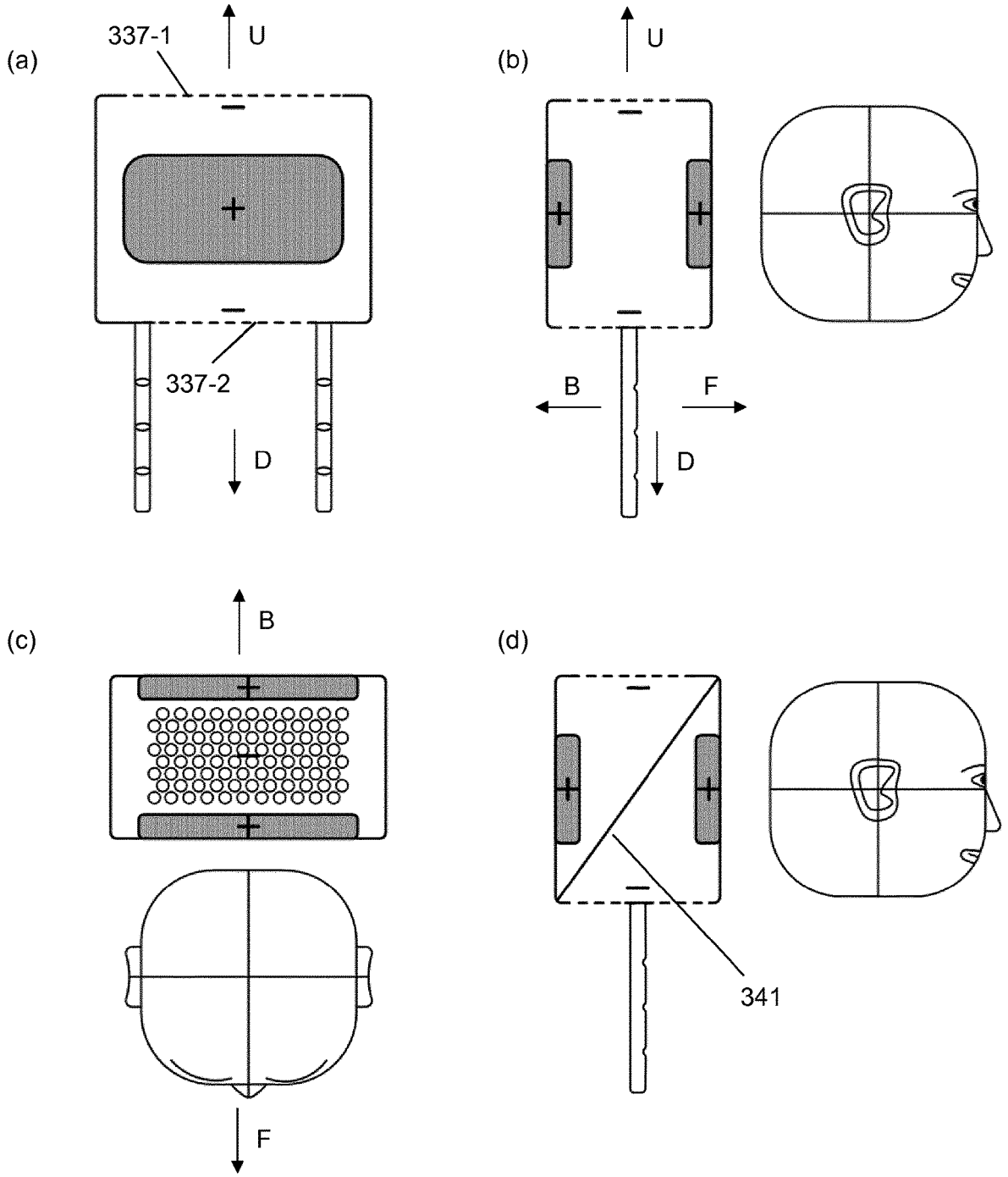
FIGS. 35(*a*)-(*d*) illustrate a preferred listening position for use with a headrest that incorporates loudspeaker unit formed of two monopole loudspeakers arranged back to back.

FIGS. 35(*a*)-(*c*) illustrate a preferred listening position for use with a headrest that incorporates loudspeaker unit formed of two monopole loudspeakers arranged back to back, in this case with the diaphragm of one of the monopole loudspeakers having a first radiating surface that faces in a forwards direction F and with the diaphragm of the other monopole loudspeaker having a first radiating surface that faces in a backwards direction B. A first vent 337-1 is configured to allow sound to propagate out from the loudspeaker unit in an upwards direction U, and a second vent 337-2 configured to allow sound to propagate out from the loudspeaker unit in a downwards direction D.

As can be seen from FIG. 35(*c*), in this example each vent 337 takes the form of a plurality of holes.

In the example shown in FIGS. 35(*a*)-(*c*), the volume displacement of the second radiating surface of each of the two loudspeakers is directed towards the vents 337-1, 337-2. In this way antiphase sound is created at the vents 337-1, 337-2, without the need for another pair of monopole loudspeakers.

FIG. 35(*d*) shows a variant of the headrest, wherein the enclosure of the loudspeaker unit includes a partition configured to direct sound produced by the second radiating surface of each diaphragm out of a respective one of the vents 337-1, 337-2.

It is to be noted that the examples shown in FIGS. 35(*a*)-(*d*) achieve force cancellation similar to that achieved by the loudspeaker described in connection with examples of the second aspect of the invention discussed above, but with fewer loudspeakers.

A delay could be implemented between the two loudspeakers to increase the virtual distance between the poles, e.g. as described above with reference to FIG. 31.

Examples which implement the principles of the loudspeaker unit 301 of FIG. 33 will now be described, with alike reference numerals indicating corresponding features that do not need to be described further, except where further explanation is provided.

Figure 36:
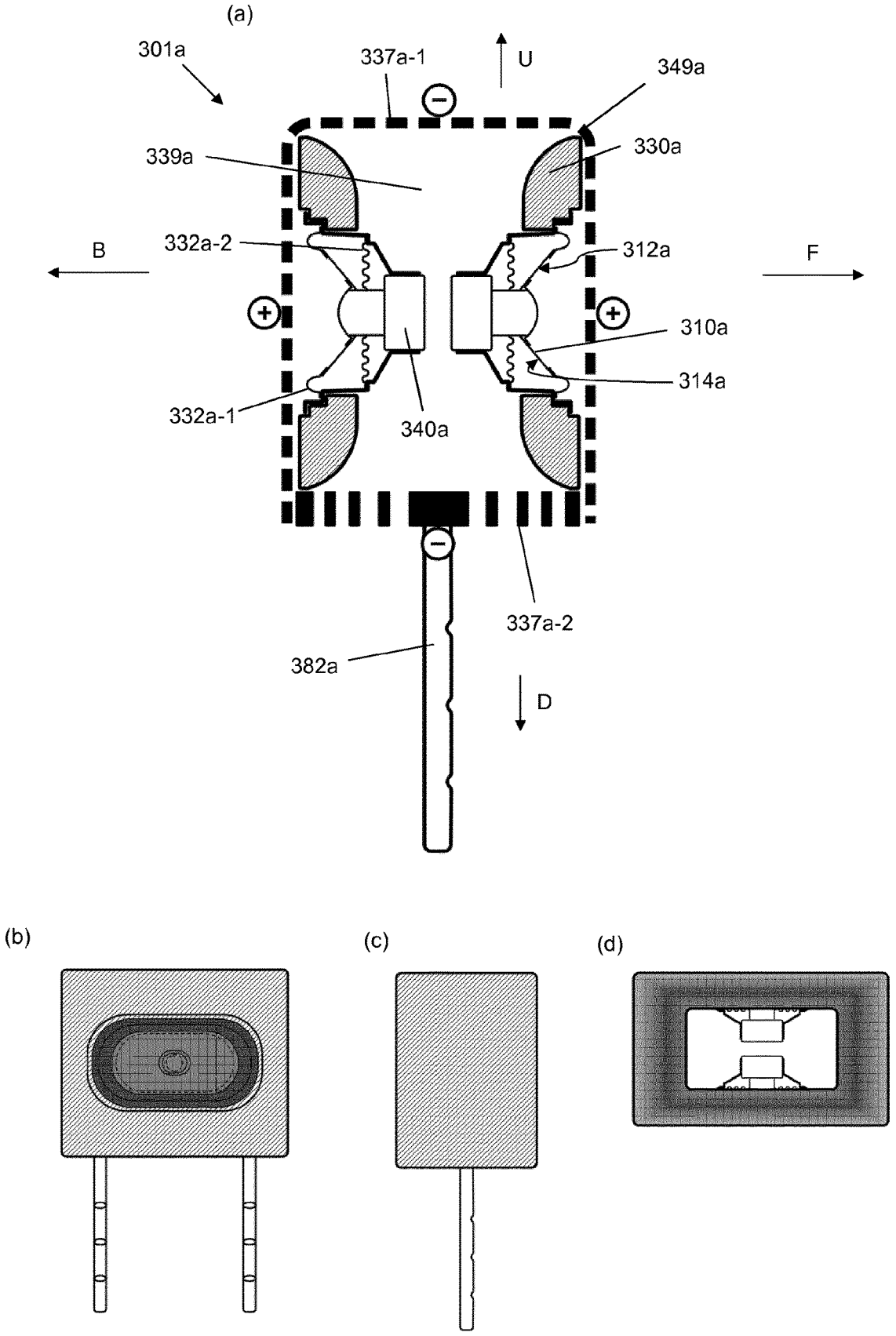
FIGS. 36(*a*)-(*d*) show a first example loudspeaker unit 301*a* which implements the loudspeaker unit 301 of FIG. 33 in a car headrest.

FIGS. 36(*a*)-(*d*) show a first example loudspeaker unit 301*a* which implements the loudspeaker unit 301 of FIG. 33 in a car headrest.

In this example, there are two diaphragms 310*a* arranged in the manner depicted in FIG. 35, i.e. arranged back to back, with one diaphragm 310*a* having a first radiating surface 312*a* that faces in a forwards direction F and with the other diaphragm 310*a* having a first radiating surface 312*a* that faces in a backwards direction B.

An enclosure which is provided by walls of the frame 330*a* and which encloses the central space 339*a* is configured to receive sound produced by the second radiating surfaces 314*a*. A first vent 337*a*-1 included in the enclosure is configured to allow sound to propagate out from the loudspeaker unit in an upwards direction U, and a second vent 337*a*-2 included in the enclosure is configured to allow sound to propagate out from the loudspeaker unit in a downwards direction D.

In this example, each diaphragm 310*a* is a cone diaphragm, wherein a concave surface of each cone provides a respective first radiating surface 312*a*. Each diaphragm is suspended from the frame 330*a* via respective suspension elements which include for each loudspeaker a roll suspension 332*a*-1 and a spider 332*a*-2.

Each drive unit 340*a* configured to move a respective diaphragm 310*a* is a conventional electromagnetic drive unit.

An acoustically transparent grill 349*a* fixedly attached the frame 334*a*, in order to provide support for an acoustically transparent covering material.

The headrest is covered by an acoustically transparent material, which has been omitted from FIGS. 36(*a*)-(*d*) so that the diaphragm can be viewed on the front of the headrest (FIG. 30(*b*)) and so that the vent can be viewed on the top of the headrest (FIG. 30(*d*)).

The loudspeaker unit 301*a* is configured to be fixedly mounted to a car seat frame via mounting pins 382*a*.

Note that the enclosure is essentially open on top and bottom, thus the pressure inside the enclosure (which is out of phase with that of the front side of the two loudspeakers) will create out of phase sources via the top and bottom vents.

Figure 37:
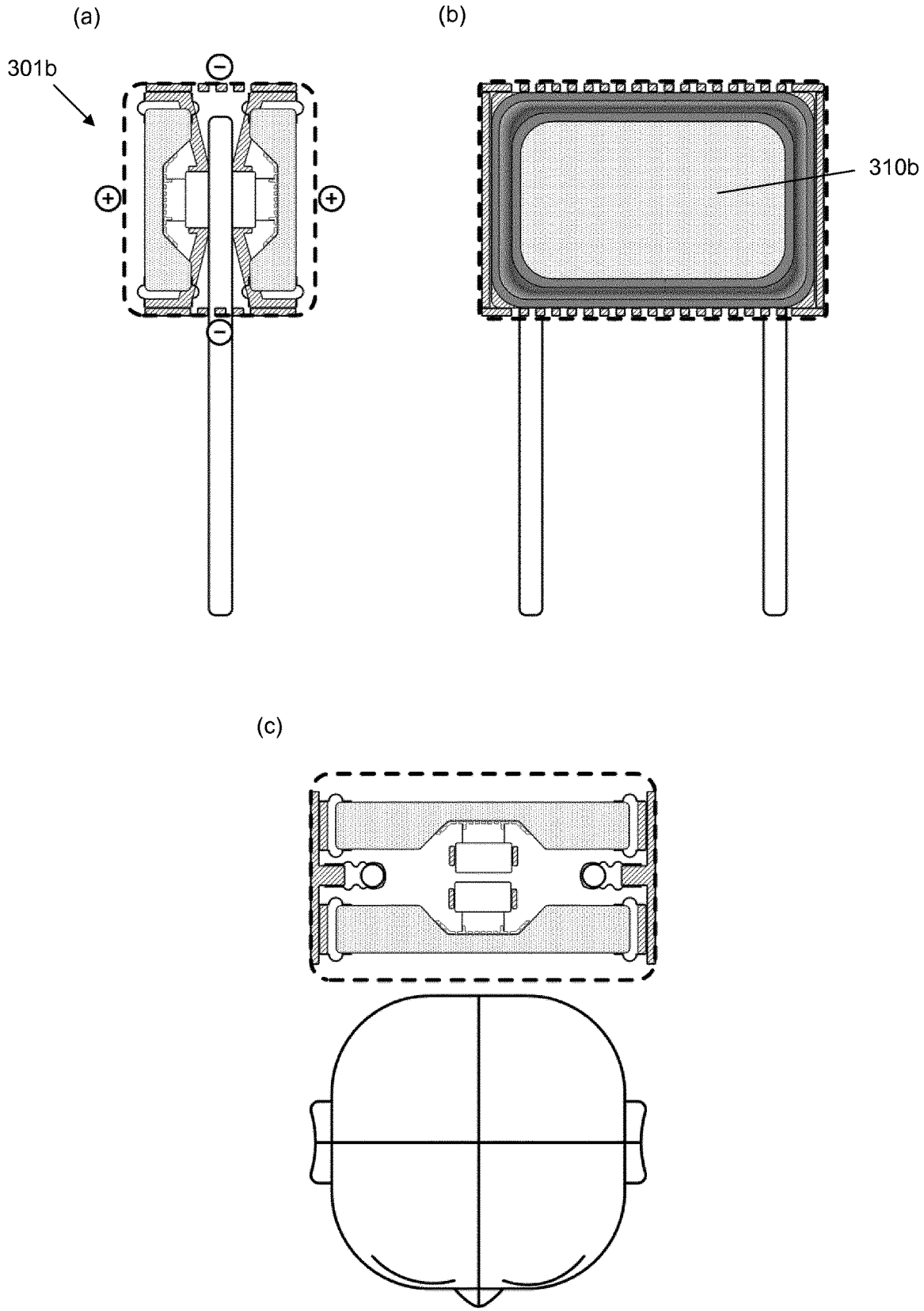
FIGS. 37(*a*)-(*c*) show a second example loudspeaker unit 301*b* which implements the loudspeaker unit 301 of FIG. 33 in a car headrest.

FIGS. 37(*a*)-(*c*) show a second example loudspeaker unit 301*b* which implements the loudspeaker unit 301 of FIG. 33 in a car headrest.

In this example, the radiating surfaces of the loudspeakers have been maximised, and the volume enclosed by the enclosure minimised, Here, the diaphragm is made of extruded polypropylene which may act as a safety element configured to prevent the magnet unit(s) from passing through the diaphragm in a crash event.

Figure 38:
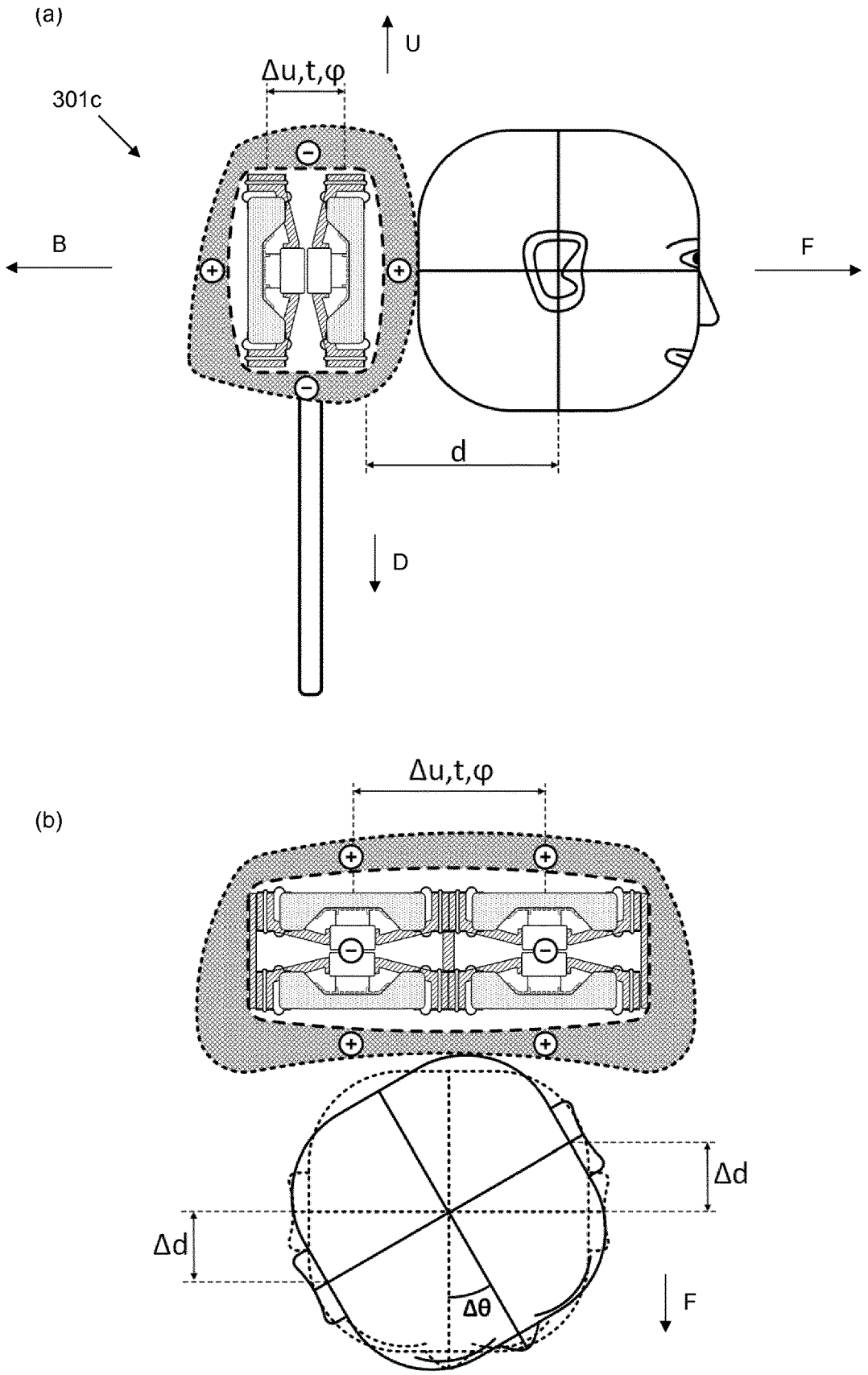
FIGS. 38(*a*)-(*b*) show a third example loudspeaker unit 301*c* which implements the loudspeaker unit 301 of FIG. 33 in a car headrest.

FIGS. 38(*a*)-(*b*) show a third example loudspeaker unit 301*c* which implements the loudspeaker unit 301 of FIG. 33 in a car headrest.

In this example, the loudspeaker unit 301*c* includes two pairs of diaphragms, with one of the diaphragms included in each pair having a first radiating surface that faces in the forward direction F, and with the other of the diaphragms included in each pair having a first radiating surface that faces in the backwards direction B. A first vent is configured to allow sound to propagate out from the loudspeaker unit in an upwards direction U, and a second vent is configured to allow sound to propagate out from the loudspeaker unit in a downwards direction D.

This may be useful e.g. to provide stereo sound to the different ears of a user or alternatively to compensate for movement of a user's head (as will now be described).

Preferably, a seat assembly that includes the car headrest also includes a head tracking unit (not shown) configured to track head movement of a user sat in the seat.

For the purposes of this description, the two diaphragms whose first radiating surfaces face in the forwards direction F are referred to as "forward facing diaphragms".

Preferably, the DSP 352 in the drive circuitry 350 is configured to modify the electrical signals provided to the drive units configured to move the forward facing diaphragms based on head movement as tracked by the head tracking unit so as to compensate for movement of the head of a user sat in the seat.

Compensation for head movement may involve adjusting any one or more of amplitude (u), delay (t) and phase ($\phi$) according suitable algorithms.

In a simple example, the DSP 352 in the drive circuitry 350 may be configured to increase the amplitude of sound produced by one of the forward facing diaphragms if it is determined based on head movement as tracked by the head tracking unit that an ear of the user has moved further away from the first radiating surface of that diaphragm (e.g. by distance $\Delta d$ as shown in FIG. 38(*b*)). Similarly, the drive circuitry may be configured to decrease the amplitude of sound produced by one of forward facing diaphragms if it is determined based on head movement as tracked by the head tracking unit that an ear of the user has moved closer to the first radiating surface of that diaphragm (e.g. by distance Δd as shown in FIG. 38(*b*)). The amount by which the amplitude of sound is increased/decreased may depend on the distance by which the relevant ear has moved (e.g. distance Δd as shown in FIG. 38(*b*)).

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

Experimental Data

Experimental Data 1

Figure 39:
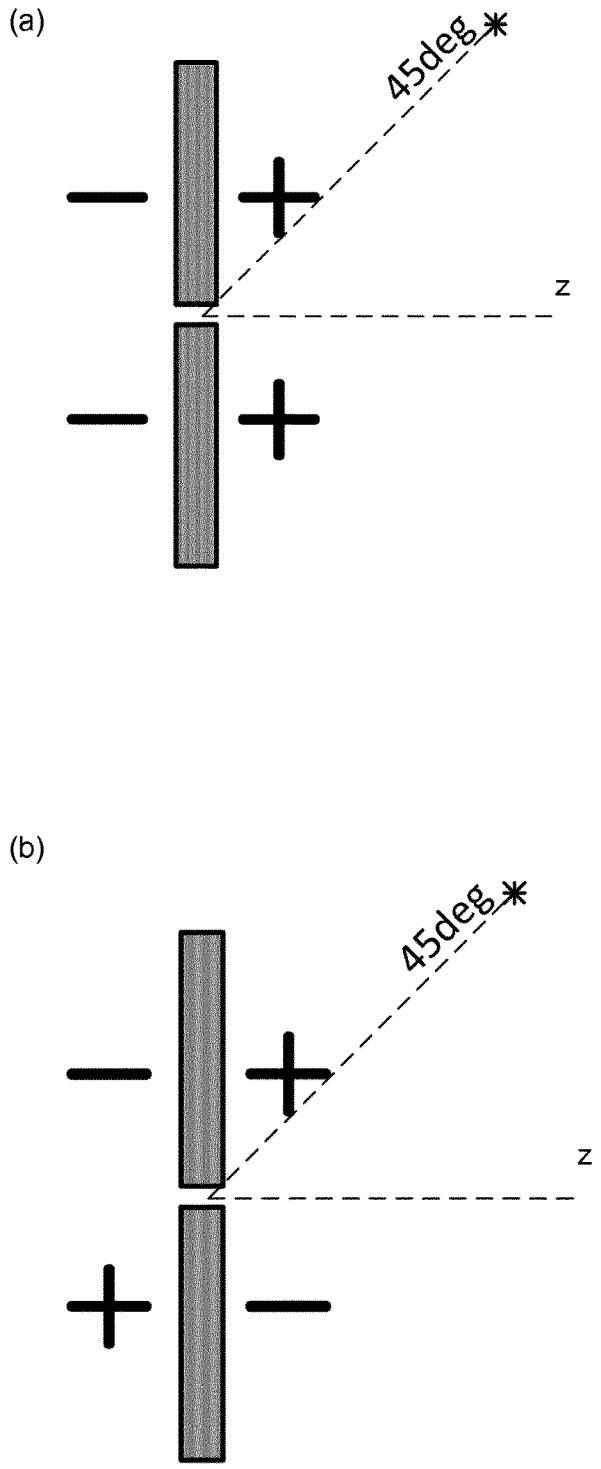
FIGS. 39(*a*)-(*b*) illustrate an experimental set up used to obtain experimental data 1.

FIGS. 39(*a*)-(*b*) illustrate an experimental set up used to obtain experimental data 1.

Figure 40:
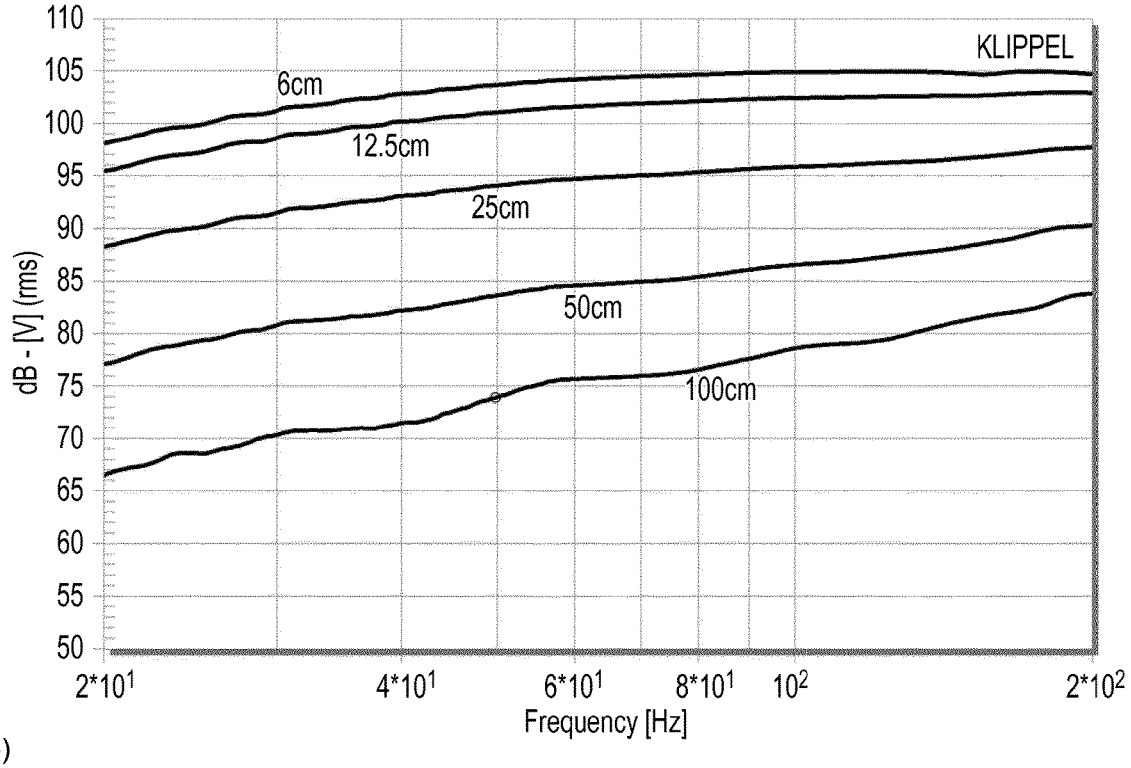
FIGS. 40(*a*)-(*b*) illustrate experimental data 1 obtained using the experimental set up of FIGS. 33(*a*)-(*b*).
Figure 40:
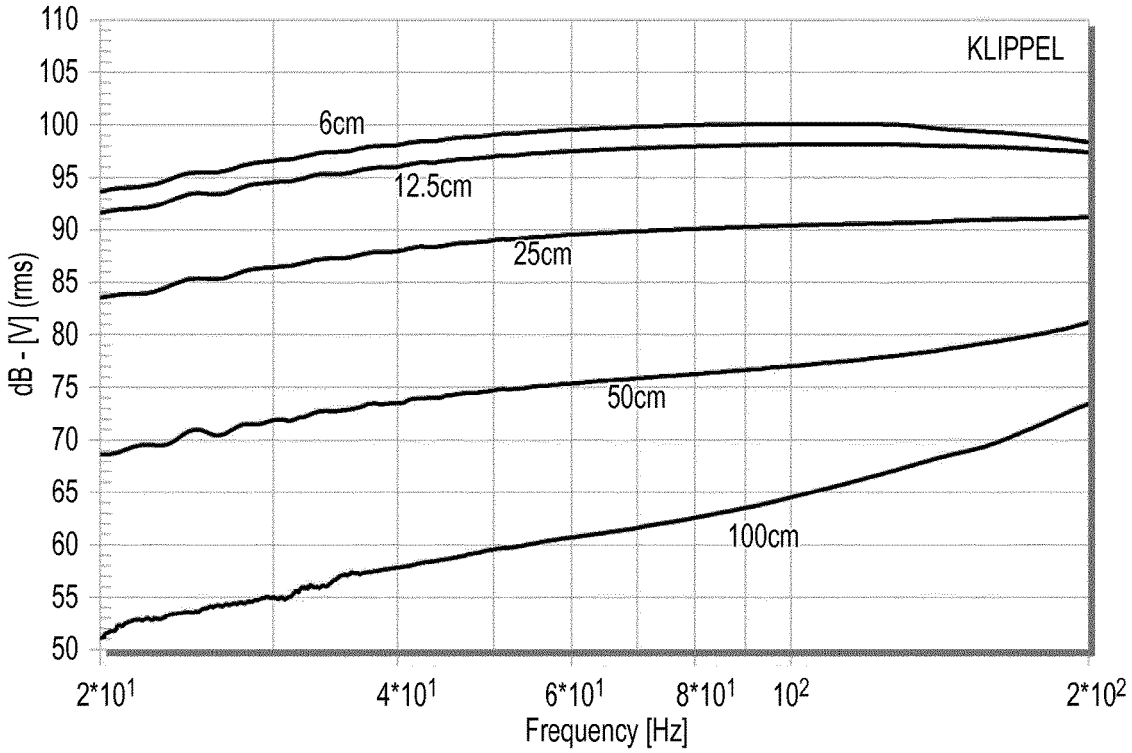

FIGS. 40(*a*)-(*b*) illustrate experimental data 1 obtained using the experimental set up of FIGS. 39(*a*)-(*b*).

Experiments were performed to test the performance of a loudspeaker unit according to the first aspect of the invention.

These experiments were performed using a loudspeaker unit in which two diaphragms were used as dipole loudspeakers and moved by a drive units that were supplied with electrical signals that were either the same (case 1=dipole mode) or in antiphase (case 2: quadrupole mode).

Each diaphragm used had a size of 20 cm×27 cm, making a total surface area of 540 $cm^2$, and fed with an electrical signal having a power of 1 W.

The arrangement of the diaphragms is shown in FIG. 39(*a*) for case 1 where the electrical signals were in phase, and in FIG. 39(*b*) for case 2 where the electrical signals were in antiphase.

In both cases 1 and 2, SPL was measured at different distances (6 cm, 12.5 cm, 25 cm, 50 cm, 100 cm) over a range of frequencies along a path 45° to a z axis, and the results of these measurements are shown in FIG. 40(*a*) for case 1 and 40(*b*) for case 2.

As can be seen from a comparison of FIGS. 34(*a*) and 34(*b*) at 50 Hz:

For the dipole mode of operation (case 1) as shown in FIG. 40(*a*), the SPL at 12.5 cm is 101 dB and at 100 cm is 74 dB, meaning a drop in SPL of 25 dB between these two distances For the quadrupole mode of operation (case 2) as shown in FIG. 40(*b*), the SPL at 12.5 cm is 97 dB and at 100 cm is 60 dB, meaning a drop in SPL of 37 dB between these two distances, i.e. an improvement of 12 dB compared to the dipole mode This shows that a loudspeaker unit configured to operate with multiple diaphragms moving out of phase with each other is able to provide an improved cocooning effect compared with a dipole loudspeaker having the same area of radiating surfaces

REFERENCES

A number of publications are cited above in order to more fully describe and disclose the invention and the state of the art to which the invention pertains. Full citations for these references are provided below. The entirety of each of these references is incorporated herein.

[1] https://en.wikipedia.org/wiki/Equal-loudness_contour

[2] http://www.linkwitzlab.com

[3] https://www.techopedia.com/definition/31557/head-tracking

[4] http://www.autoguide.com/auto-news/2017/08/two-companies-are-working-on-bringing-in-car-sensing-tech-to-new-cars.html

[5] https://sharpbrains.com/blog/2014/09/02/general-motors-to-adopt-eye-head-tracking-technology-to-reduce-distracted-driving/

[6] http://www.patentlyapple.com/patently-apple/2016/08/apple-wins-patent-for-advanced-3d-eyehead-tracking-system-supporting-apples-3d-camera.html

[7] "Face Recognition and Head Tracking in Embedded Systems", Lenka Ivantysynova and Tobias Scheffer, Optik&Photonik, January 2015, pages 42-45.

What is claimed:

1. A loudspeaker unit for producing sound at bass frequencies including:

an array of two or more diaphragms, each diaphragm in the array having a first radiating surface and a second radiating surface, wherein the first radiating surface and the second radiating surface are located on opposite faces of the diaphragm;

a plurality of drive units, wherein each drive unit is configured to move a respective one of the diaphragms in the array based on a respective electrical signal;

a frame, wherein each diaphragm in the array is suspended from the frame via one or more suspension elements, wherein the frame is configured to allow sound produced by the first radiating surfaces to propagate out from the loudspeaker unit;

at least one enclosure configured to receive sound produced by the second radiating surfaces, wherein the enclosure includes a plurality of vents, wherein each vent is configured to allow sound produced by the second radiating surfaces to propagate out from the loudspeaker unit;

drive circuitry configured to provide each drive unit with a respective electrical signal derived from the same audio source such that the sound produced by the second radiating surfaces is out of phase with respect to the sound produced by the first radiating surfaces, wherein the loudspeaker unit is configured for use with a first ear of a user located at a first listening position that is 40 cm or less from the first radiating surface of one of the diaphragms whilst a second ear of the user is located at a second listening position that is 40 cm or less from the first radiating surface of one of the diaphragms;

the loudspeaker unit includes at least one pair of diaphragms;

the diaphragms in the/each pair is oriented with one of the diaphragms included in the/each pair having a first radiating surface that faces in a first direction and with the other one of the diaphragms included in the/each pair having a first radiating surface that faces in a second direction that is opposite to the first direction;

the plurality of vents include a first vent configured to allow sound to propagate out from the loudspeaker unit in a third direction that is transverse with respect to the first direction, and a second vent configured to allow sound to propagate out from the loudspeaker unit in a fourth direction that is opposite to the third direction.

2. A loudspeaker unit according to claim 1, wherein the enclosure includes one or more partitions configured to direct sound produced by the second radiating surface of each diaphragm out of a respective one of the vents.

3. A loudspeaker unit according to claim 1, wherein the loudspeaker unit is a subwoofer configured to produce sound at bass frequencies, wherein the bass frequencies includes frequencies across the range 50-100 Hz.

4. A loudspeaker unit according to 1, wherein the frame from which each diaphragm is suspended is a secondary frame, wherein the diaphragms are suspended from one or more primary frames via one or more primary suspension elements, wherein the/each primary frame is suspended from the secondary frame via one or more secondary suspension elements.

5. A loudspeaker unit according to 1, wherein the frame from which each diaphragm is suspended is part of or configured to fixedly attach to a rigid supporting structure.

6. A loudspeaker unit according to 1, wherein the loudspeaker unit is configured for use in performing noise cancelation at bass frequencies.

7. A loudspeaker unit according to claim 1, wherein the drive circuitry is configured to apply a predetermined delay to one or more of the electrical signals provided to the drive units.

* * * * *